US010926919B2

(12) United States Patent
Dominguez Guevara

(10) Patent No.: US 10,926,919 B2
(45) Date of Patent: Feb. 23, 2021

(54) CARDBOARD PALLET

(71) Applicant: Flex Ltd., Singapore (SG)

(72) Inventor: Alfonso Dominguez Guevara, Zapopan (MX)

(73) Assignee: Flex Ltd., Singapore (SG)

( * ) Notice: Subject to any disclaimer, the term of this patent is extended or adjusted under 35 U.S.C. 154(b) by 0 days.

(21) Appl. No.: 16/656,329

(22) Filed: Oct. 17, 2019

(65) Prior Publication Data

US 2020/0115099 A1 Apr. 16, 2020

Related U.S. Application Data

(63) Continuation of application No. 16/216,743, filed on Dec. 11, 2018, now abandoned.

(60) Provisional application No. 62/608,033, filed on Dec. 20, 2017, provisional application No. 62/597,162, filed on Dec. 11, 2017.

(51) Int. Cl.
*B65D 19/00* (2006.01)

(52) U.S. Cl.
CPC ..... *B65D 19/0073* (2013.01); *B65D 19/0071* (2013.01); *B65D 19/0095* (2013.01); *B65D 2519/00019* (2013.01); *B65D 2519/00054* (2013.01); *B65D 2519/00089* (2013.01); *B65D 2519/00124* (2013.01); *B65D 2519/00273* (2013.01); *B65D 2519/00293* (2013.01); *B65D 2519/00323* (2013.01); *B65D 2519/00333* (2013.01); *B65D 2519/00343* (2013.01); *B65D 2519/00373* (2013.01); *B65D 2519/00378* (2013.01); *B65D 2519/00432* (2013.01); *B65D 2519/00447* (2013.01); *B65D 2519/00567* (2013.01)

(58) Field of Classification Search
CPC ..... B65D 19/20
USPC ..... 108/51.3
See application file for complete search history.

(56) References Cited

U.S. PATENT DOCUMENTS 3,952,672 A * 4/1976 Gordon ..... B65D 19/0012 108/51.3
4,979,446 A * 12/1990 Winebarger ..... B65D 19/0024 108/51.3
5,528,994 A 6/1996 Iseli
5,531,165 A * 7/1996 Taravella ..... B65D 19/0012 108/51.3

(Continued)

FOREIGN PATENT DOCUMENTS

WO WO 2011/003126 1/2011
WO WO-2011003126 A1 * 1/2011 ..... B65D 19/20

OTHER PUBLICATIONS

Official Action for U.S. Appl. No. 16/216,743, dated Jul. 18, 2019 15 pages.

*Primary Examiner* — Daniel J Rohrhoff
(74) *Attorney, Agent, or Firm* — Sheridan Ross P.C.

(57) ABSTRACT

Methods, devices, and systems for assembling a pallet are provided. In particular, a pallet is provided that is made from multiple pieces that are bent from an initial planar shape to a final shape. In some embodiments, a transverse piece locks at least one longitudinal piece in the final shape without the use of fasteners or adhesives. The resulting pallet can be loaded with materials and then maneuvered and transported using a forklift. In addition, the pieces can be made from cardboard which significantly reduces the weight of the pallet.

18 Claims, 46 Drawing Sheets

(56) References Cited

U.S. PATENT DOCUMENTS 5,784,971 A * 7/1998 Chang ..... B65D 19/0059 108/51.3
5,816,172 A 10/1998 Carter
5,996,510 A 12/1999 Harpman et al.
6,079,337 A * 6/2000 Huang ..... B65D 19/0012 108/51.3
6,612,247 B1 9/2003 Pistner et al.
6,739,270 B1 * 5/2004 Sewell ..... B65D 19/0012 108/51.3
7,426,890 B2 * 9/2008 Olvey ..... B65D 19/0036 108/51.3
8,601,955 B2 12/2013 Casey et al.
8,695,511 B2 4/2014 Casey et al.
9,090,379 B2 * 7/2015 Nelson ..... B65D 19/0026
9,555,924 B2 * 1/2017 Olvey ..... B65D 19/0012
9,919,834 B2 3/2018 Linares
2005/0092214 A1 5/2005 Edell
2005/0247240 A1 * 11/2005 Nelson ..... B65D 19/0012 108/51.3
2006/0236899 A1 * 10/2006 Nelson ..... B65D 19/0012 108/51.3
2008/0295747 A1 * 12/2008 Vinderola ..... B65D 19/0028 108/51.3
2009/0188411 A1 * 7/2009 Gibson ..... B65D 19/0022 108/51.3
2009/0223421 A1 9/2009 Ferguson
2009/0308289 A1 12/2009 Ferguson
2010/0175595 A1 * 7/2010 Grietens ..... B65D 19/0095 108/51.3
2012/0204767 A1 * 8/2012 Jian ..... B65D 19/0028 108/51.3
2017/0015463 A1 * 1/2017 Gabrys ..... B65D 73/0042
2018/0273242 A1 * 9/2018 Van Riper ..... B65D 19/0012
2019/0177036 A1 6/2019 Guevara

* cited by examiner

CARDBOARD PALLET

CROSS REFERENCE TO RELATED APPLICATION

The present application is a continuation of and claims priority to U.S. patent application Ser. No. 16/216,743 filed on Dec. 11, 2018 by Alfonso Dominguez Guevara and entitled "Cardboard Pallet", which claims the benefits of and priority, under 35 U.S.C. § 119(e), to U.S. Provisional Application No. 62/597,162 filed Dec. 11, 2017 by Alfonso Dominguez Guevara and entitled "Cardboard Pallet", and U.S. patent application Ser. No. 16/216,743 claims the benefits of and priority, under 35 U.S.C. § 119(e), to U.S. Provisional Application No. 62/608,033 filed Dec. 20, 2017 by Alfonso Dominguez Guevara and entitled "Cardboard Pallet", of which the entire disclosures are incorporated herein by reference for all purposes.

FIELD

The present disclosure is generally directed to the pallets and portable structures for handling, storing, or transporting materials.

BACKGROUND

Traditional pallets are generally made from wood or other similar materials, and the pallet provides a stable, weight-bearing surface for handling, storing, or transporting materials. However, there are several shortcomings with traditional pallets. Traditional pallets can weigh between 33-40 pounds and can be difficult to handle. Furthermore, a falling pallet or the failure of a pallet can result in injury due to the heavy weight of a traditional pallet.

The material construction of traditional pallets presents additional issues. For example, wooden packaging materials, such as pallets, require fumigation to prevent pests from traveling with the pallets as the pallets are shipped around the world. Fumigation treatments can include debarking, heat treatment, and/or methyl bromide treatment. These treatments increase costs and can pose environmental issues depending on the type of treatment. Traditional pallets are typically made from wood and other materials such as metal fasteners, which can make the pallet more difficult to recycle due to the need for disassembly or shredding.

BRIEF SUMMARY

Methods, devices, and systems for assembling a pallet are provided. In particular, multiple pieces can be bent and selectively connected with each other without the use of fasteners or adhesives to form the pallet. In addition, the pieces can be made from cardboard to significantly reduce the weight of the pallet. These aspects of the various exemplary embodiments and other aspects described herein address the above issues with traditional pallets.

According to one embodiment, a pallet can comprise at least one longitudinal piece that is bent into a final shape and then locked in a final shape with a transverse piece. The longitudinal piece can have an initial shape that is substantially planar, and bend lines on the longitudinal piece indicate where the longitudinal piece can be bent to form the final shape. The bend lines can also define which portions of the longitudinal piece are horizontal portions in the final shape, are vertical portions in the final shape, or any other orientation in the final shape. Generally, the horizontal portions define the horizontal extent of the pallet, and as described in further detail below, the horizontal portions can at least partially define the fork apertures of the pallet. The vertical portions define the vertical extent of the pallet, which is the smallest dimension of the pallet. Therefore, stated another way, the vertical portions are substantially perpendicular to the top surface of the pallet that receives the materials, loads, etc. to be transported using the pallet. Therefore, the force from the materials, loads, etc. extends through a planar direction of the vertical portions, and the planar direction of the vertical portions is the strongest with respect to compressive forces.

A transverse piece selectively connects to the at least one longitudinal piece to lock the longitudinal piece in the final shape and to lock the horizontal and vertical portions in the horizontal and vertical directions, respectively. In some embodiments, transverse slots extend across the longitudinal piece in a direction that is perpendicular to the bend lines. In other embodiments, the transverse slots extend into the longitudinal piece in a direction that is substantially parallel to the bend lines. In either instance, the transverse piece engages these transverse slots, and the transverse piece can have at least a portion that is substantially perpendicular to both the horizontal portion and the vertical portion of the longitudinal piece. In addition, the transverse piece may have a series of recesses on the portions of the transverse piece that selectively connect to the longitudinal piece and engage the transverse slots. The recesses generally correspond to the vertical portions and/or the horizontal portions of the longitudinal piece to provide a more complete and secure selective connection with the longitudinal piece. The orientation of the transverse slots and the transverse piece contributes to the ability of the transverse piece to lock the longitudinal piece in the final shape.

According to one embodiment, a pallet can comprise pieces that are joined together in an interference fit without the use of separate fasteners or adhesives. As the pieces are bent from an initial shape to a final shape, the pieces have a tendency to unfurl or revert back to the initial shape. This aspect of the pieces is utilized to lock the pieces together in an interference fit. An exemplary longitudinal piece has several bend lines that are substantially parallel to each other. Therefore, when the longitudinal piece is bent into a final shape, the longitudinal piece has a tendency to unfurl in a single direction. A transverse piece can have a series of recesses that receive the vertical portions and/or horizontal portions of the longitudinal piece, and the tendency of the longitudinal piece to unfurl causes the vertical and horizontal portions to press against the transverse piece within a given recess to lock the transverse piece and the longitudinal piece together.

A similar aspect of the transverse piece is utilized to enhance the interference fit between pieces. The transverse piece may also have bend lines, an initial shape, a final shape, and a tendency to unfurl from the final shape to the initial shape. When the transverse piece is positioned within the transverse slots of the longitudinal piece, the tendency to unfurl causes the transverse piece to press against the longitudinal piece within the transverse slot to lock the transverse piece and the longitudinal piece together.

According to one embodiment, a pallet can comprise multiple pieces to enhance the performance of the pallet and increase the compressive strength of the pallet. As described above, the vertical portions can provide the requisite compressive strength of the pallet. Additional longitudinal pieces (second longitudinal pieces, third longitudinal pieces, etc.) can be added to the original longitudinal piece so that vertical portions from multiple pieces can reinforce each other and/or distribute loads from an upper surface of the pallet across more vertical portions. Similarly, horizontal portions from multiple pieces can reinforce each other and/or distribute loads from various directions.

According to one embodiment, a pallet can comprise a planar piece that provides an upper surface of the pallet to receive materials. It may be advantageous to have a continuous upper surface of the pallet to distribute loads to the other pieces of the pallet and to provide a surface that can contain disparate parts on a common surface. For instance, a planar piece can receive aggregate materials such as gravel on a common surface rather than have individual pieces of gravel slip through the pallet onto the ground. Similar to other pieces described herein, a planar piece can have bend lines, and the planar piece can be bent from an initial shape to a final shape. The longitudinal pieces can have planar slots that are configured to receive ends of the planar piece. Like the transverse piece, the planar piece can have recesses that correspond to vertical portions and/or horizontal portions of the longitudinal pieces to better selectively connect the planar piece and the longitudinal pieces.

According to one embodiment, a pallet can comprise a plurality of fork apertures to receive the forks of a forklift. Pallets have recesses or apertures that receive the forks of a forklift so that the forklift can maneuver the pallet and transport the load on the pallet. In embodiments of the present disclosure, fork slots in the various pieces can at least partially define a fork aperture in the pallet. In addition or in the alternative, the various portions of the pieces themselves, such as the horizontal and vertical portion of the longitudinal pieces, can define a fork aperture in the pallet. These fork apertures are generally arranged with a first and second fork aperture oriented parallel to each other and extending through the pallet and with a third and fourth fork aperture oriented parallel to each other and extending through the pallet. As a result, a forklift with two parallel forks can engage the pallet from four different sides. The first and second fork apertures may intersect the third and fourth fork apertures.

According to one embodiment, a pallet can comprise components made from cardboard such as a corrugated fiberboard that has a fluted corrugated sheet and a linerboard. Corrugated fiberboard can be characterized in a number of ways, for example, the fiberboard and/or liner board may be made from paper using the kraft process. Further, the fluted corrugated sheet may have different flute sizes and pitches graded from A to F where a B flute has 47+/−3 flutes per linear foot and a flute thickness of ⅛ inch, and a C flute has 39+/−3 flutes per linear foot and a flute thickness of 5/32 inch. A BC flute is a double-walled corrugated board where three liner boards provide space for two fluted corrugated sheets, where one fluted corrugated sheet has a B flute and the other fluted corrugated sheet has a C flute. Next, an edge crush test determines the strength of a piece of cardboard, and in this test, the edges of a piece of cardboard are placed between two plates and then subjected to a compressive force. A peak force is identified in pounds/inch. Therefore, an exemplary piece of cardboard may be identified as kraft flute BC ECT 42 fiberboard. This piece has components made from the kraft process, has a double-wall design with a B flute and a C flute, and has an edge crush test value of 42 pounds/inch. It will be appreciated that the embodiments described in this disclosure can utilize this type of cardboard, other types of cardboard, or any other material that can be used in accordance with the description herein.

DETAILED DESCRIPTION

It is with respect to the above issues and other problems that the embodiments presented herein were contemplated. In general, embodiments of the present disclosure provide methods, devices, and systems for assembling pallets from a plurality of pieces without additional fasteners, glue, or prior construction experience. Due to the features described in further detail below, the pieces can lock together using friction forces to form an interference fit. In addition, the pieces can be made from a material such as cardboard to lighten the weight of the pallet and reduce the likelihood of injuries from falling or failing pallets. The pallets described herein can be easily assembled, do not require fumigation or other similar post processing, reduce the likelihood of injury, and can be easily recycled.

First Exemplary Embodiment

Figure 1B:
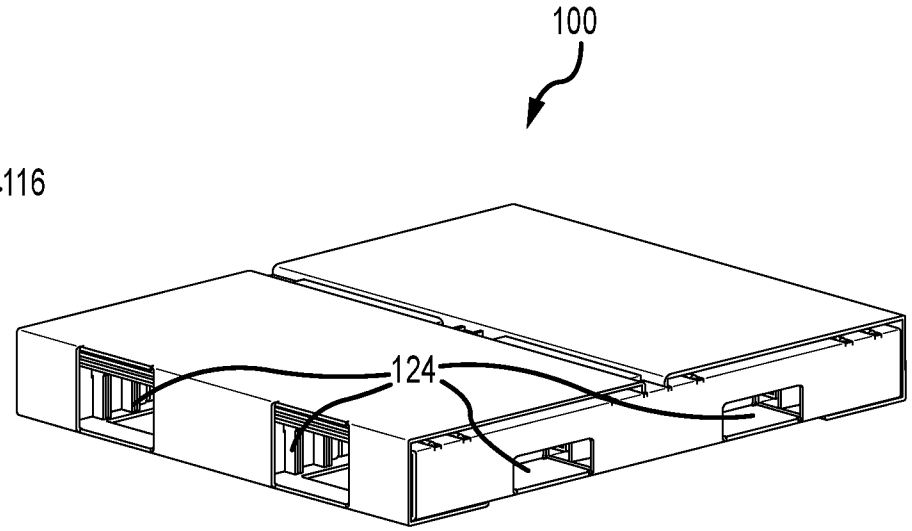
FIG. 1B is an assembled, perspective view of the pallet of FIG. 1A in accordance with embodiments of the present disclosure.
Figure 1A:
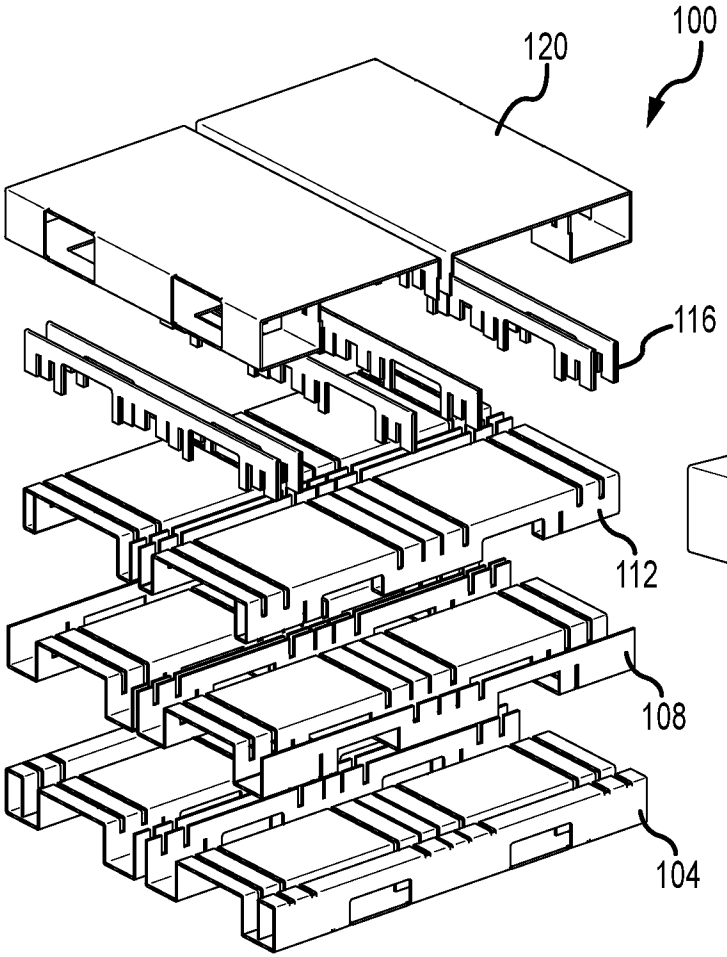
FIG. 1A is an exploded, perspective view of a pallet in accordance with embodiments of the present disclosure.

FIGS. 1A and 1B are an exploded view and an assembled view of a pallet 100, respectively. Referring to FIG. 1A, this embodiment of the pallet 100 comprises a first longitudinal piece 104, a second longitudinal piece 108, a third longitudinal piece 112, a transverse piece 116, and a planar piece 120. The longitudinal pieces 104, 108, 112 are bent to provide horizontal and vertical portions that are generally oriented perpendicular to each other and extend in a longitudinal direction. The horizontal portions extend to define a width of the pallet 100 and also to define some fork apertures 124 configured to receive the forks of a forklift so that the pallet 100, once loaded, can be transported by the forklift. In this embodiment, the pallet 100 has two sets of fork apertures 124 so that the forklift can engage the pallet 100 from four different sides. The vertical portions define the smallest dimension of the pallet 100 and provide the requisite compressive strength to handle the loads, materials, devices, etc. placed on the top of the pallet 100. As described in further detail below, multiple pieces with vertical portions can be positioned within each other to reinforce the vertical portions, distribute forces, and provide the requisite compressive strength of the pallet 100.

Next, transverse pieces 116 hold the longitudinal pieces 104, 108, 112 in a final shape. The longitudinal pieces 104, 108, 112 are each folded from a single piece of material such as cardboard. As a result, the longitudinal pieces 104, 108, 112 have a tendency to unfurl or revert to their initial shapes or original planar shapes. The transverse pieces 116 are oriented perpendicular to both the horizontal and vertical portions of the longitudinal pieces 104, 108, 112 and lock into each longitudinal piece 104, 108, 112 to hold the longitudinal pieces 104, 108, 112 in their final shapes and to hold the horizontal and vertical portions in the desired orientations. This arrangement provides an interference fit between the transverse pieces 116 and the longitudinal pieces 104, 108, 112 that holds the pieces 104, 108, 112, 116 together. Lastly, planar pieces 120 can similarly selectively connect with the longitudinal and transverse pieces 104, 108, 112, 116, and the planar pieces 120 provide a flat, continuous surface on top of the pallet 100 to receive materials. FIGS. 2A-6B show the bend lines and other features of each individual piece, and FIGS. 7A-7E show a sequence of assembling the pieces to form a pallet 100.

Figure 2B:
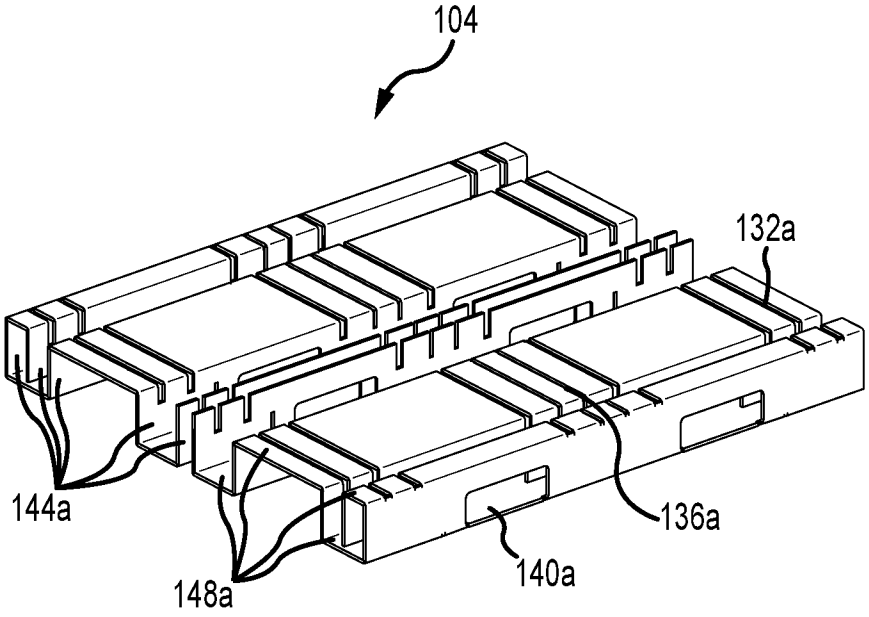
FIG. 2B is a perspective view of the first longitudinal piece of FIG. 2A in a final shape in accordance with embodiments of the present disclosure.
Figure 2A:
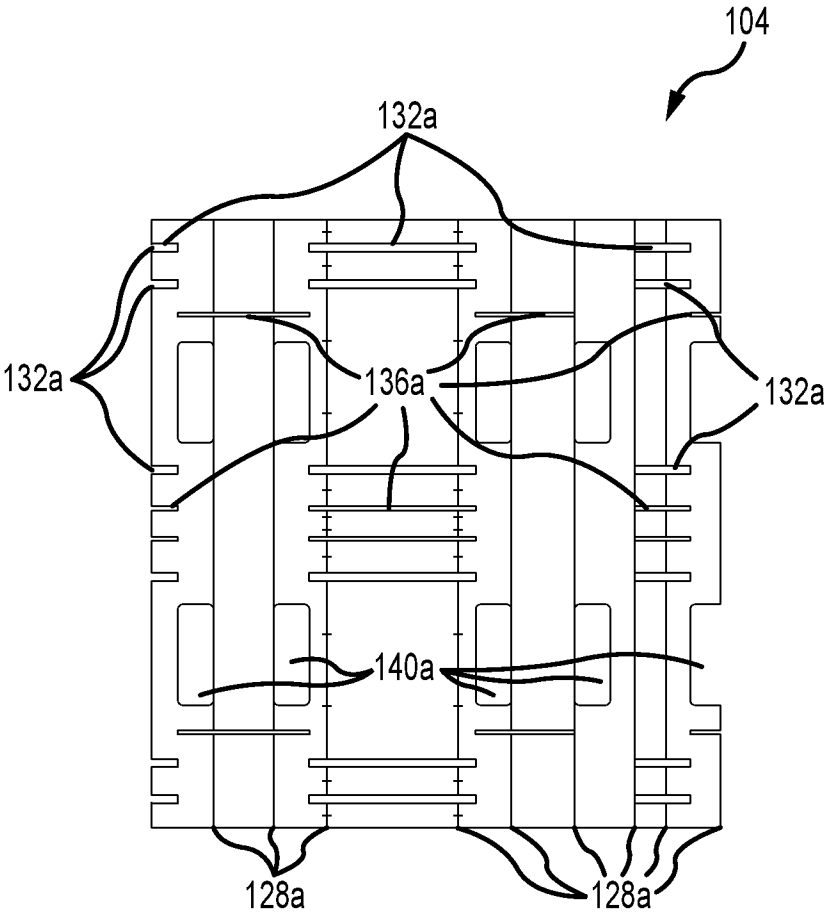
FIG. 2A is a top plan view of a first longitudinal piece in an initial shape in accordance with embodiments of the present disclosure.

FIGS. 2A and 2B show the first longitudinal piece 104 in an initial shape and a final shape, respectively. Referring to FIG. 2A, the first longitudinal piece 104 can be made from a single piece of material such as cardboard. To begin, a series of bend lines 128*a* extend along a longitudinal length of the piece 104, and the portions between the bend lines 128*a* are the horizontal and vertical portions that are described in more detail below with respect to FIG. 2B. Next, a series of slots define a transverse slot 132*a* that ultimately receives the transverse piece. Three slots define a transverse slot 132*a* once the first longitudinal piece 104 is bent into the final shape. Though three constituent slots define a single transverse slot 132*a*, it will be appreciated that in some embodiments, each constituent slot may be referred to a single transverse slot 132*a*. In FIG. 2A, three transverse slots 132*a* are identified on an upper half of the first longitudinal piece 104, and the piece 104 generally exhibits symmetry about a midline so there are six transverse slots 132*a* in total.

Next, a series of slots define a planar slot 136*a* that receives one end of one planar piece. As shown, three slots define a planar slot 136*a* once the first longitudinal piece 104 is bent into the final shape. Two planar slots 136*a* are provided on the upper half of the first longitudinal piece 104 where each planar slot 136*a* receives one end of the planar piece. Again, with symmetry about a midline, there are four total planar slots 136*a*. The first longitudinal piece 104 also has fork slots 140*a* that define some fork apertures configured to receive the forks of a forklift. Five slots together define a fork slot 140*a* once the first longitudinal piece 104 is bent into the final shape. One fork slot 140*a* is identified on a lower half of the first longitudinal piece 104, and with symmetry about a midline, the first longitudinal piece 104 has two total fork slots 140*a*.

Referring to FIG. 2B, the first longitudinal piece 104 is shown in a final shape where the piece 104 has been bent about each bend line to define several horizontal portions 148*a* and vertical portions 144*a*. Also shown in FIG. 2B is how several slots form, for example, a transverse slot 132*a*, a planar slot 136*a*, and a fork slot 140*a*. The final pallet utilizes two first longitudinal pieces 104 as shown in FIG. 2B.

Figure 3B:
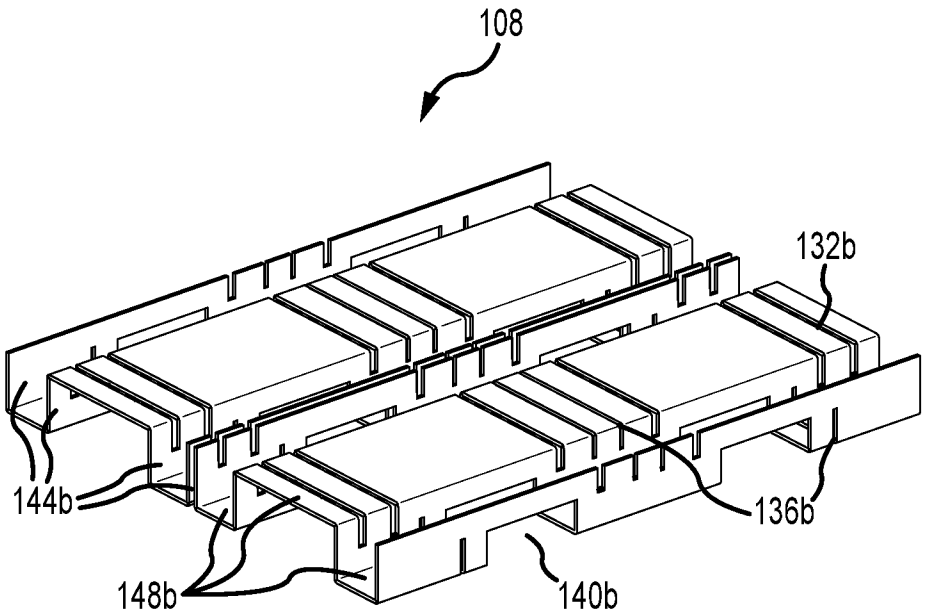
FIG. 3B is a perspective view of the second longitudinal piece of FIG. 3A in a final shape in accordance with embodiments of the present disclosure.
Figure 3A:
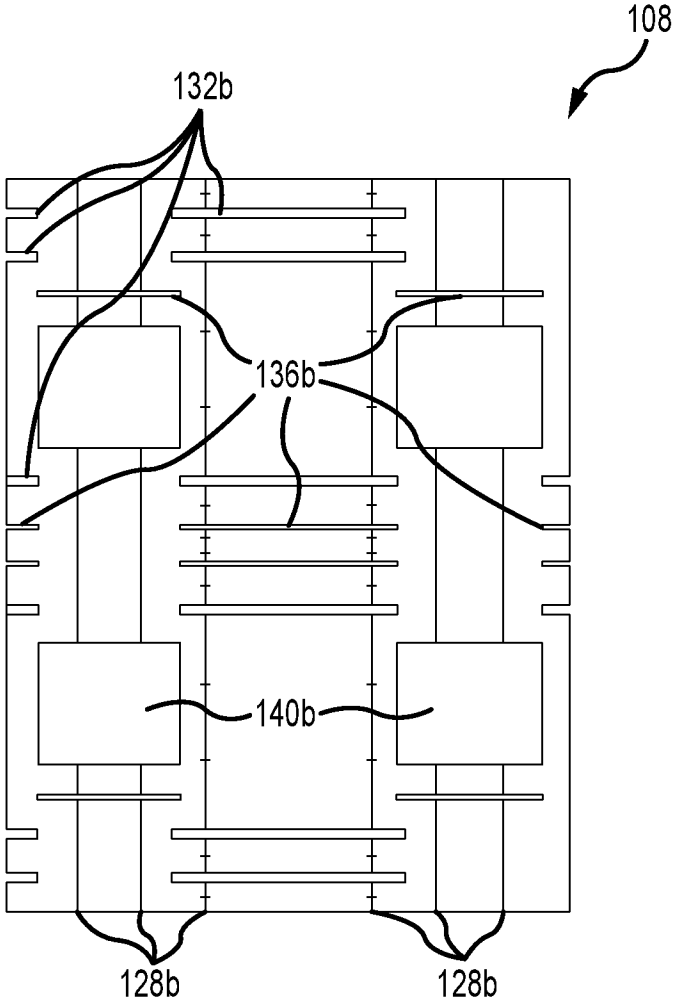
FIG. 3A is a top plan view of a second longitudinal piece in an initial shape in accordance with embodiments of the present disclosure.

FIGS. 3A and 3B show the second longitudinal piece 108 in an initial shape and a final shape, respectively. Referring to FIG. 3A, the second longitudinal piece 108 can be made from a single piece of material such as cardboard. To begin, a series of bend lines 128*b* extend along a longitudinal length of the piece 108, and the portions between the bend lines 128*b* are the horizontal and vertical portions that are described in more detail below with respect to FIG. 3B. Next, a series of slots define a transverse slot 132*b* that ultimately receives the transverse piece. As shown, two slots together form a transverse slot 132*b* once the second longitudinal piece 108 is bent into the final shape. In FIG. 3A, three transverse slots 132*b* are identified on an upper half of the second longitudinal piece 108, and the piece 108 generally exhibits symmetry about a midline so there are six transverse slots 132*b* in total.

Next, a series of slots define a planar slot 136*b* that receives one end of one planar piece. As shown, two or three slots define a planar slot 136*b* once the second longitudinal piece 108 is bent into the final shape. Two planar slots 136*b* are provided on the upper half of the second longitudinal piece 108 where each planar slot 136*b* receives one end of the planar piece. Again, with symmetry about a midline, there are four total planar slots 136*b*. The second longitudinal piece 108 also has fork slots 140*b* that define some fork apertures configured to receive the forks of a forklift. Two slots together define a fork slot 140*b* once the second longitudinal piece 108 is bent into the final shape. One fork slot 140*a* is identified on a lower half of the first longitudinal piece 104, and with symmetry about a midline, the second longitudinal piece 108 has two total fork slots 140*b*.

Referring to FIG. 3B, the second longitudinal piece 108 is shown in a final shape where the piece 108 has been bent about each bend line to define several horizontal portions 148*b* and vertical portions 144*b*. Also shown in FIG. 3B is how several slots form, for example, a transverse slot 132*b*, a planar slot 136*b*, and a fork slot 140*b*. The final pallet utilizes two second longitudinal pieces 108 as shown in FIG. 3B.

Figure 4B:
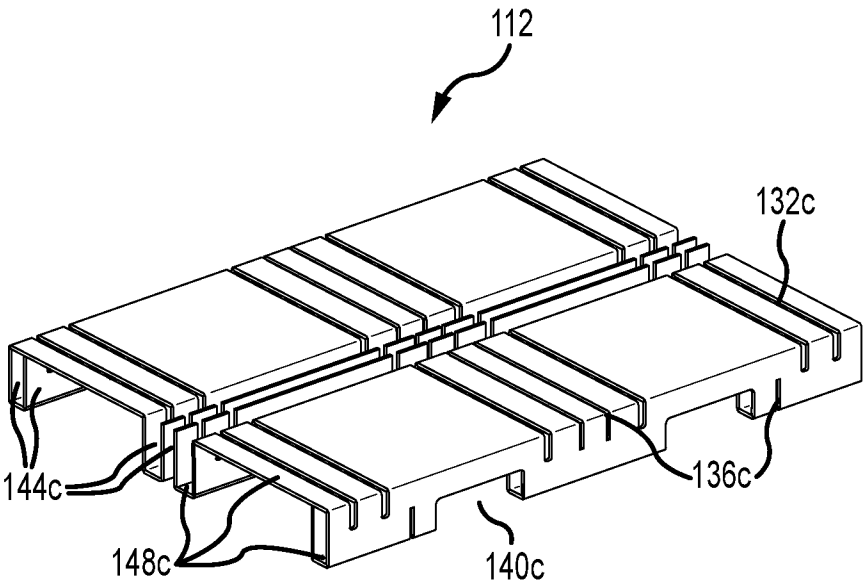
FIG. 4B is a perspective view of the third longitudinal piece of FIG. 4A in a final shape in accordance with embodiments of the present disclosure.
Figure 4A:
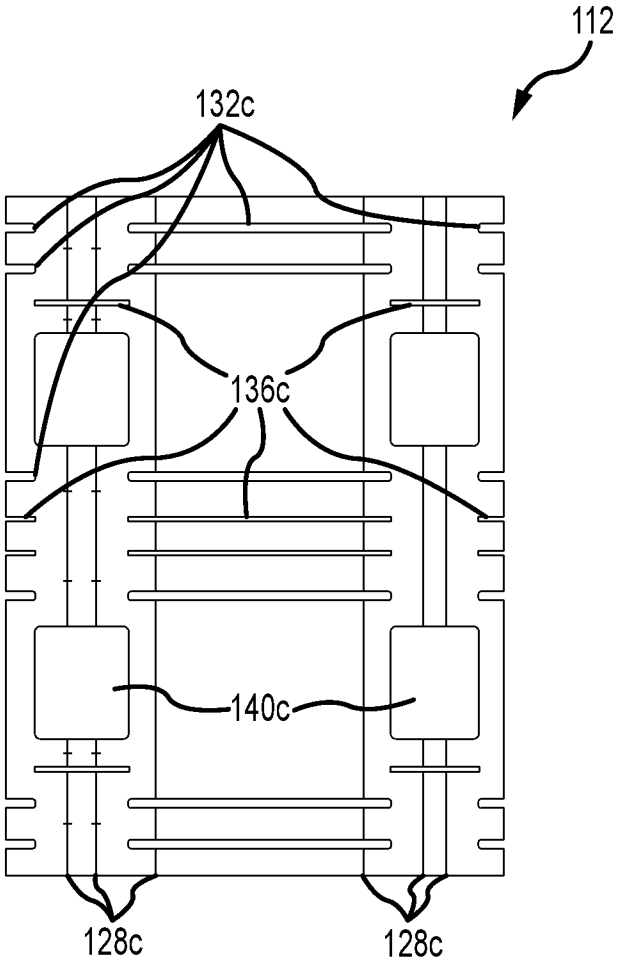
FIG. 4A is a top plan view of a third longitudinal piece in an initial shape in accordance with embodiments of the present disclosure.

FIGS. 4A and 4B show the third longitudinal piece 112 in an initial shape and a final shape, respectively. Referring to FIG. 4A, the third longitudinal piece 112 can be made from a single piece of material such as cardboard. To begin, a series of bend lines 128*c* extend along a longitudinal length of the piece 112, and the portions between the bend lines 128*c* are the horizontal and vertical portions that are described in more detail below with respect to FIG. 4B. Next, a series of slots define a transverse slot 132*c* that ultimately receives the transverse piece. Three slots define a transverse slot 132*c* once the third longitudinal piece 112 is bent into the final shape. In FIG. 4A, three transverse slots 132*c* are identified on an upper half of the third longitudinal piece 112, and the piece 112 generally exhibits symmetry about a midline so there are six transverse slots 132*c* in total.

Next, a series of slots define a planar slot 136*c* that receives one end of one planar piece. As shown, two or three slots define a planar slot 136*c* once the third longitudinal piece 112 is bent into the final shape. Two planar slots 136*c* are provided on the upper half of the third longitudinal piece 112 where each planar slot 136*c* receives one end of the planar piece. Again, with symmetry about a midline, there are four total planar slots 136*c*. The third longitudinal piece 112 also has fork slots 140*c* that define some fork apertures configured to receive the forks of a forklift. Two slots together define a fork slot 140*c* once the third longitudinal piece 112 is bent into the final shape. One fork slot 140*c* is identified on a lower half of the first longitudinal piece 104, and with symmetry about a midline, the third longitudinal piece 112 has two total fork slots 140*c*.

Referring to FIG. 4B, the third longitudinal piece 112 is shown in a final shape where the piece 112 has been bent about each bend line to define several horizontal portions 148*c* and vertical portions 144*c*. Also shown in FIG. 4B is how several slots form, for example, a transverse slot 132*c*, a planar slot 136*c*, and a fork slot 140*c*. The final pallet utilizes two third longitudinal pieces 112 as shown in FIG. 4B.

Figure 5B:
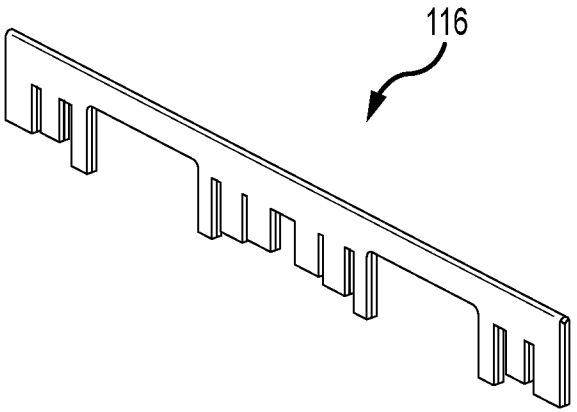
FIG. 5B is a perspective view of the transverse piece of FIG. 5A in a final shape in accordance with embodiments of the present disclosure.
Figure 5A:
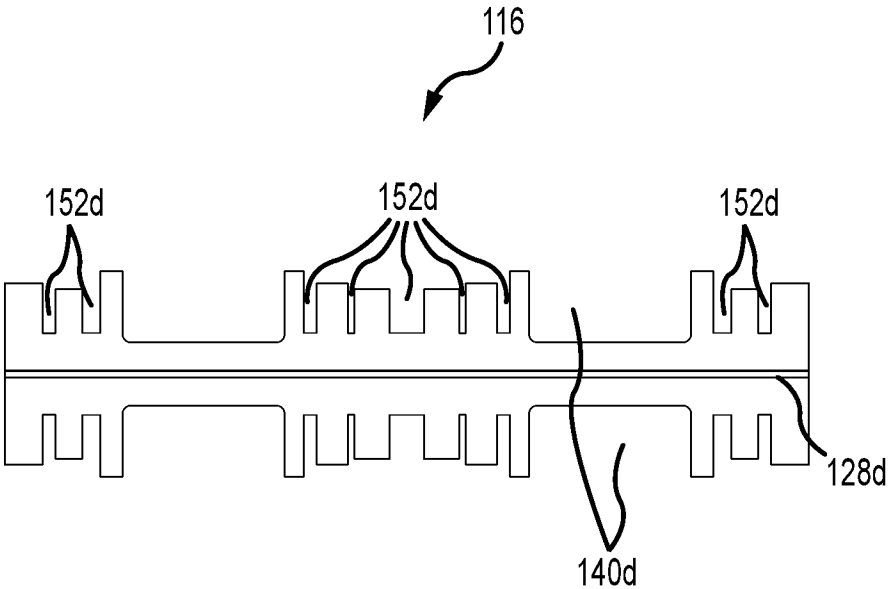
FIG. 5A is a top plan view of a transverse piece in an initial shape in accordance with embodiments of the present disclosure.

FIGS. 5A and 5B show a transverse piece 116 in an initial shape and a final shape, respectively. Referring to FIG. 5A, the transverse piece may be made from a single piece of planar cardboard. A bend line 128*d* extends across the transverse piece 116, and the transverse piece 116 has two slots that together define a fork slot 140*d* once the transverse piece is bent into a final shape. There is one fork slot 140*d* on a right half of the piece 116 and since the transverse piece 116 is symmetric about a midline, the transverse piece 116 has two fork slots 140*d* in total. Next, the transverse piece 116 has a series of recesses 152*d*. These recesses 152*d* generally correspond to vertical portions of the longitudinal pieces. This allows the transverse pieces 116 to extend completely downward into the transverse slots of the longitudinal pieces so that the tops of the transverse pieces 116 are flush or substantially flush with the tops of the longitudinal pieces. In addition, the recesses 152*d* help resist the tendency of the longitudinal pieces to unfurl and provide an interference fit between the transverse pieces 116 and the longitudinal pieces. Referring to FIG. 5B, the transverse piece 116 is folded about the bend line. Like the longitudinal pieces, the transverse piece 116 also generally has some bias back towards the initial position. This aspect helps lock the transverse piece 116 into the transverse slots in an interference fit.

Figure 6B:
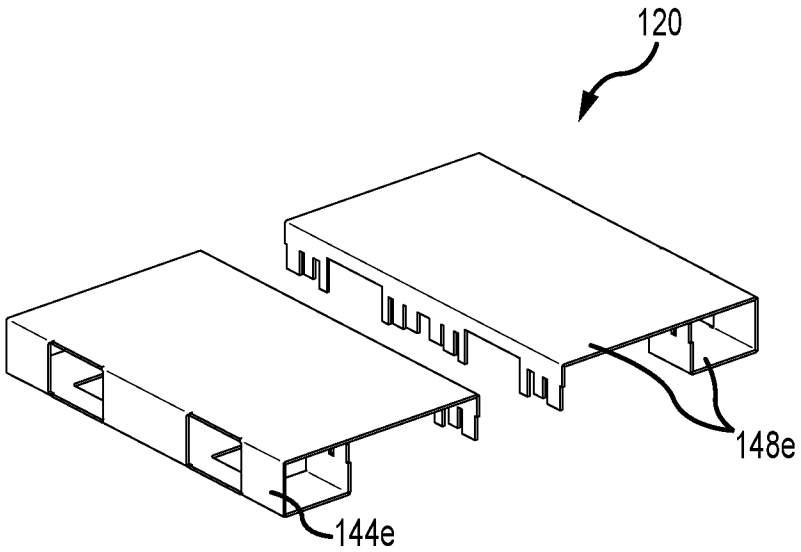
FIG. 6B is a perspective view of the planar piece of FIG. 6A in a final shape in accordance with embodiments of the present disclosure.
Figure 6A:
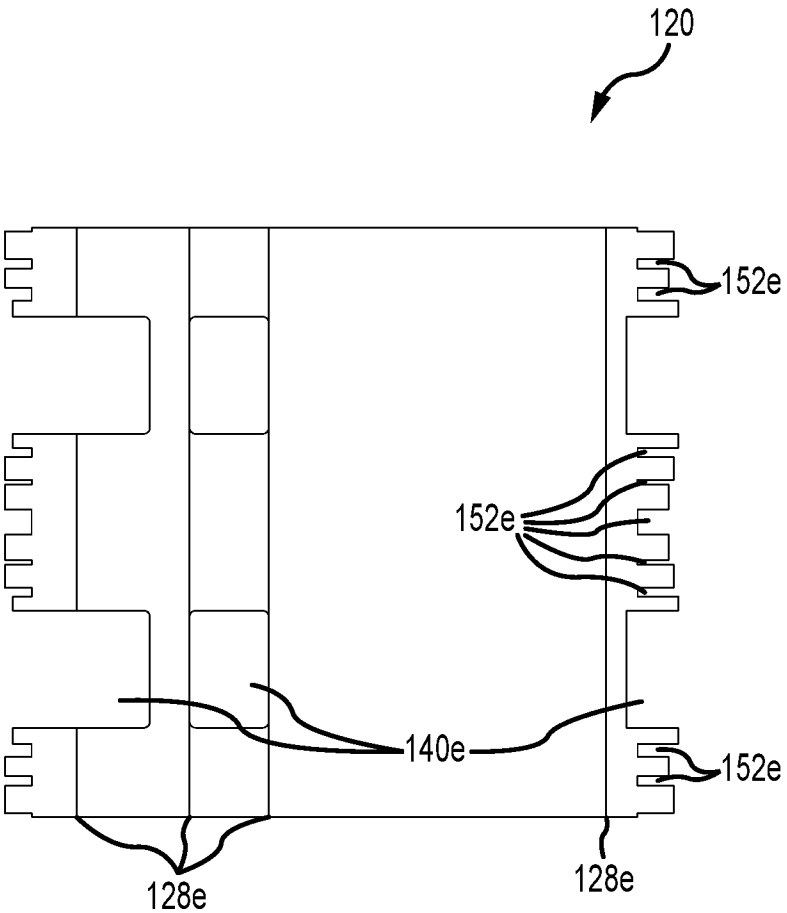
FIG. 6A is a top plan view of a planar piece in an initial shape in accordance with embodiments of the present disclosure.

FIGS. 6A and 6B show a planar piece 120 in an initial shape and a final shape, respectively. Referring to FIG. 6A, the planar piece 120 may be made from a single piece of planar cardboard. Several bend lines 128*e* extend along the planar piece 120. The planar piece 120 has a series of slots that form a fork slot 140*e*. Three slots form a fork slot 140*e*, and one fork slot 140*e* is identified on the lower half of the piece 120. Since the planar piece 120 is generally symmetric about a midline, there are two fork slots 140*e*. Next, at a right end, the planar piece 120 has a series of recesses 152*e* that allow the end of the planar piece 120 to fully extend into the planar slots of the longitudinal pieces. The recesses 152*e* correspond to vertical portions of the longitudinal pieces. The planar piece 120 also has a set of recesses 152*e* at a second end on the left that allow the second end of the planar piece 120 to fully extend into a second planar slot in the longitudinal pieces. Referring to FIG. 6B, the planar piece is in a final shape, and the bend lines define several vertical and horizontal portions 144*e*, 148*e*. The pallet utilizes two planar pieces 120 to define an upper surface of the pallet.

Figure 7A:
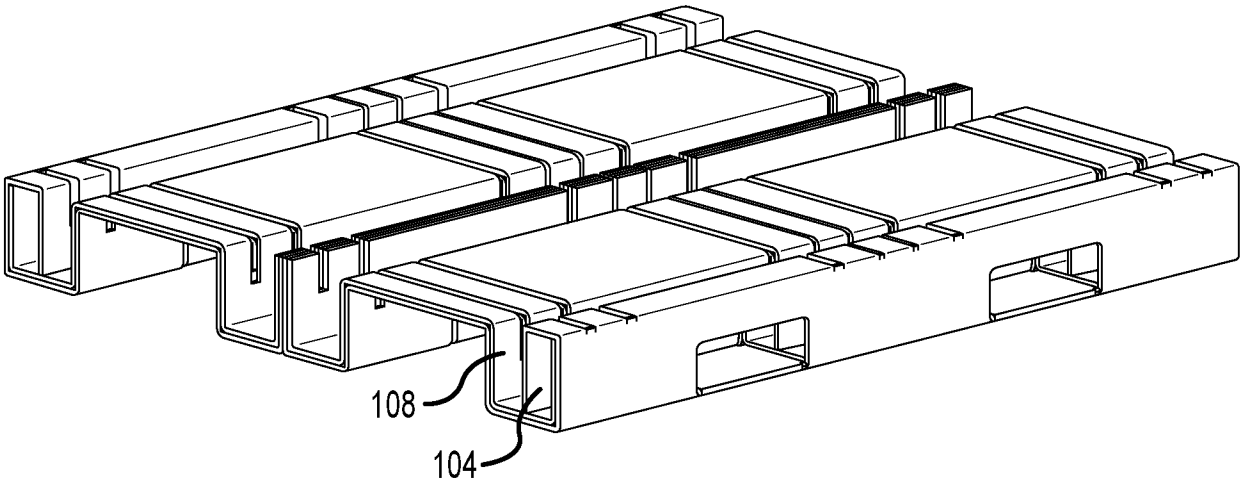
FIG. 7A is a perspective view of first longitudinal pieces of FIGS. 2A-2B positioned within respective second longitudinal pieces of FIGS. 3A-3B in accordance with embodiments of the present disclosure.
Figure 7B:
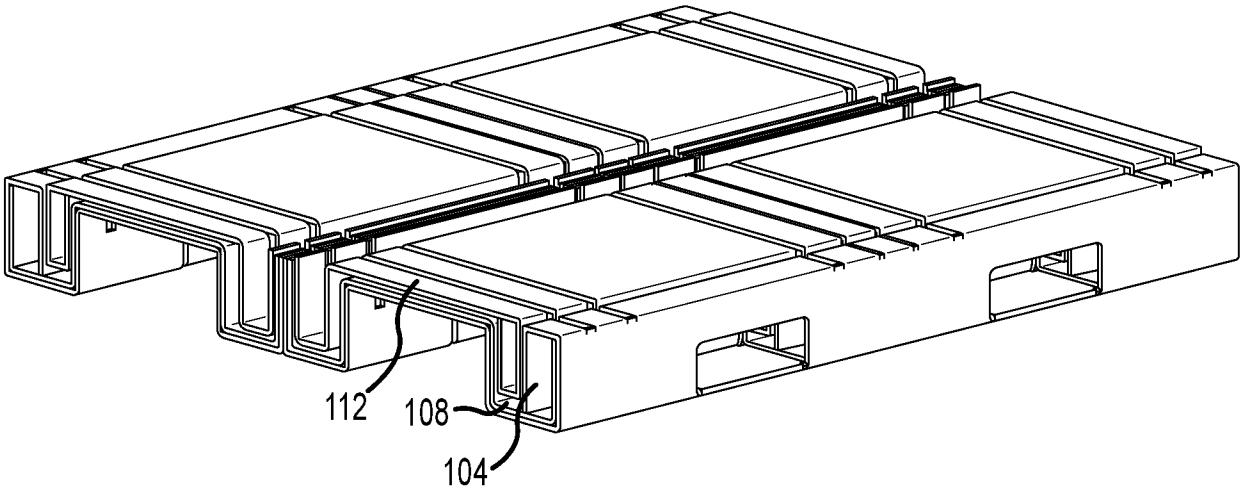
FIG. 7B is a perspective view of third longitudinal pieces of FIGS. 4A-4B positioned within respective first and second longitudinal pieces of FIG. 7A in accordance with embodiments of the present disclosure.

FIGS. 7A-7E show a sequence of assembling the various pieces to form a pallet. FIG. 7A shows a second longitudinal piece 108 nested within a first longitudinal piece 104. In this embodiment, there are two first longitudinal pieces 104 and two second longitudinal pieces 108. These pieces are positioned such that their respective vertical portions, horizontal portions, and slots align. FIG. 7B shows two third longitudinal pieces 112 added to the combination of FIG. 7A. Again, the portions and slots of the third longitudinal pieces 112 are aligned with the portions and slots of the first and second longitudinal pieces 104, 108.

Figure 7C:
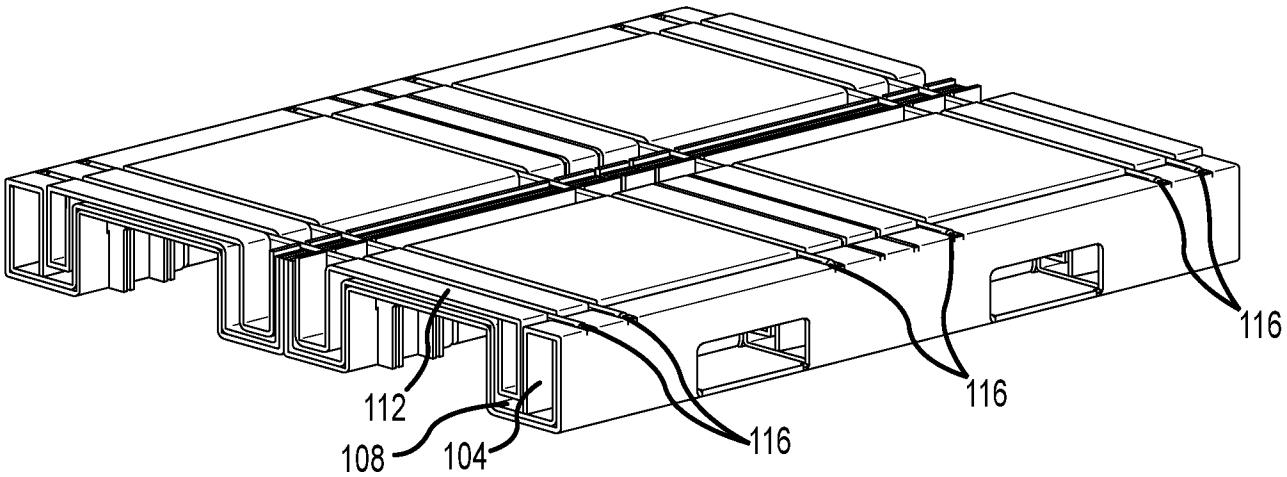
FIG. 7C is a perspective view of six transverse pieces of FIGS. 5A-5B positioned across the first, second, and third longitudinal pieces of FIG. 7B in accordance with embodiments of the present disclosure.

FIG. 7C shows six transverse pieces positioned in the six transverse slots of each of the longitudinal pieces 104, 108, 112. The recesses of the transverse pieces 116 align with the vertical portions of the longitudinal pieces 104, 108, 112 so that the transverse pieces 116 can fully extend into the longitudinal pieces 104, 108, 112. The transverse pieces 116 prevent the longitudinal pieces 104, 108, 112 from unfurling to the initial shape of the pieces 104, 108, 112. Similarly, the transverse slots of the longitudinal pieces 104, 108, 112 prevent the transverse pieces 116 from unfurling to the initial shape of the piece 116.

Figure 7D:
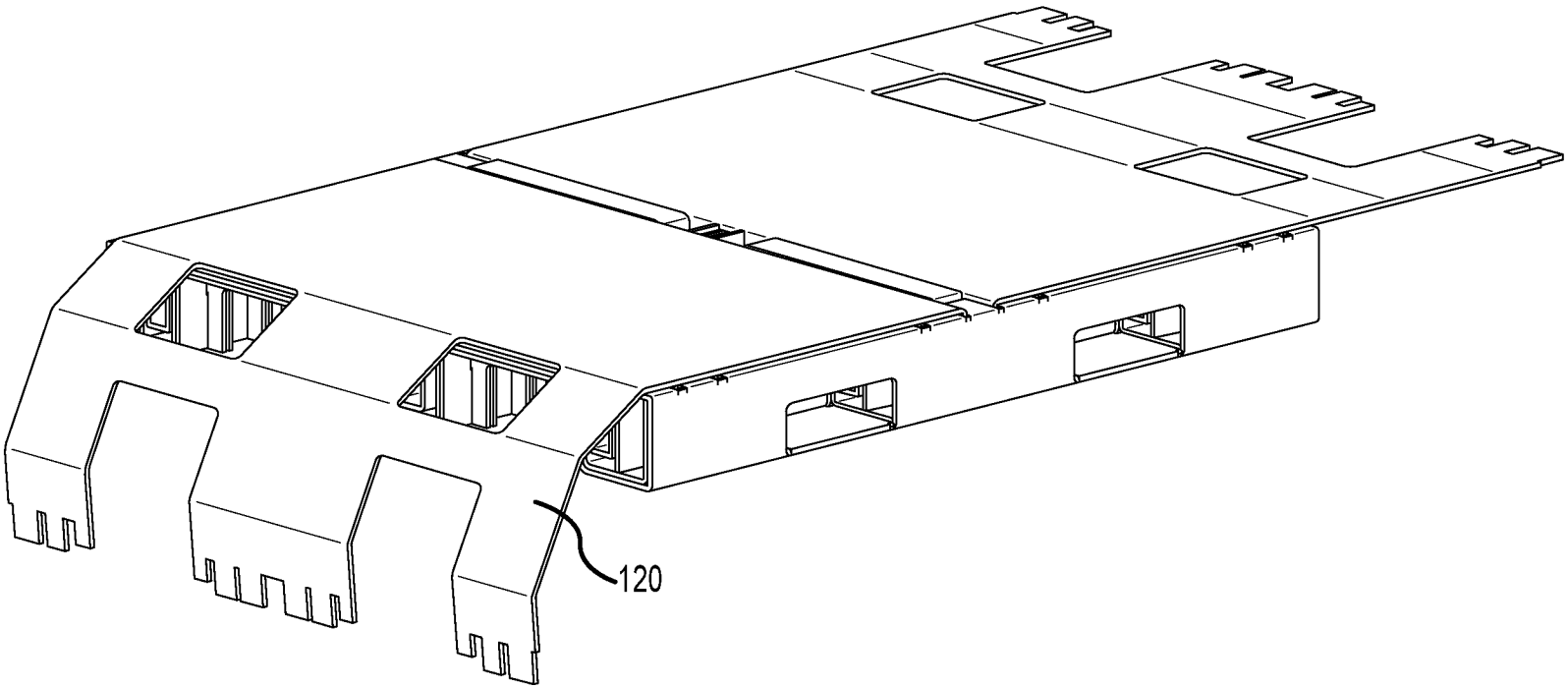
FIG. 7D is a perspective view of planar pieces of FIGS. 6A-6B positioned on top of the pieces of FIG. 7C in accordance with embodiments of the present disclosure.
Figure 7E:
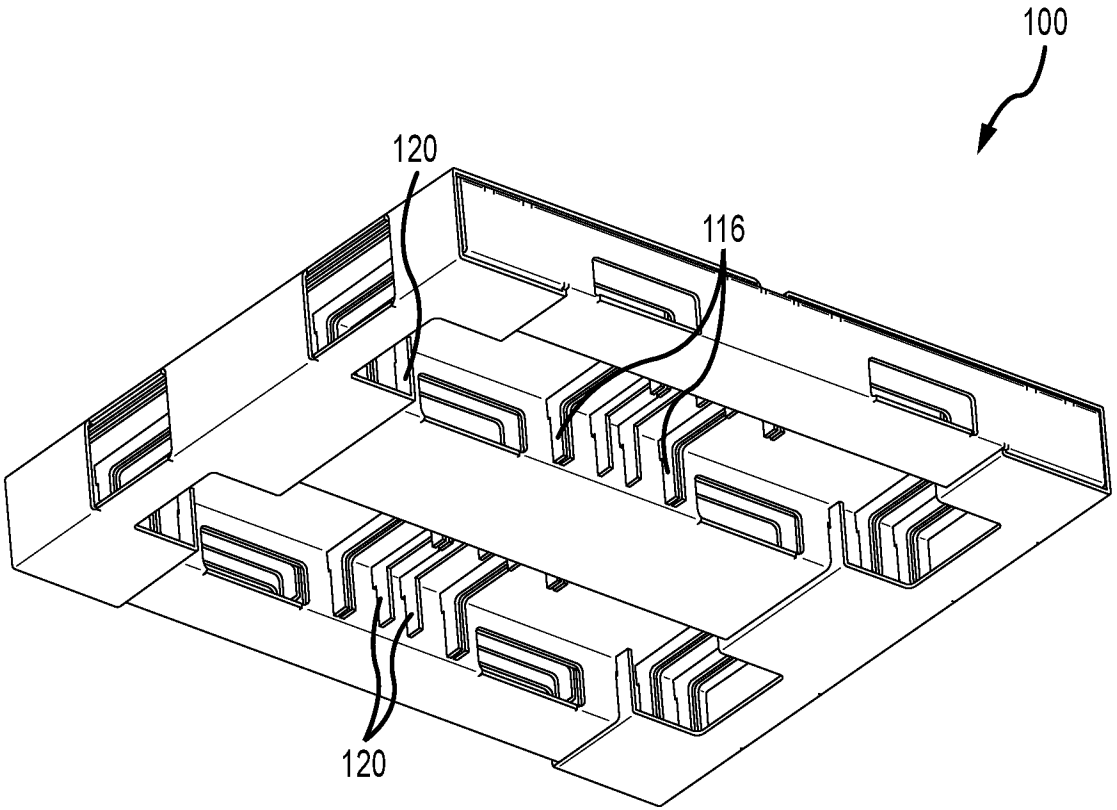
FIG. 7E is a perspective view of the ends of the planar pieces of FIG. 7D folded into other pieces of FIG. 7D to form an assembled pallet in accordance with embodiments of the present disclosure.

FIG. 7D shows the first ends of two planar pieces 120 extending into planar slots defined by the longitudinal pieces. The horizontal portion of the planar pieces 120 defines an upper surface of the pallet that can receive materials. FIG. 7E shows the second ends of the two planar pieces 120 extending into the other planar slots of the longitudinal pieces to form a complete pallet 100.

Second Exemplary Embodiment

Figure 8B:
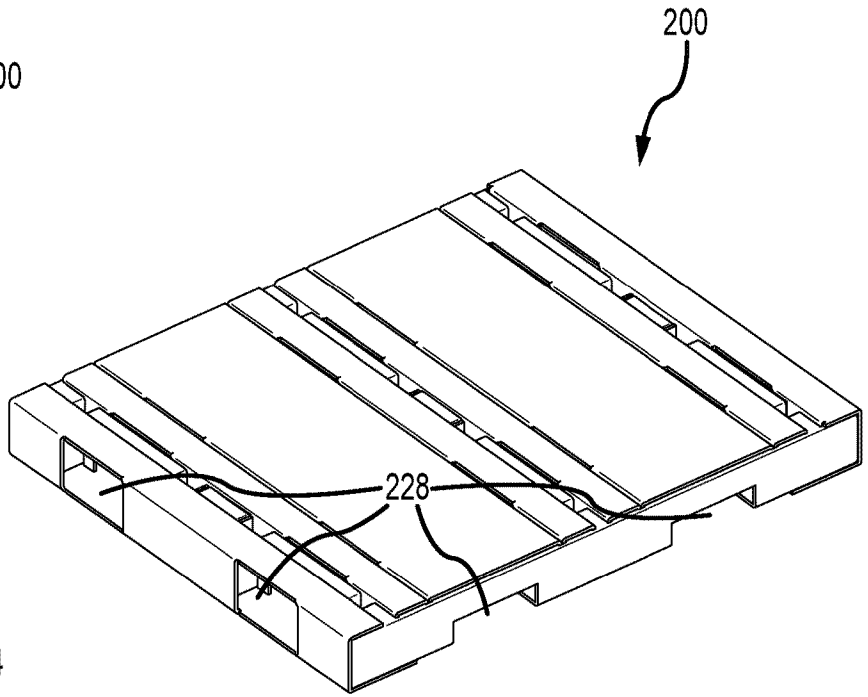
FIG. 8B is an assembled, perspective view of the pallet of FIG. 8A in accordance with embodiments of the present disclosure.
Figure 8A:
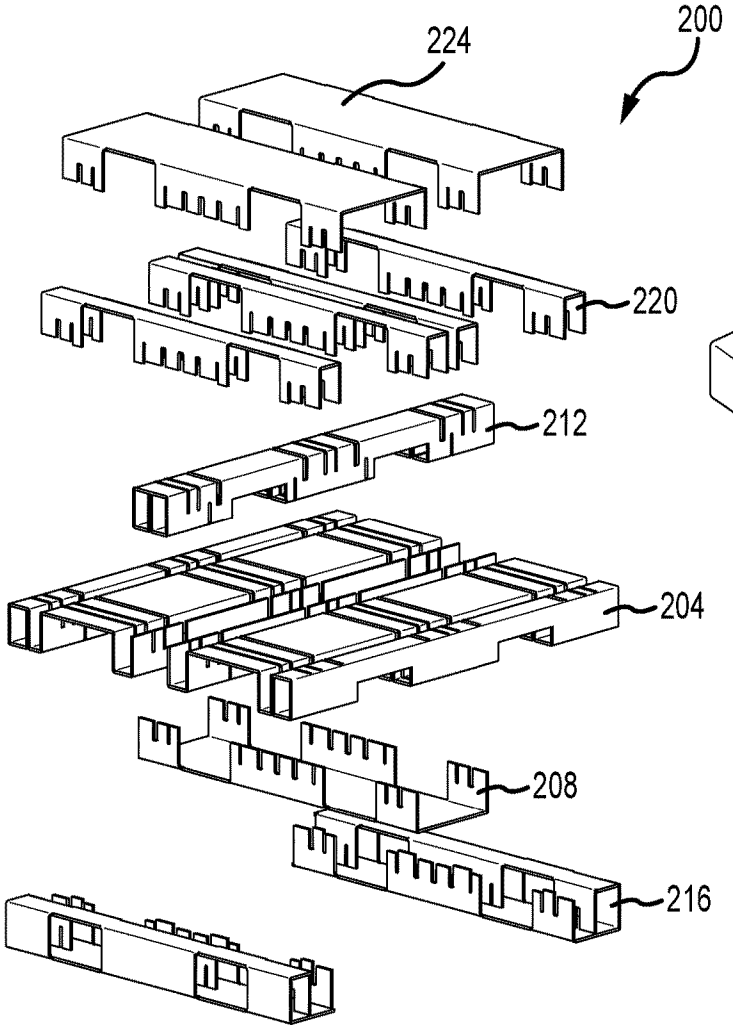
FIG. 8A is an exploded, perspective view of a pallet in accordance with embodiments of the present disclosure.

FIGS. 8A and 8B are an exploded view and an assembled view of a pallet 200, respectively. Referring to FIG. 8A, this embodiment of the pallet 200 comprises a first longitudinal piece 204, a first transverse piece 208, a second longitudinal piece 212, a second transverse piece 216, a third transverse piece 220, and a fourth transverse piece 224. The longitudinal pieces 204, 212 are bent to provide horizontal and vertical portions that are generally oriented perpendicular to each other and extend in a longitudinal direction. The horizontal portions extend to define a width of the pallet 200 and also to define apertures 228 configured to receive the forks of a forklift so that the pallet 200, once loaded, can be transported by the forklift. In this embodiment, the pallet 200 has two sets of apertures 228 so that the forklift can engage the pallet 200 from four different sides. The vertical portions define the smallest dimension of the pallet 200 and provide the requisite compressive strength to handle the loads, materials, devices, etc. placed on the top of the pallet 200. As described in further detail below, multiple pieces with vertical portions can be positioned within each other to reinforce the vertical portions and provide the requisite compressive strength of the pallet 200.

Next, transverse pieces 208, 216, 220, 224 hold the longitudinal pieces 204, 212 in a final shape. The longitudinal pieces 204, 212 are each folded from a single piece of material such as cardboard. As a result, the longitudinal pieces 204, 212 have a tendency to unfurl or revert to their initial shapes or original planar shapes. The transverse pieces 208, 216, 220, 224 are oriented perpendicular to both the horizontal and vertical portions of the longitudinal pieces 204, 212 and lock into each longitudinal piece 204, 212 to hold the longitudinal pieces 204, 212 in their final shapes and to hold the horizontal and vertical portions in the desired orientations. This arrangement provides an interference fit between the transverse pieces 208, 216, 220, 224 and the longitudinal pieces 204, 212 that holds the pieces 204, 212 together. FIGS. 9A-14B describe the bend lines and other features of each individual piece, and FIGS. 15A-15E show a sequence of assembling the pieces to form a pallet 200.

Figure 9B:
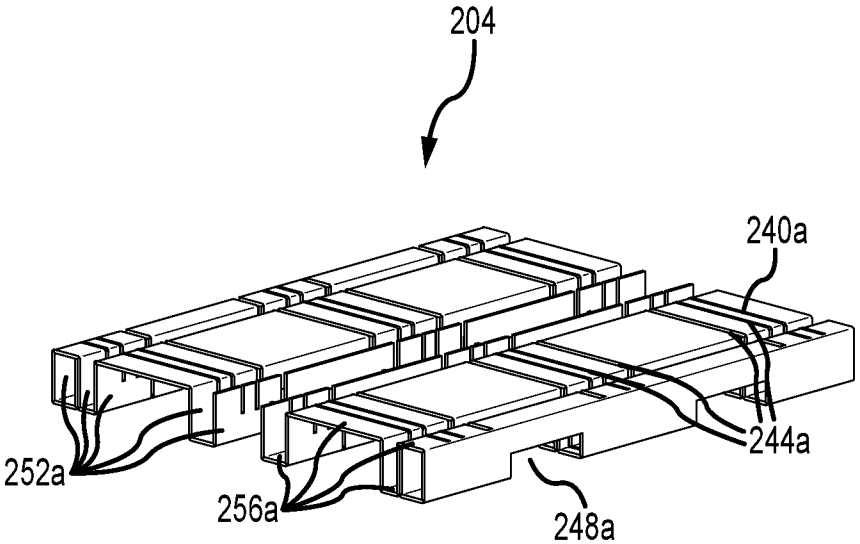
FIG. 9B is a perspective view of the first longitudinal piece of FIG. 9A in a final shape in accordance with embodiments of the present disclosure.
Figure 9A:
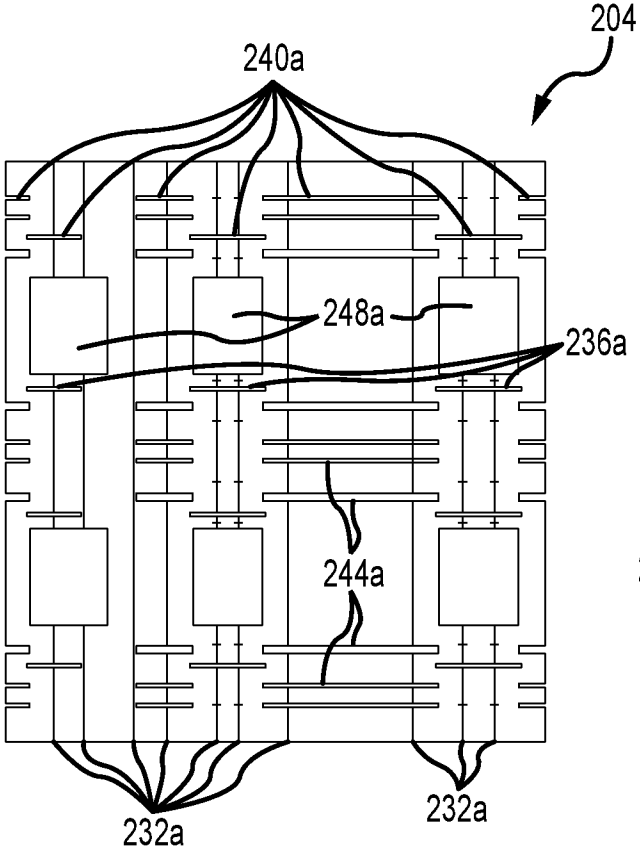
FIG. 9A is a top plan view of a first longitudinal piece in an initial shape in accordance with embodiments of the present disclosure.

FIGS. 9A and 9B show the first longitudinal piece 204 in an initial shape and a final shape, respectively. Referring to FIG. 9A, the first longitudinal piece 204 can be made from a single piece of material such as cardboard. To begin, a series of bend lines 232*a* extend along a longitudinal length of the piece 204, and the portions between the bend lines 232*a* are the horizontal and vertical portions that are described in more detail below with respect to FIG. 9B. Next, a series of slots define a first transverse slot 236*a* that ultimately receives the first transverse piece. As shown, three slots together form a transverse slot 236*a* once the first longitudinal piece 204 is bent into the final shape. In FIG. 9A, the piece 204 generally exhibits symmetry about a midline so there are two transverse slots 236*a* in total.

Further, a series of slots define a second transverse slot 240*a* that ultimately receives the second transverse piece. As shown, three or four slots together form a transverse slot 240*a* once the first longitudinal piece 204 is bent into the final shape. In FIG. 9A, the piece 204 generally exhibits symmetry about a midline so there are four transverse slots 240*a* in total. Moreover, a series of slots define a third/fourth transverse slot 244*a* that ultimately receives the third and fourth transverse pieces. As shown, four slots together form a third/fourth transverse slot 244*a* once the first longitudinal piece 204 is bent into the final shape. In FIG. 9A, the piece 204 generally exhibits symmetry about a midline so there are eight third/fourth transverse slots 244*a* in total. The first longitudinal piece 204 also has a series of fork slots 248*a* that together define some fork apertures that are configured to receive the forks of a forklift. Three slots form a fork slot 248*a* once the first longitudinal piece 204 is bent into a final shape. One fork slot 248*a* is identified on an upper half of the first longitudinal piece 204, and with symmetry about a midline, the first longitudinal piece 204 has two total fork slots 248*a*.

Referring to FIG. 9B, the first longitudinal piece 204 is shown in a final shape where the piece 204 has been bent about each bend line to define several horizontal portions 256*a* and vertical portions 252*a*. Also shown in FIG. 9B is how several slots form, for example, a second transverse slot 240*a*, a third/fourth transverse slot 244*a*, and a fork slot 248*a*. The final pallet utilizes two first longitudinal pieces 204 as shown in FIG. 9B.

Figure 10B:
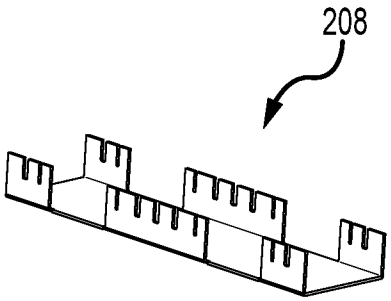
FIG. 10B is a perspective view of the first transverse piece of FIG. 10A in a final shape in accordance with embodiments of the present disclosure.
Figure 10A:
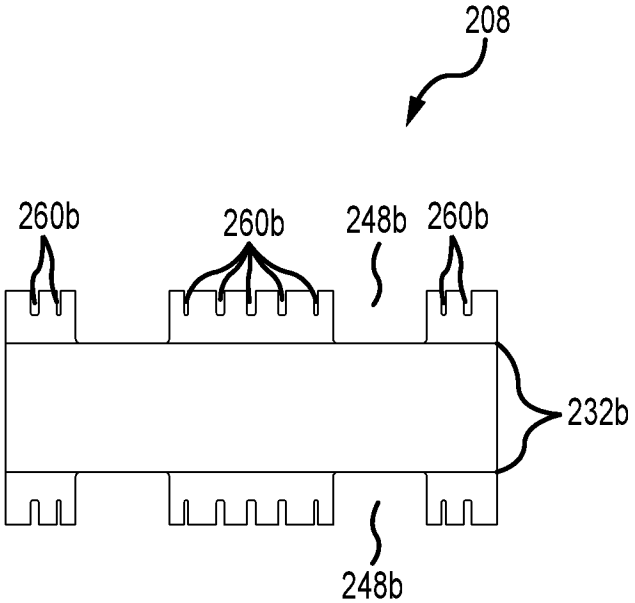
FIG. 10A is a top plan view of a first transverse piece in an initial shape in accordance with embodiments of the present disclosure.

FIGS. 10A and 10B show a first transverse piece 208 in an initial shape and a final shape, respectively. Referring to FIG. 10A, the first transverse piece may be made from a single piece of planar cardboard. A bend lines 232*b* extends across the first transverse piece 208, and the first transverse piece 208 has slots on a right half of the piece 208 that form a fork slot 248*b* once the first transverse piece 208 is bent into a final shape. Since the first transverse piece 208 is symmetric about a midline the transverse piece 208 has two fork slots 248*b* in total. Next, the first transverse piece 208 has a series of recesses 260*b*. These recesses 260*b* generally correspond to vertical portions of the longitudinal pieces. This allows the first transverse piece 208 to extend completely downward into the transverse slots of the longitudinal pieces so that the top of the first transverse piece 208 is flush or substantially flush with the tops of the longitudinal pieces. Referring to FIG. 10B, the first transverse piece 208 is folded about the bend lines. Like the longitudinal piece, the first transverse piece 208 also generally has some bias back towards the initial position. This aspect helps lock the first transverse piece 208 into the first transverse slots in an interference fit.

Figure 11B:
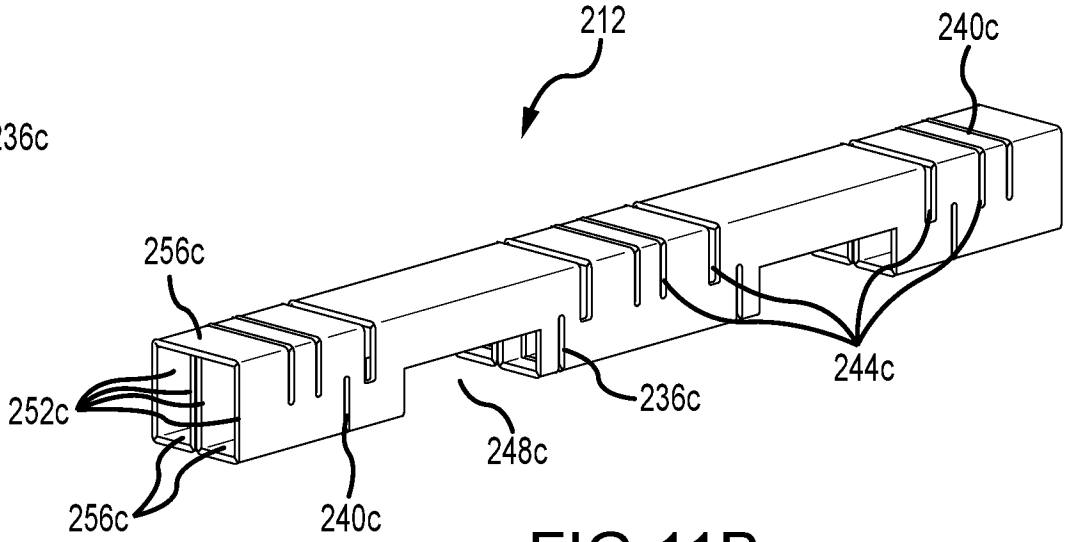
FIG. 11B is a perspective view of the second longitudinal piece of FIG. 11A in a final shape in accordance with embodiments of the present disclosure.
Figure 11A:
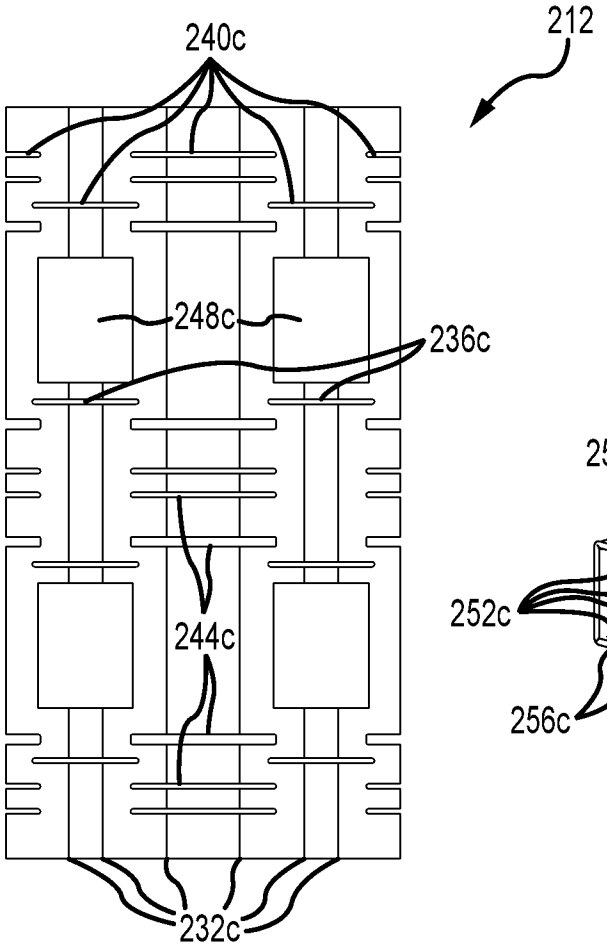
FIG. 11A is a top plan view of a second longitudinal piece in an initial shape in accordance with embodiments of the present disclosure.

FIGS. 11A and 11B show the second longitudinal piece 212 in an initial shape and a final shape, respectively.

Referring to FIG. 11A, the second longitudinal piece 212 can be made from a single piece of material such as cardboard. To begin, a series of bend lines 232*c* extend along a longitudinal length of the piece 212, and the portions between the bend lines 232*c* are the horizontal and vertical portions that are described in more detail below with respect to FIG. 11B. Next, a series of slots define a first transverse slot 236*c* that ultimately receives the first transverse piece. As shown, two slots together form a transverse slot 236*c* once the second longitudinal piece 212 is bent into the final shape. In FIG. 11A, the piece 212 generally exhibits symmetry about a midline so there are two transverse slots 236*c* in total.

Further, a series of slots define a second transverse slot 240*c* that ultimately receives the second transverse piece. As shown, two or three slots together form a transverse slot 240*c* once the second longitudinal piece 212 is bent into the final shape. In FIG. 11A, the piece 212 generally exhibits symmetry about a midline so there are four transverse slots 240*c* in total. Moreover, a series of slots define a third/fourth transverse slot 244*c* that ultimately receives the third and/or fourth transverse pieces. As shown, three slots together form a third/fourth transverse slot 244*c* once the second longitudinal piece 212 is bent into the final shape. In FIG. 11A, the piece 204 generally exhibits symmetry about a midline so there are eight third/fourth transverse slots 244*c* in total. The second longitudinal piece 212 also has fork slots 248*c* that together define some fork apertures that are configured to receive the forks of a forklift. Two slots form a fork slot 248*c* once the second longitudinal piece 212 is bent into a final shape. One fork slot 248*c* is identified on an upper half of the second longitudinal piece 212, and with symmetry about a midline, the second longitudinal piece 212 has two total fork slots 248*c*.

Referring to FIG. 11B, the second longitudinal piece 212 is shown in a final shape where the piece 212 has been bent about each bend line to define several horizontal portions 256*c* and vertical portions 252*c*. Also shown in FIG. 11B is how several slots form, for example, a first transverse slot 236*c*, a second transverse slot 240*c*, a third/fourth transverse slot 244*c*, and a fork slot 248*c*.

Figure 12B:
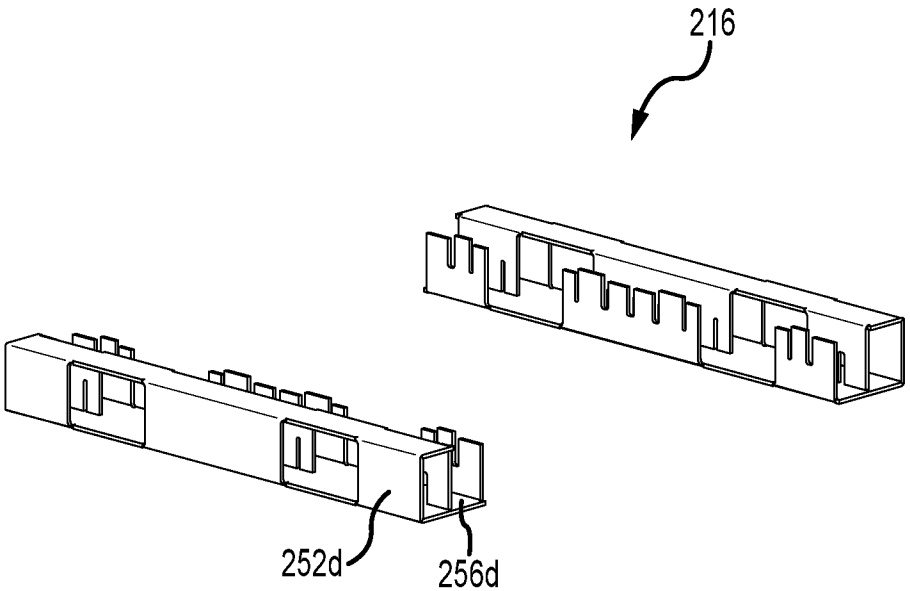
FIG. 12B is a perspective view of the second transverse piece of FIG. 12A in a final shape in accordance with embodiments of the present disclosure.
Figure 12A:
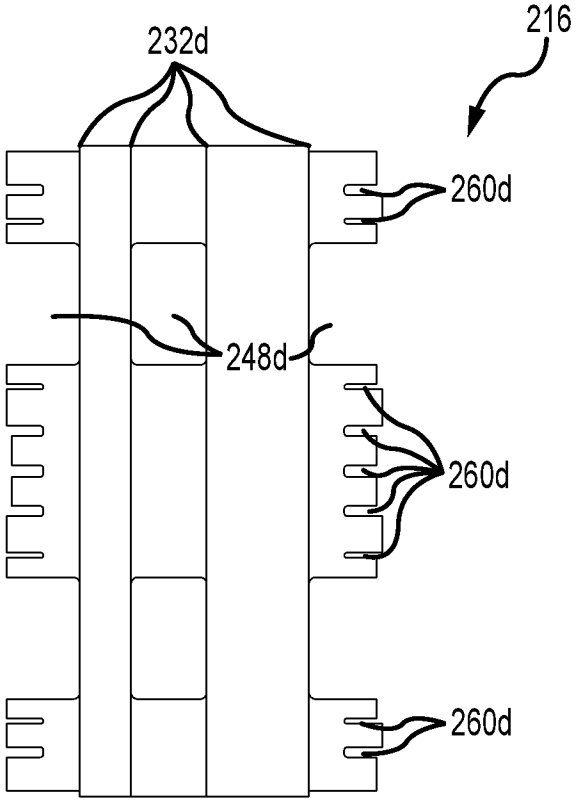
FIG. 12A is a top plan view of a second transverse piece in an initial shape in accordance with embodiments of the present disclosure.

FIGS. 12A and 12B show a second transverse piece 216 in an initial shape and a final shape, respectively. Referring to FIG. 12A, the second transverse piece 216 may be made from a single piece of planar cardboard. Bend lines 232*e* extend across the second transverse piece 216, and the second transverse piece 216 has three slots on an upper half of the piece 216 that form a fork slot 248*d* when the second transverse piece 216 is bent into a final shape. Since the second transverse piece 216 is symmetric about a midline the transverse piece 216 has two fork slots 248*d* in total. Next, the second transverse piece 216 has a series of recesses 260*d*. These recesses 260*d* generally correspond to vertical portions of the longitudinal pieces. This allows the second transverse piece 216 to extend completely downward into the transverse slots of the longitudinal pieces so that the top of the second transverse piece 216 is flush or substantially flush with the tops of the longitudinal pieces. Referring to FIG. 12B, the second transverse piece 216 is folded about the bend lines to define a horizontal portion 256*d* and a vertical portion 252*d*. Like the longitudinal piece, the second transverse piece 216 also generally has some bias back towards the initial position. This aspect helps lock the second transverse piece 216 into the second transverse slots in an interference fit.

Figure 13B:
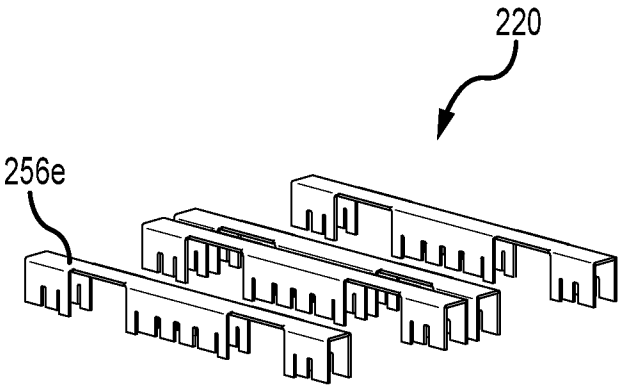
FIG. 13B is a perspective view of the third transverse piece of FIG. 13A in a final shape in accordance with embodiments of the present disclosure.
Figure 13A:
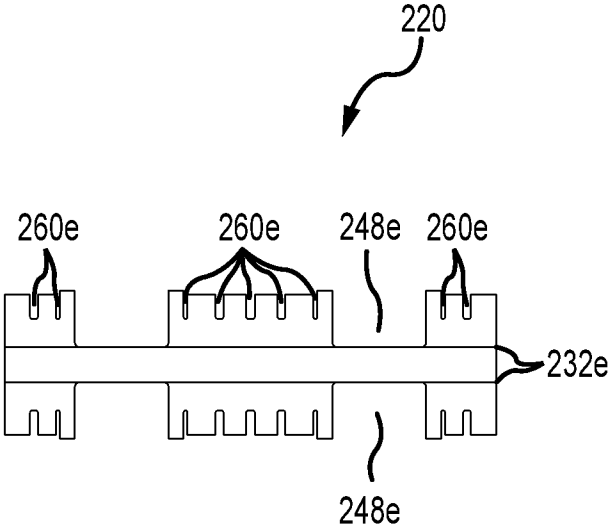
FIG. 13A is a top plan view of a third transverse piece in an initial shape in accordance with embodiments of the present disclosure.

FIGS. 13A and 13B show a third transverse piece 220 in an initial shape and a final shape, respectively. Referring to FIG. 13A, the third transverse piece may be made from a single piece of planar cardboard. Bend lines 232*e* extend across the third transverse piece 220, and the third transverse piece 220 has two slots on a right half of the piece 220 that form a fork slot 248*e* once the third transverse piece is bent into the final shape. Since the third transverse piece 220 is symmetric about a midline the transverse piece 220 has two fork slots 248*e* in total. Next, the third transverse piece 220 has a series of recesses 260*e*. These recesses 260*e* generally correspond to vertical portions of the longitudinal pieces. This allows the third transverse piece 220 to extend completely downward into the transverse slots of the longitudinal pieces so that the top of the third transverse piece 220 is flush or substantially flush with the tops of the longitudinal pieces. Referring to FIG. 13B, the third transverse piece 220 is folded about the bend lines. Like the longitudinal piece, the third transverse piece 220 also generally has some bias back towards the initial position. This aspect helps lock the third transverse piece 220 into the third/fourth transverse slots in an interference fit.

Figure 14B:
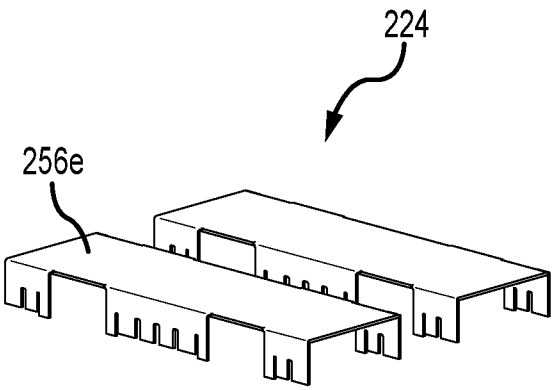
FIG. 14B is a perspective view of the fourth transverse piece of FIG. 14A in a final shape in accordance with embodiments of the present disclosure.
Figure 14A:
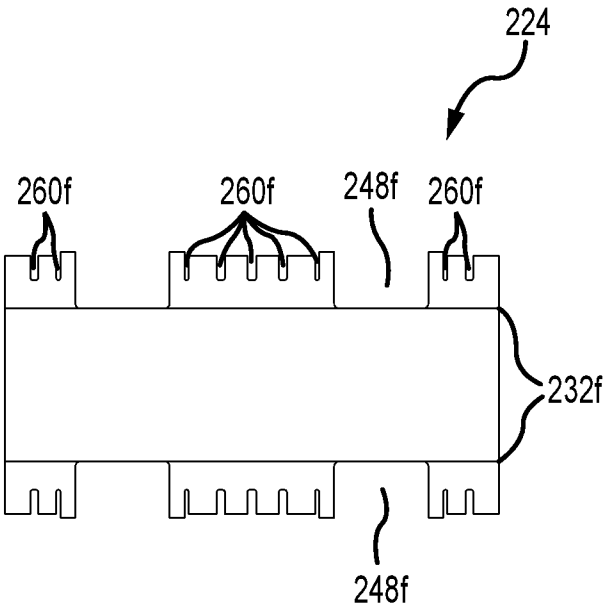
FIG. 14A is a top plan view of a fourth transverse piece in an initial shape in accordance with embodiments of the present disclosure.

FIGS. 14A and 14B show a fourth transverse piece 224 in an initial shape and a final shape, respectively. Referring to FIG. 14A, the fourth transverse piece 224 may be made from a single piece of planar cardboard. Bend lines 232*f* extend across the fourth transverse piece 224, and the fourth transverse piece 224 has two slots on a right half of the piece 224 that form a fork slot 248*f* once the fourth transverse piece 224 is bent into a final shape. Since the fourth transverse piece 224 is symmetric about a midline the transverse piece 224 has two fork slots 248*f* in total. Next, the fourth transverse piece 224 has a series of recesses 260*f*. These recesses 260*f* generally correspond to vertical portions of the longitudinal pieces. This allows the fourth transverse piece 224 to extend completely downward into the transverse slots of the longitudinal pieces so that the top of the fourth transverse piece 224 is flush or substantially flush with the tops of the longitudinal pieces. Referring to FIG. 14B, the fourth transverse piece 224 is folded about the bend lines. Like the longitudinal piece, the fourth transverse piece 224 also generally has some bias back towards the initial position. This aspect helps lock the fourth transverse piece 224 into the third/fourth transverse slots in an interference fit.

Figure 15A:
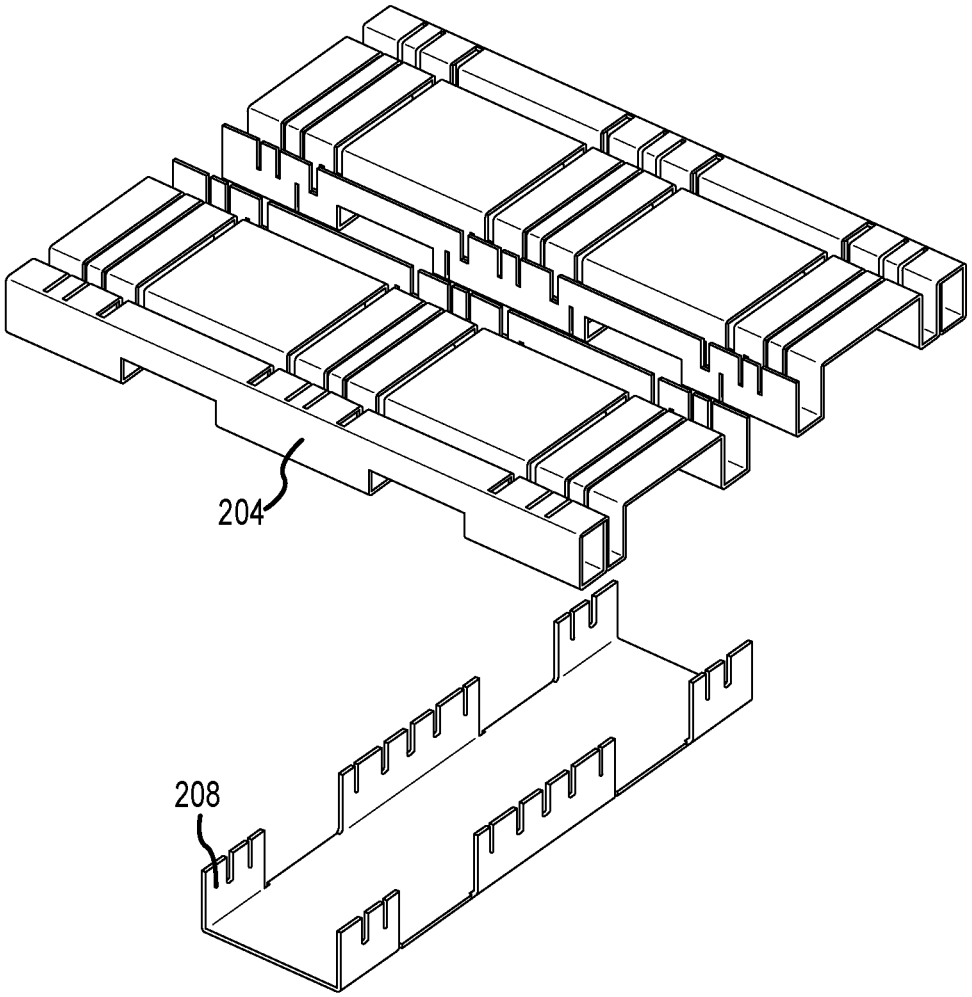
FIG. 15A is a perspective view of first longitudinal pieces of FIGS. 9A-9B positioned next to the first transverse piece of FIGS. 10A-10B in accordance with embodiments of the present disclosure.
Figure 15B:
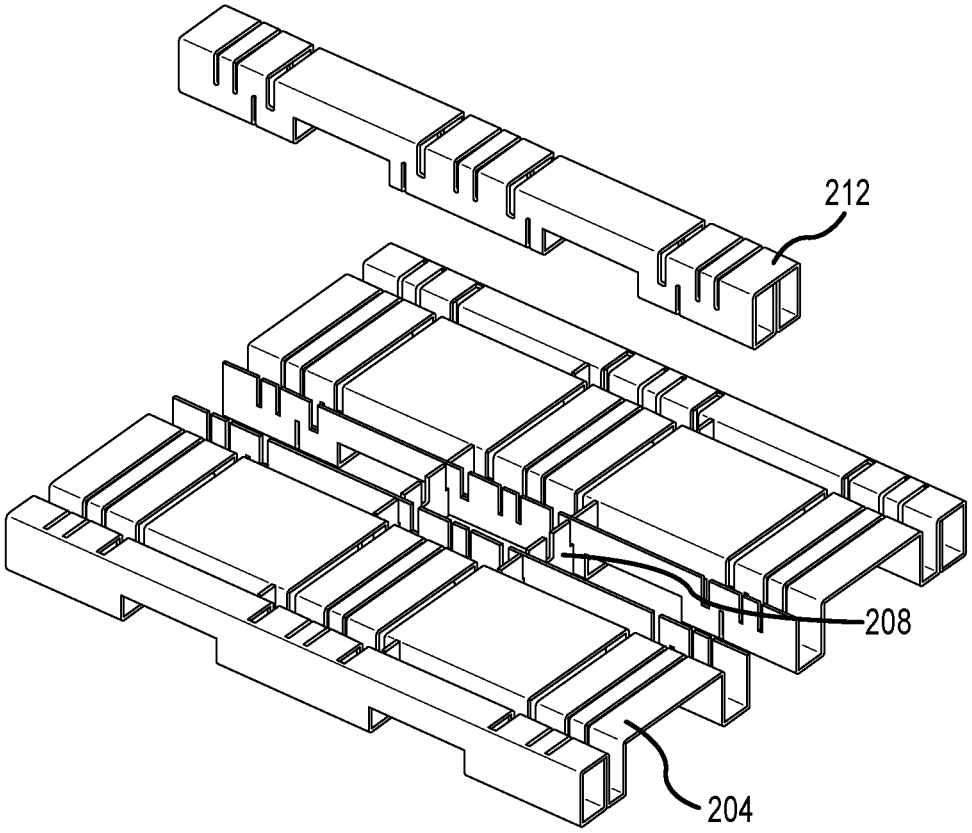
FIG. 15B is a perspective view of the second longitudinal piece of FIGS. 11A-11B positioned next to the pieces of FIG. 15A in accordance with embodiments of the present disclosure.

FIGS. 15A-15E show a sequence of assembling the various pieces to form a pallet. FIG. 15A shows two first longitudinal pieces 204 positioned next to a first transverse piece 208. FIG. 15B shows the first transverse piece 208 positioned in the first transverse slots of the first longitudinal pieces 204 to hold the pieces 204 in their final shape. The transverse slots also help hold the first transverse piece 208 in position. FIG. 7B also shows a second longitudinal piece 212.

Figure 15C:
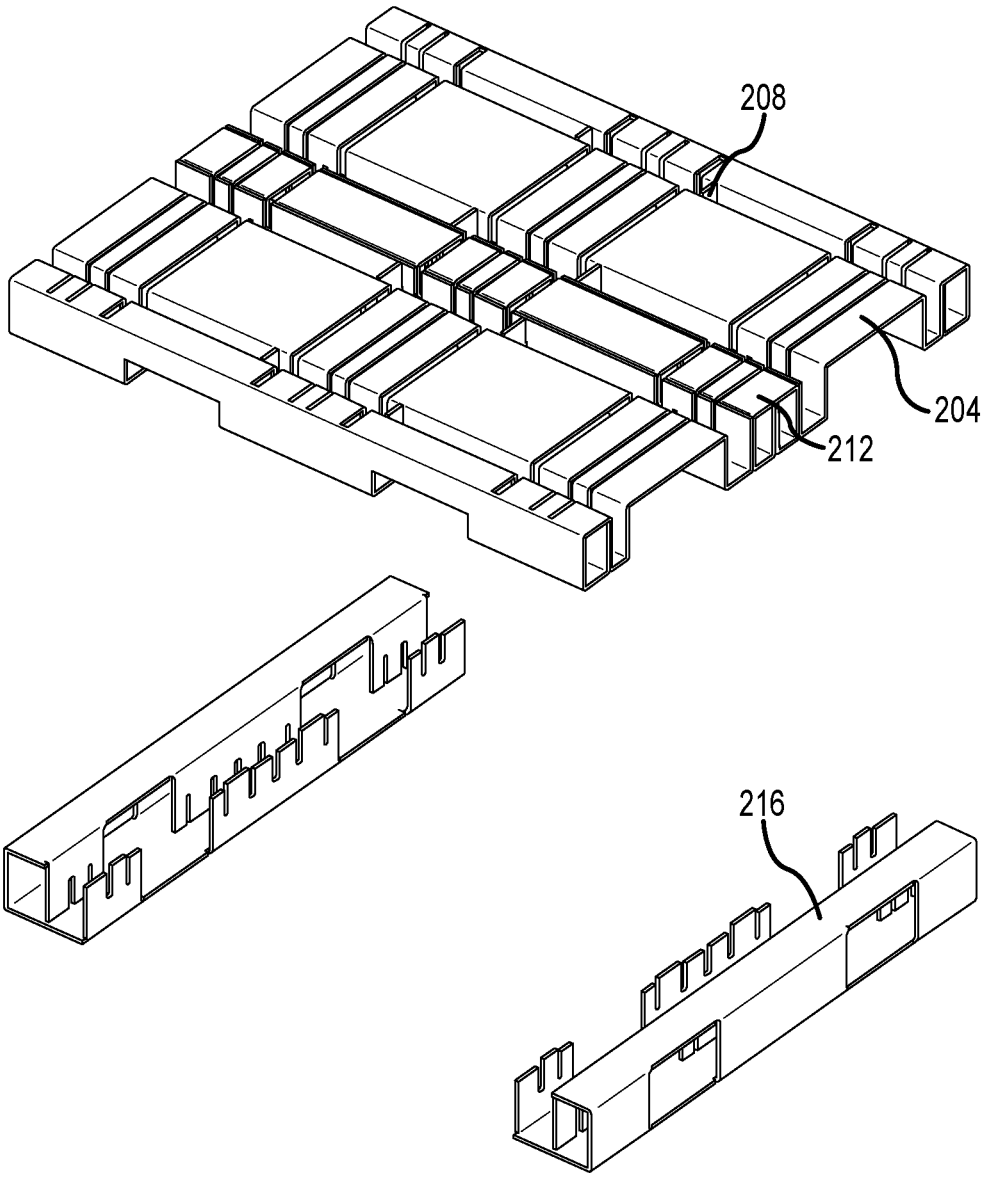
FIG. 15C is a perspective view of second transverse pieces of FIGS. 12A-12B positioned next to the pieces of FIG. 15B in accordance with embodiments of the present disclosure.
Figure 15D:
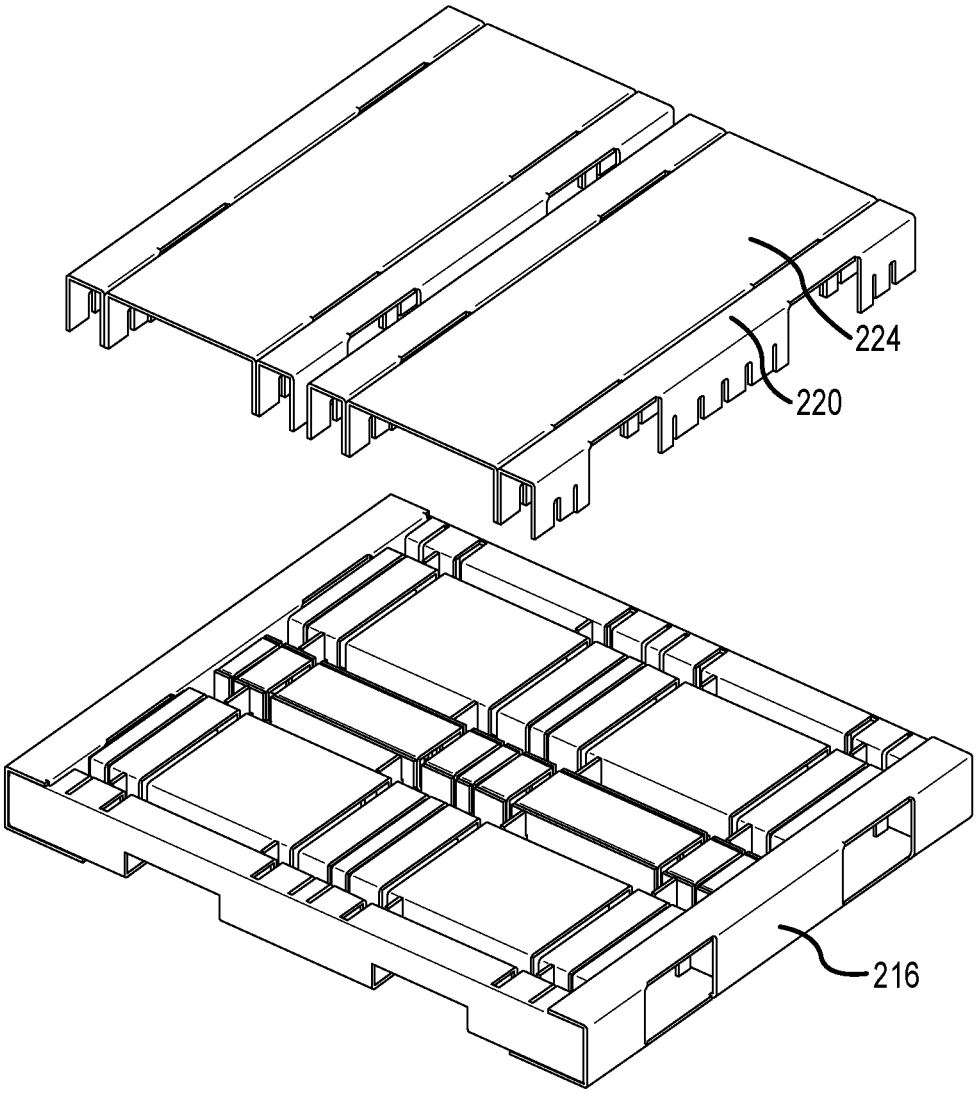
FIG. 15D is a perspective view of third and fourth transverse pieces of FIGS. 13A-13B and 14A-14B positioned next to the pieces of FIG. 15C in accordance with embodiments of the present disclosure.
Figure 15E:
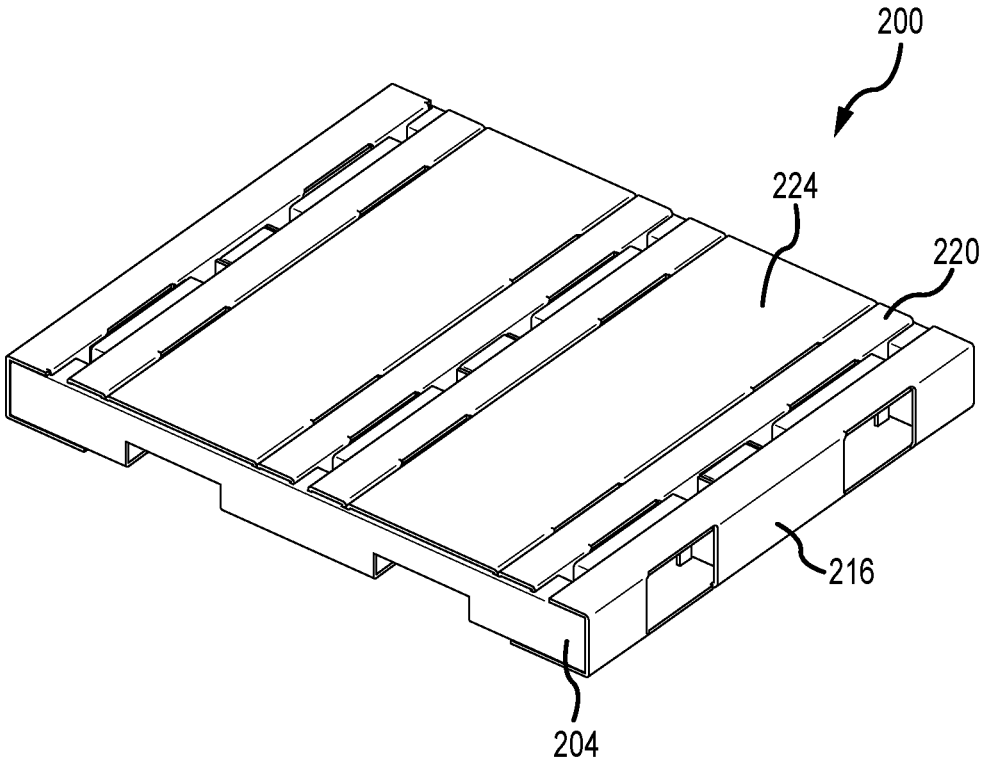
FIG. 15E is a perspective view of the pieces of FIG. 15D that form an assembled pallet in accordance with embodiments of the present disclosure.

FIG. 15C shows the first transverse piece 208 further positioned in the first transverse slots of the second longitudinal piece 212. FIG. 15C also shows two second transverse pieces 216. FIG. 15D shows the second transverse pieces 216 in position with the ends of the second transverse pieces 216 positioned in the second transverse slots of the longitudinal pieces. FIG. 15D also shows four third transverse pieces 220 and two fourth transverse pieces 224. FIG. 15E shows the third and fourth transverse pieces 220, 224 positioned in the third/fourth transverse slots of the longitudinal pieces where the ends of some adjacent third and fourth transverse pieces 220, 224 share a common third/fourth transverse slot to form a complete pallet 200.

Third Exemplary Embodiment

Figure 16B:
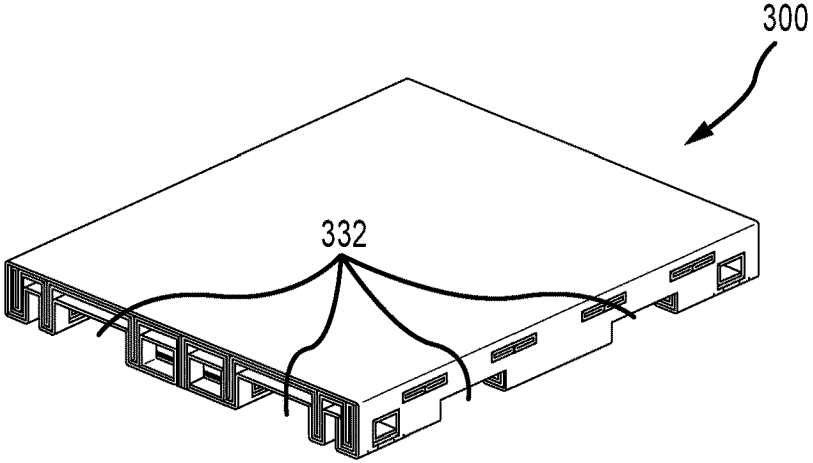
FIG. 16B is an assembled, perspective view of the pallet of FIG. 16A in accordance with embodiments of the present disclosure.
Figure 16A:
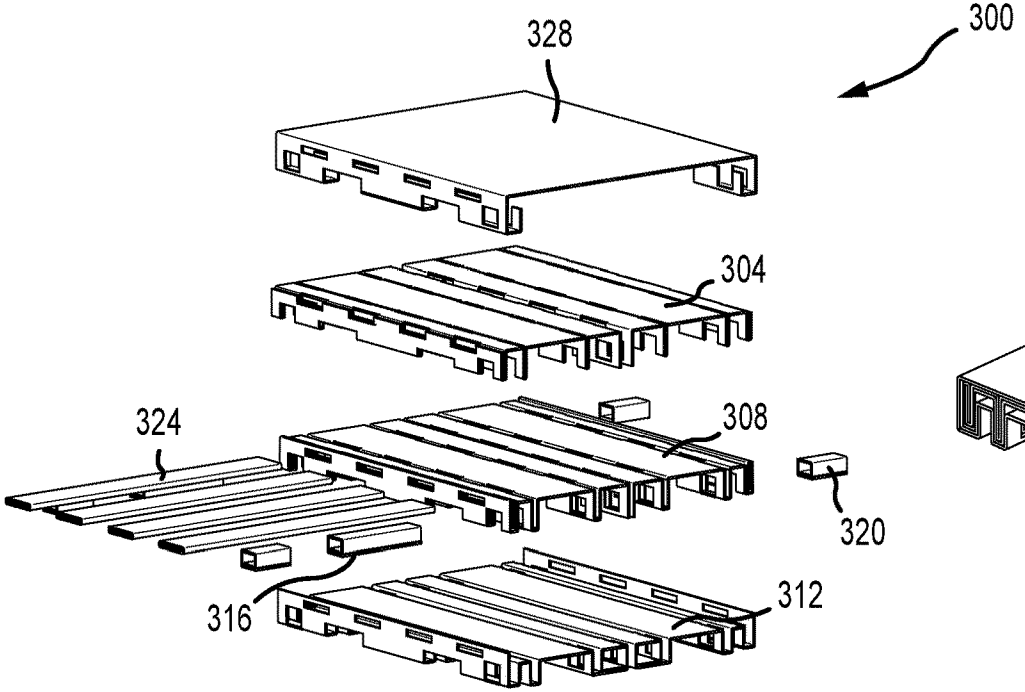
FIG. 16A is an exploded, perspective view of a pallet in accordance with embodiments of the present disclosure.

FIGS. 16A and 16B are an exploded view and an assembled view of a pallet 300, respectively. Referring to FIG. 16A, this embodiment of the pallet 300 comprises a first longitudinal piece 304, a second longitudinal piece 308, a third longitudinal piece 312, a first transverse piece 316, a second transverse piece 320, a third transverse piece 324, and a planar piece 328. The longitudinal pieces 304, 308, 312 are bent to provide horizontal and vertical portions that are generally oriented perpendicular to each other and extend in a longitudinal direction. The horizontal portions extend to define a width of the pallet 300 and also to define apertures 332 configured to receive the forks of a forklift so that the pallet 300, once loaded, can be transported by the forklift. In this embodiment, the pallet 300 has two sets of apertures 332 so that the forklift can engage the pallet 300 from four different sides. The vertical portions define the smallest dimension of the pallet 300 and provide the requisite compressive strength to handle the loads, materials, devices, etc. placed on the top of the pallet 300. As described in further detail below, multiple pieces with vertical portions can be positioned within each other to reinforce the vertical portions and provide the requisite compressive strength of the pallet 300.

Next, transverse pieces 316, 320, 324 hold the longitudinal pieces 304, 308, 312 in a final shape. The longitudinal pieces 304, 308, 312 are each folded from a single piece of material such as cardboard. As a result, the longitudinal pieces 304, 308, 312 have a tendency to unfurl or revert to their initial shapes or original planar shapes. The transverse pieces 316, 320, 324 have at least some portions that are oriented perpendicular to both the horizontal and vertical portions of the longitudinal pieces 304, 308, 312 and lock into each longitudinal piece 304, 308, 312 to hold the longitudinal pieces 304, 308, 312 in their final shapes and to hold the horizontal and vertical portions in the desired orientations. This arrangement provides an interference fit between the transverse pieces 316, 320, 324 and the longitudinal pieces 304, 308, 312 that holds the pieces 304, 308, 312 together. The planar piece 328 provides a flat surface to receive materials. FIGS. 17A-22B describe the bend lines and other features of each individual piece, and FIGS. 23A-23D show a sequence of assembling the pieces to form a pallet 300.

Figure 17B:
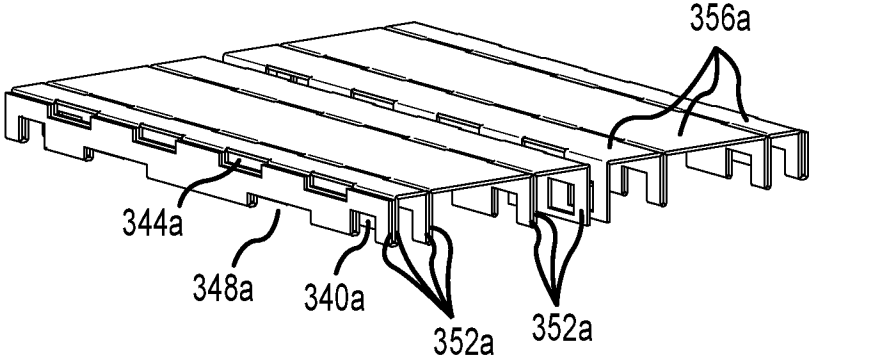
FIG. 17B is a perspective view of the first longitudinal piece of FIG. 17A in a final shape in accordance with embodiments of the present disclosure.
Figure 17A:
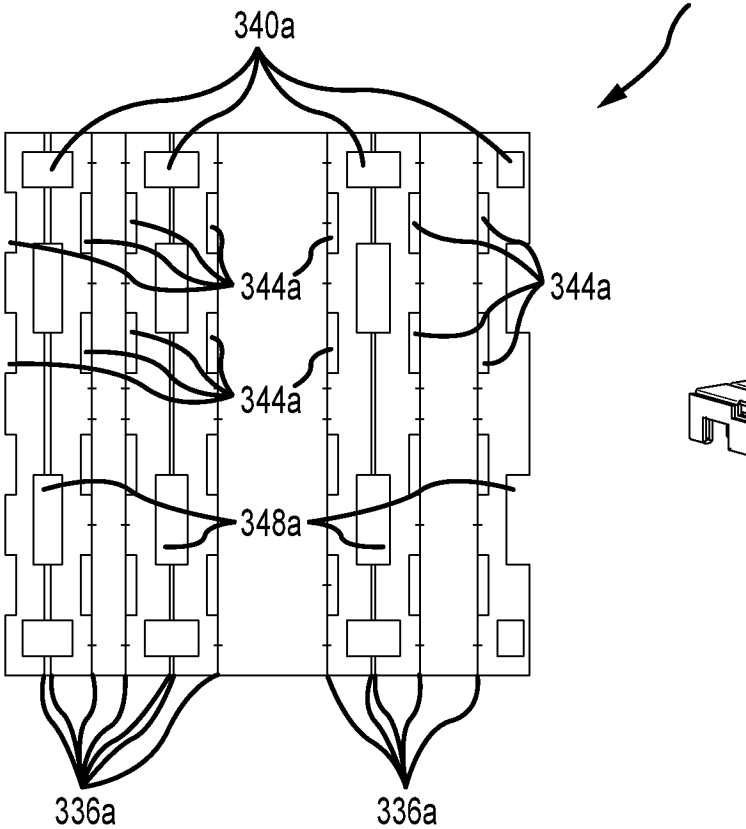
FIG. 17A is a top plan view of a first longitudinal piece in an initial shape in accordance with embodiments of the present disclosure.

FIGS. 17A and 17B show the first longitudinal piece 304 in an initial shape and a final shape, respectively. Referring to FIG. 17A, the first longitudinal piece 304 can be made from a single piece of material such as cardboard. To begin, a series of bend lines 336*a* extend along a longitudinal length of the piece 304, and the portions between the bend lines 336*a* are the horizontal and vertical portions that are described in more detail below with respect to FIG. 17B. Next, a series of slots define a first transverse slot 340*a* that ultimately receives the first transverse piece. As shown, four slots together form a first transverse slot 340*a* once the first longitudinal piece 304 has been bent into the final shape. In FIG. 17A, the piece 304 generally exhibits symmetry about a midline so there are two first transverse slots 340*a* in total.

Further, a series of slots define a second transverse slot 344*a* that ultimately receives the second transverse piece. As shown, seven slots together form a second transverse slot 344*a* once the first longitudinal piece 304 has been bent into the final shape. In FIG. 17A, the piece 304 generally exhibits symmetry about a midline so there are four second transverse slots 344*a* in total. The first longitudinal piece 304 also has a series of fork slots 348*a* that together define some fork apertures that are configured to receive the forks of a forklift. Four slots define a fork slot 348*a* once the first longitudinal piece 304 is bent into a final shape. One fork slot 348*a* is identified on a lower half of the first longitudinal piece 304, and with symmetry about a midline, the first longitudinal piece 304 has two total fork slots 348*a*.

Referring to FIG. 17B, the first longitudinal piece 304 is shown in a final shape where the piece 304 has been bent about each bend line to define several horizontal portions 356*a* and vertical portions 352*a*. Also shown in FIG. 17B is how several slots form, for example, a first transverse slot 340*a*, a second transverse slot 344*a*, and a fork slot 348*a*. The final pallet utilizes two first longitudinal pieces 304 as shown in FIG. 17B.

Figure 18B:
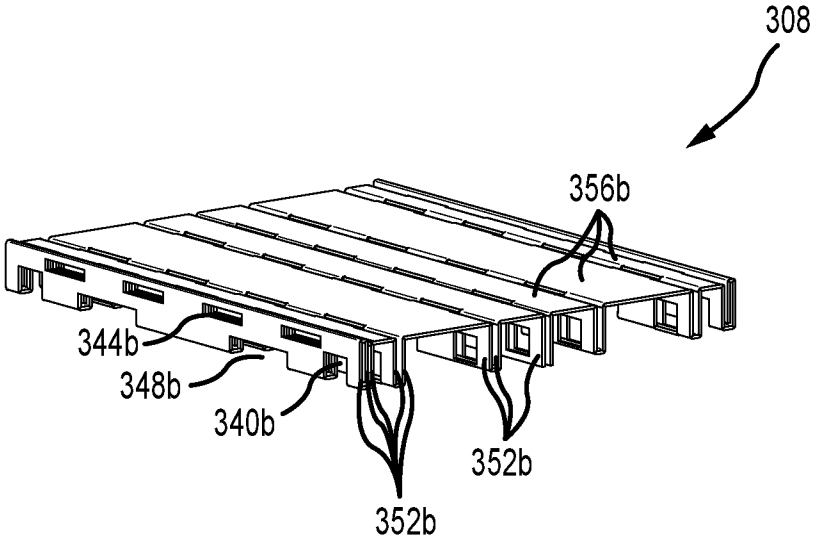
FIG. 18B is a perspective view of the second longitudinal piece of FIG. 18A in a final shape in accordance with embodiments of the present disclosure.
Figure 18A:
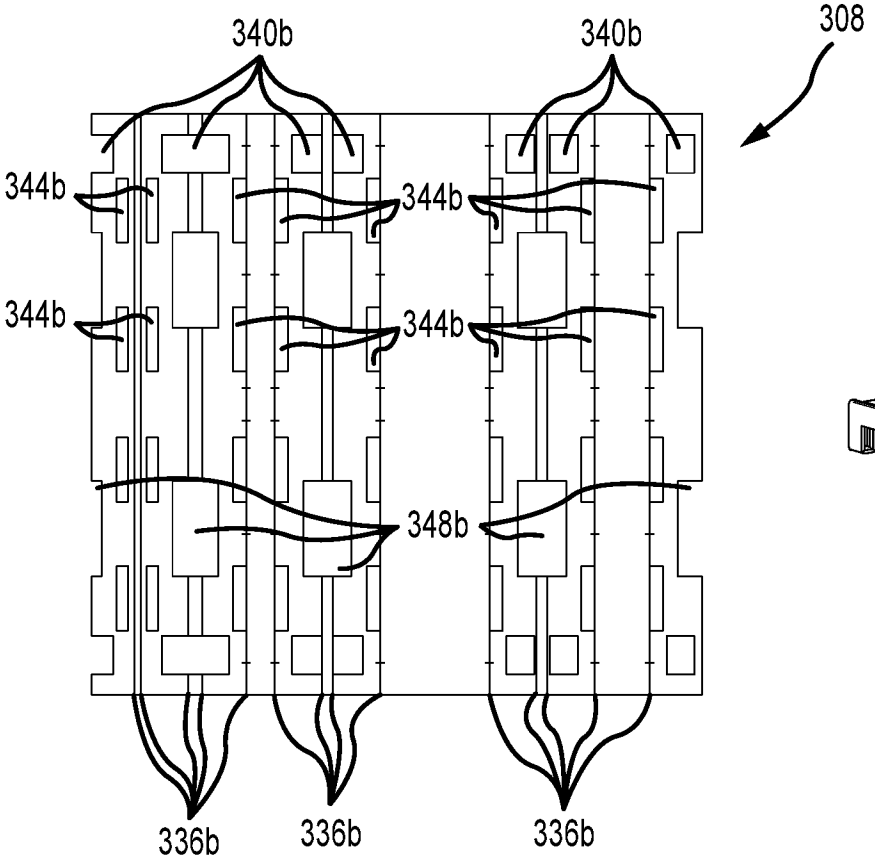
FIG. 18A is a top plan view of a second longitudinal piece in an initial shape in accordance with embodiments of the present disclosure.

FIGS. 18A and 18B show the second longitudinal piece 308 in an initial shape and a final shape, respectively. Referring to FIG. 18A, the second longitudinal piece 308 can be made from a single piece of material such as cardboard. To begin, a series of bend lines 336*b* extend along a longitudinal length of the piece 308, and the portions between the bend lines 336*b* are the horizontal and vertical portions that are described in more detail below with respect to FIG. 18B. Next, a series of slots define a first transverse slot 340*b* that ultimately receives the first transverse piece. As shown, seven slots together form a first transverse slot 340*b* once the second longitudinal piece 308 has been bent into the final shape. In FIG. 18A, the piece 308 generally exhibits symmetry about a midline so there are two first transverse slots 340*b* in total.

Further, a series of slots define a second transverse slot 344*b* that ultimately receives the second transverse piece. As shown, eight slots together form a second transverse slots 344*b* once the second longitudinal piece 308 has been bent into the final shape. In FIG. 18A, the piece 308 generally exhibits symmetry about a midline so there are four second transverse slots 344*b* in total. The second longitudinal piece 308 also has a series of fork slots 348*b* that together define some fork apertures that are configured to receive the forks of a forklift. Four slots define a fork slot 348*b* once the second longitudinal piece 308 is bent into a final shape. One fork slot 348*b* is identified on a lower half of the second longitudinal piece 308, and with symmetry about a midline, the second longitudinal piece 308 has two total fork slots 348*b*.

Referring to FIG. 18B, the second longitudinal piece 308 is shown in a final shape where the piece 308 has been bent about each bend line to define several horizontal portions 356*b* and vertical portions 352*b*. Also shown in FIG. 18B is how several slots form, for example, a first transverse slot 340*b*, a second transverse slot 344*b*, and a fork slot 348*b*. The final pallet utilizes two second longitudinal pieces 308 as shown in FIG. 18B.

Figure 19B:
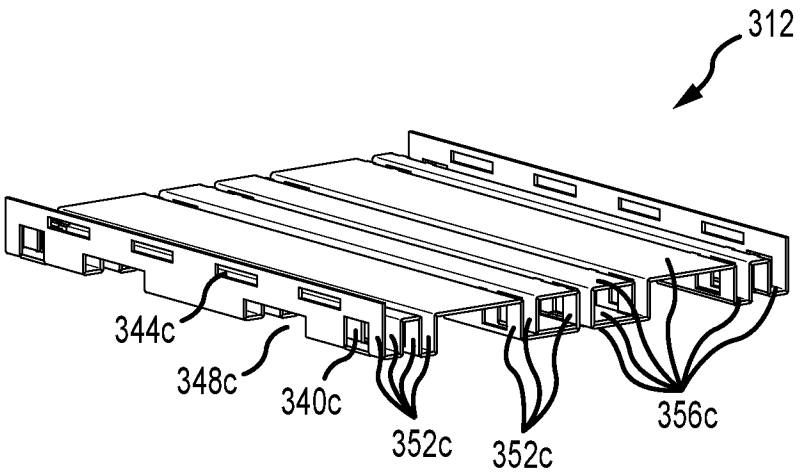
FIG. 19B is a perspective view of the third longitudinal piece of FIG. 19A in a final shape in accordance with embodiments of the present disclosure.
Figure 19A:
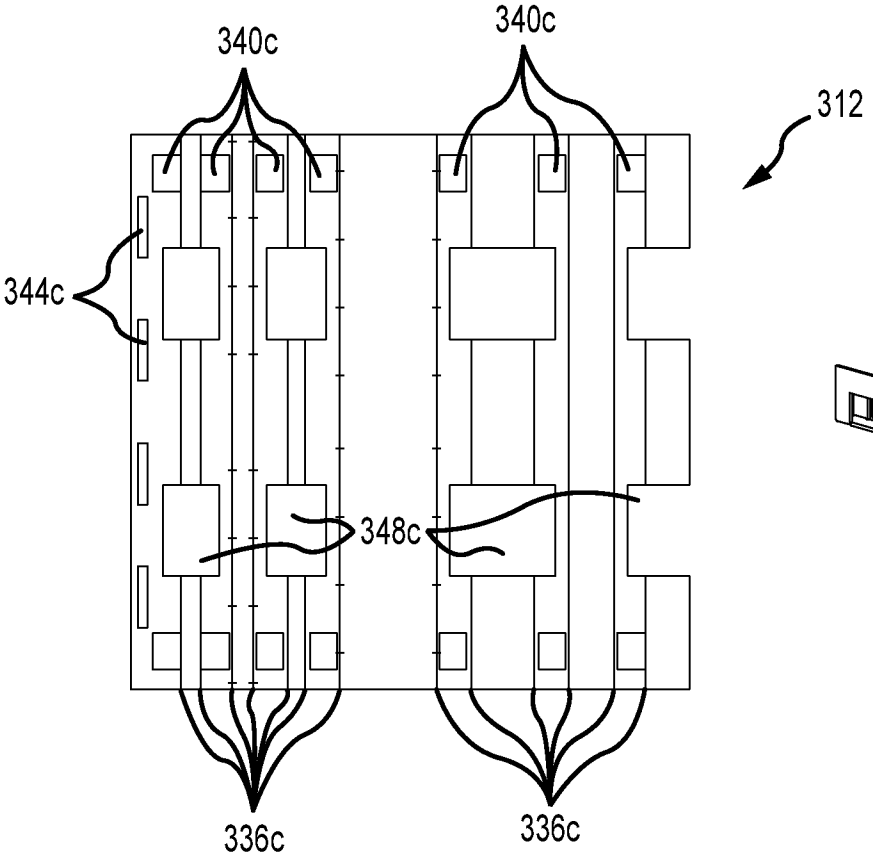
FIG. 19A is a top plan view of a third longitudinal piece in an initial shape in accordance with embodiments of the present disclosure.

FIGS. 19A and 19B show the third longitudinal piece 312 in an initial shape and a final shape, respectively. Referring to FIG. 19A, the third longitudinal piece 312 can be made from a single piece of material such as cardboard. To begin, a series of bend lines 336*c* extend along a longitudinal length of the piece 312, and the portions between the bend lines 336*c* are the horizontal and vertical portions that are described in more detail below with respect to FIG. 19B. Next, a series of slots define a first transverse slot 340*c* that ultimately receives the first transverse piece. As shown, seven slots together form a first transverse slot 340*c* once the third longitudinal piece 312 has been bent into the final shape. In FIG. 19A, the piece 312 generally exhibits symmetry about a midline so there are two first transverse slots 340*c* in total.

Further, a slot defines a second transverse slot 344*c* that ultimately receives the second transverse piece. As shown, one slot forms a second transverse slot 344*c* once the third longitudinal piece 312 has been bent into the final shape. In FIG. 19A, the piece 312 generally exhibits symmetry about a midline so there are two second transverse slots 344*c* in total. The third longitudinal piece 312 also has a series of fork slots 348*c* that together define some fork apertures that are configured to receive the forks of a forklift. Four slots form a fork slot 348*c* once the third longitudinal piece 312 is bent into a final shape. One fork slot 348*c* is identified on a lower half of the third longitudinal piece 312, and with symmetry about a midline, the third longitudinal piece 312 has two total fork slots 348*c*.

Referring to FIG. 19B, the third longitudinal piece 312 is shown in a final shape where the piece 312 has been bent about each bend line to define several horizontal portions 356*c* and vertical portions 352*c*. Also shown in FIG. 19B is how several slots form, for example, a first transverse slot 340*c*, a second transverse slot 344*c*, and a fork slot 348*c*. The final pallet utilizes two second longitudinal pieces 312 as shown in FIG. 19B.

Figure 20A:
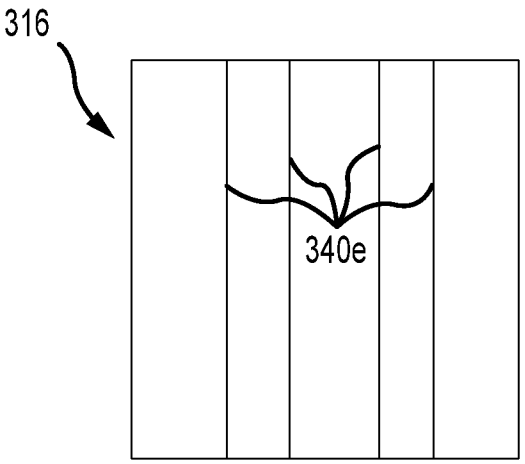
FIG. 20A is a top plan view of a first transverse piece in an initial shape in accordance with embodiments of the present disclosure.
Figure 20B:
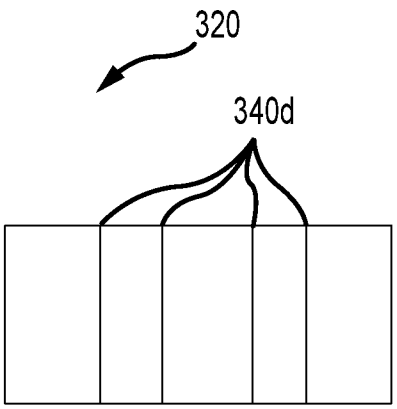
FIG. 20B is a top plan view of a second transverse piece in an initial shape in accordance with embodiments of the present disclosure.
Figure 20C:
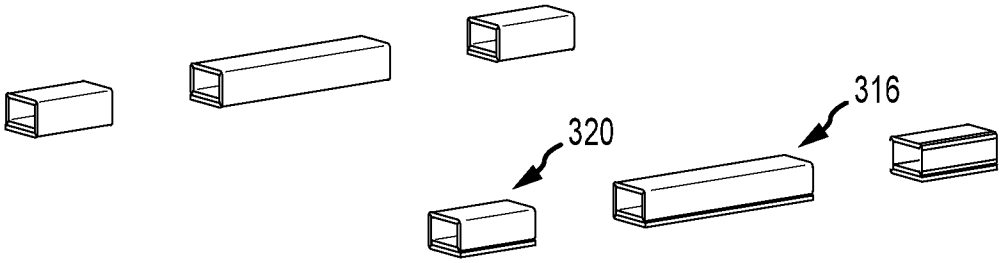
FIG. 20C is a perspective view of the first transverse piece of FIG. 20A in a final shape and the second transverse piece of 20B in a final shape in accordance with embodiments of the present disclosure.

FIGS. 20A and 20B show a first transverse piece 316 and a second transverse piece 320 in an initial shape, respectively, and FIG. 20C shows the first and second transverse pieces 316, 320 in a final shape. Referring to FIG. 20A, the first transverse piece 316 can be made from a single piece of material such as cardboard. Several bend lines 340*d* define several planar portions of the first transverse piece 316. Similarly, Referring to FIG. 20B, the second transverse piece 320 can be made from a single piece of material such as cardboard. Several bend lines 340*e* define several planar portions of the second transverse piece 320. Referring to FIG. 20C, the first and second transverse pieces 316, 320 are shown in a final shape, where the pieces 316, 320 have been bent along bend lines to produce shapes that have a substantially rectangular cross section. As shown, four second transverse pieces 316 and two third transverse pieces 320 are used in the assembly of the pallet.

Figure 21B:
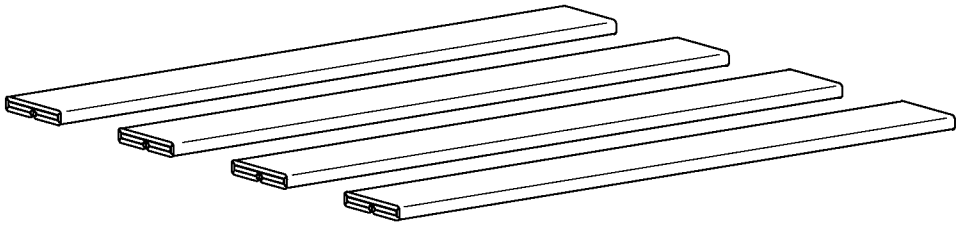
FIG. 21B is a perspective view of the third transverse piece of FIG. 21A in a final shape in accordance with embodiments of the present disclosure.
Figure 21A:
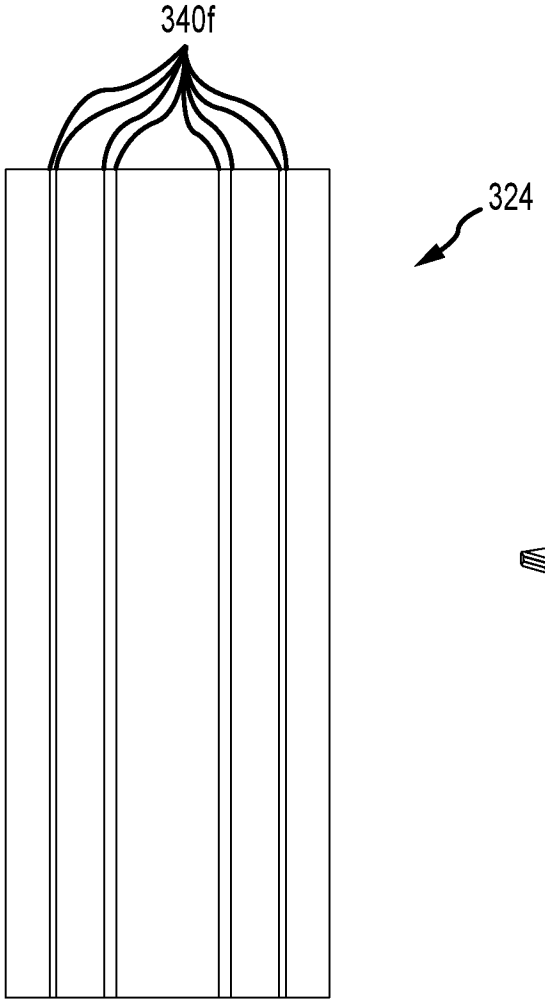
FIG. 21A is a top plan view of a third transverse piece in an initial shape in accordance with embodiments of the present disclosure.

FIGS. 21A and 21B show a third transverse piece 324 in an initial shape and a final shape, respectively. Referring to FIG. 21A, the third transverse piece 324 can be made from a single piece of material such as cardboard. Several bend lines 340*f* define several planar portions of the third transverse piece 324. Referring to FIG. 21B, the third transverse piece 324 is shown in a final shape where the transverse piece 324 has been bent along the bend lines to produce a substantially planar shape. As shown, four third transverse pieces 324 are used in the assembly of the pallet.

Figure 22B:
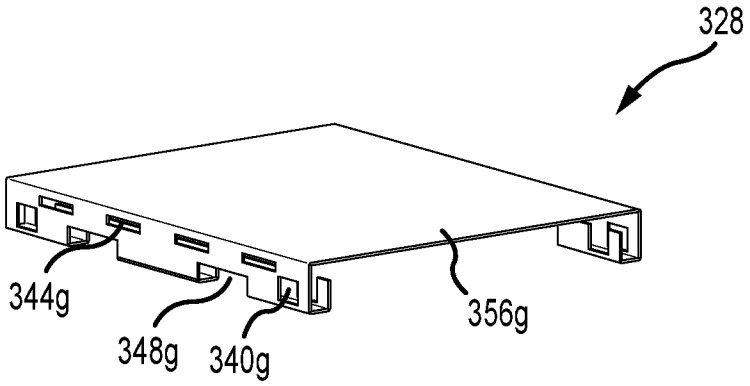
FIG. 22B is a perspective view of the planar piece of FIG. 22A in a final shape in accordance with embodiments of the present disclosure.
Figure 22A:
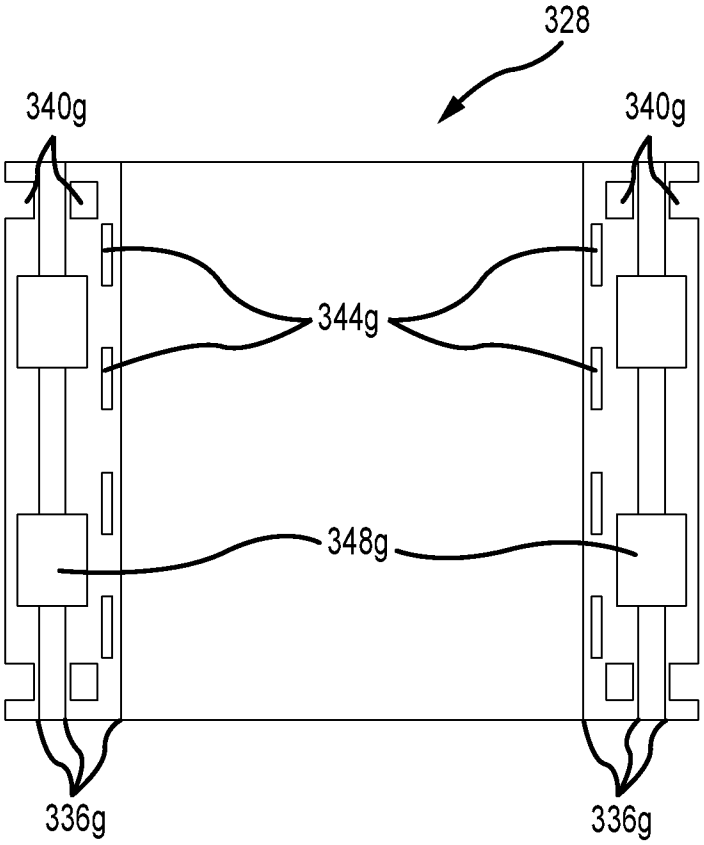
FIG. 22A is a top plan view of a planar piece in an initial shape in accordance with embodiments of the present disclosure.

FIGS. 22A and 22B show a planar piece 328 in an initial shape and a final shape, respectively. Referring to FIG. 22A, the planar piece 328 may be made from a single piece of planar cardboard. Several bend lines 336*g* extend along the planar piece 328. Next, a series of slots define a first transverse slot 340*g* that ultimately receives the first transverse piece. As shown, four slots together form a first transverse slot 340*g* once the planar piece 328 has been bent into the final shape. In FIG. 22A, the piece 328 generally exhibits symmetry about a midline so there are two first transverse slots 340*g* in total.

In addition, a series of slots define a second transverse slot 344*g* that ultimately receives the second transverse piece. As shown, two slots together form a second transverse slot 344*g* once the planar piece 328 has been bent into the final shape. In FIG. 22A, the piece 328 generally exhibits symmetry about a midline so there are four second transverse slots 344*g* in total. The planar piece 328 has a series of slots that form a fork slot 348*g*. Two slots form a fork slot 348*g* once the planar piece 328 is bent into a final shape. Since the planar piece 328 is generally symmetric about a midline, the planar piece 328 has two fork slots 348*g*.

Referring to FIG. 22B, the planar piece 328 is in a final shape, and the bend lines define several portions, including a horizontal portion 356*g*. Several slots and slots are also shown, including the first transverse slot 340*g*, the second transverse slot 344*g*, and the fork slot 348*g*.

Figure 23A:
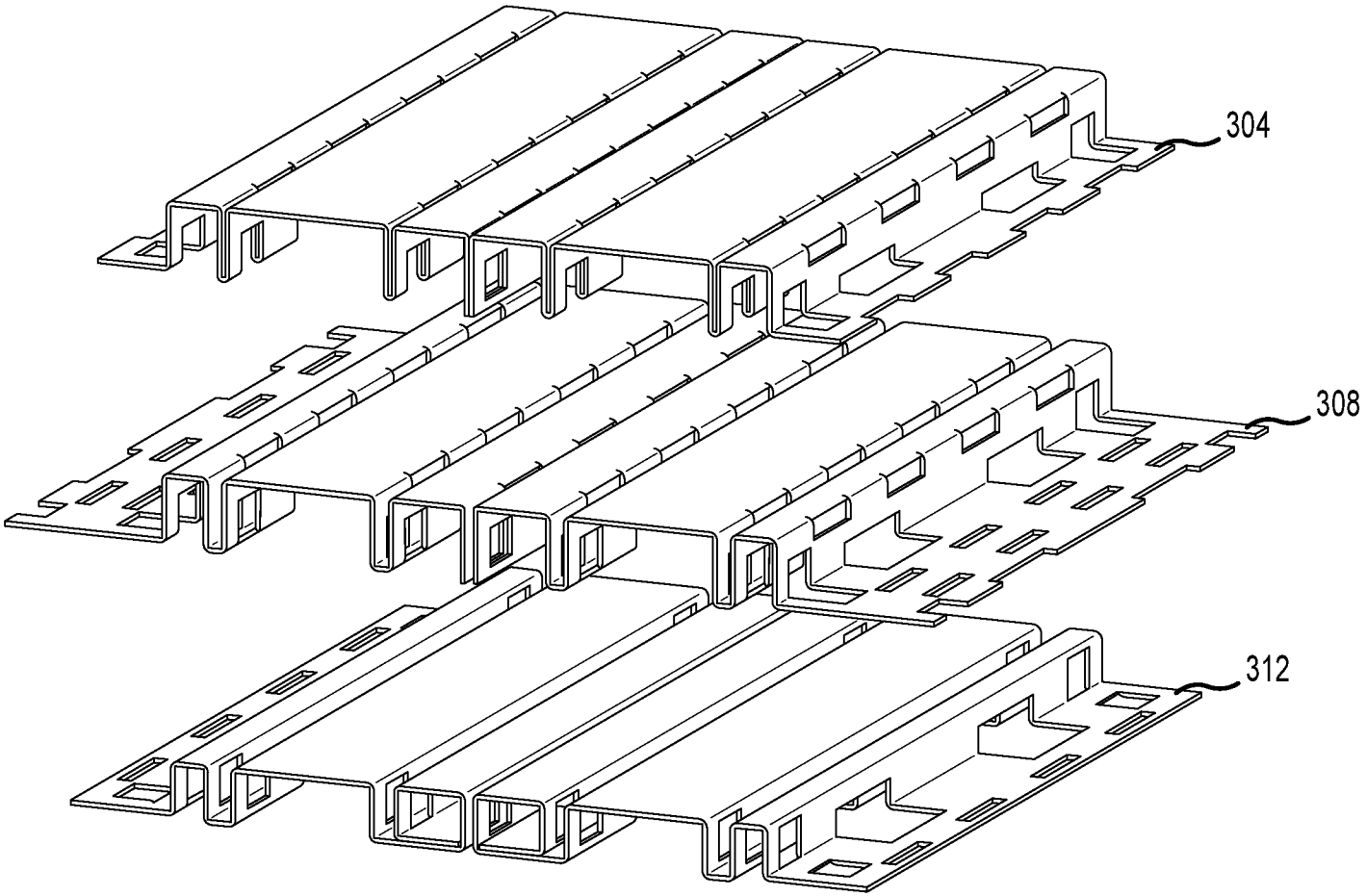
FIG. 23A is a perspective view of first longitudinal pieces of FIGS. 17A-17B, second longitudinal pieces of FIGS. 18A-18B, and third longitudinal pieces of FIGS. 19A-19B in accordance with embodiments of the present disclosure.
Figure 23B:
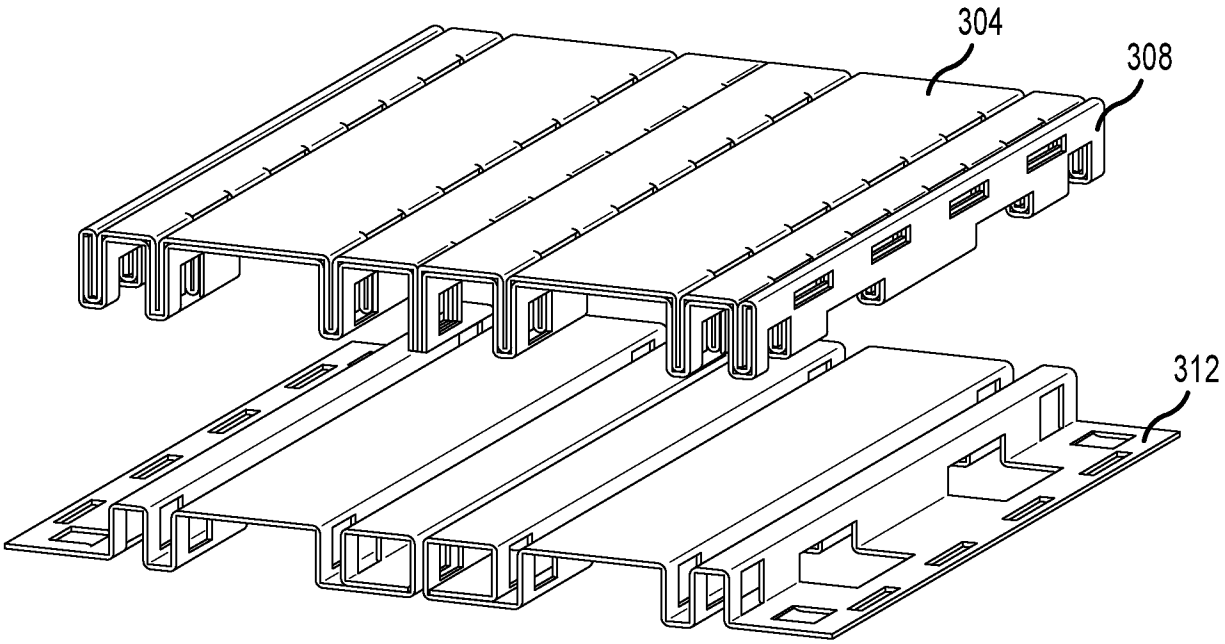
FIG. 23B is a perspective view of first longitudinal pieces of FIG. 23A positioned within second longitudinal pieces of FIG. 23A in accordance with embodiments of the present disclosure.
Figure 23C:
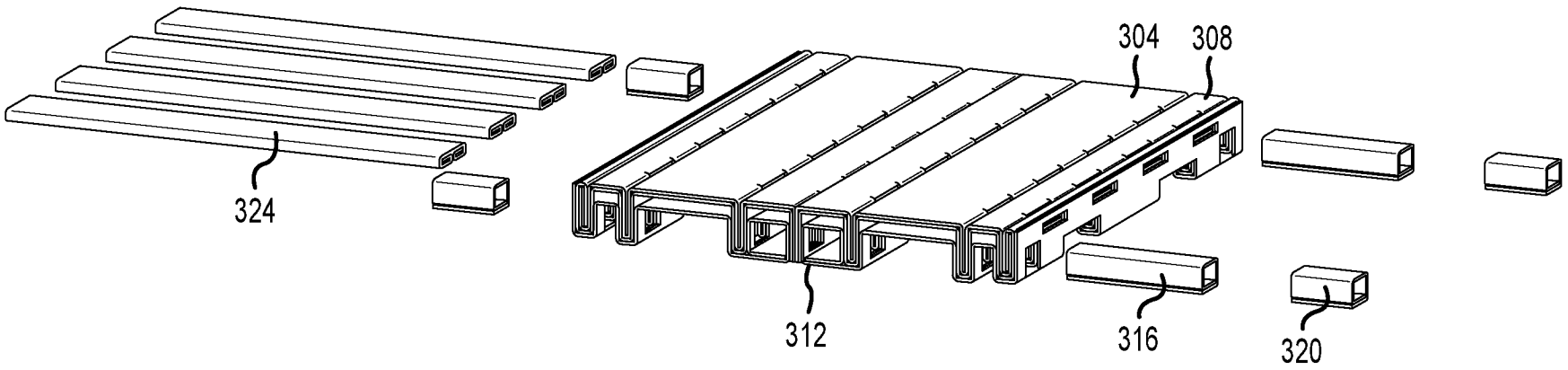
FIG. 23C is a perspective view of first and second transverse pieces of FIG. 23B positioned within third longitudinal pieces of FIG. 23B and a perspective view of first and second transverse pieces of FIGS. 20A-20C and third transverse pieces of FIGS. 21A-21B in accordance with embodiments of the present disclosure.

FIGS. 23A-23D show a sequence of assembling the various pieces to form a pallet. FIG. 23A shows two first longitudinal pieces 304, two second longitudinal pieces 308, and two third longitudinal pieces 312 positioned next to each other. FIG. 23B shows the first longitudinal piece 304 positioned within the second longitudinal piece 308, and FIG. 23C shows the first and second longitudinal pieces 304, 308 positioned within the third longitudinal piece 312. The combined arrangement of the longitudinal pieces 304, 308, 312 reinforces the vertical portions of the longitudinal pieces 304, 308, 312. FIG. 23C also shows the first, second, and third transverse pieces 316, 320, 324 prior to insertion through the respective transverse slots of the longitudinal pieces 304, 308, 312.

Figure 23D:
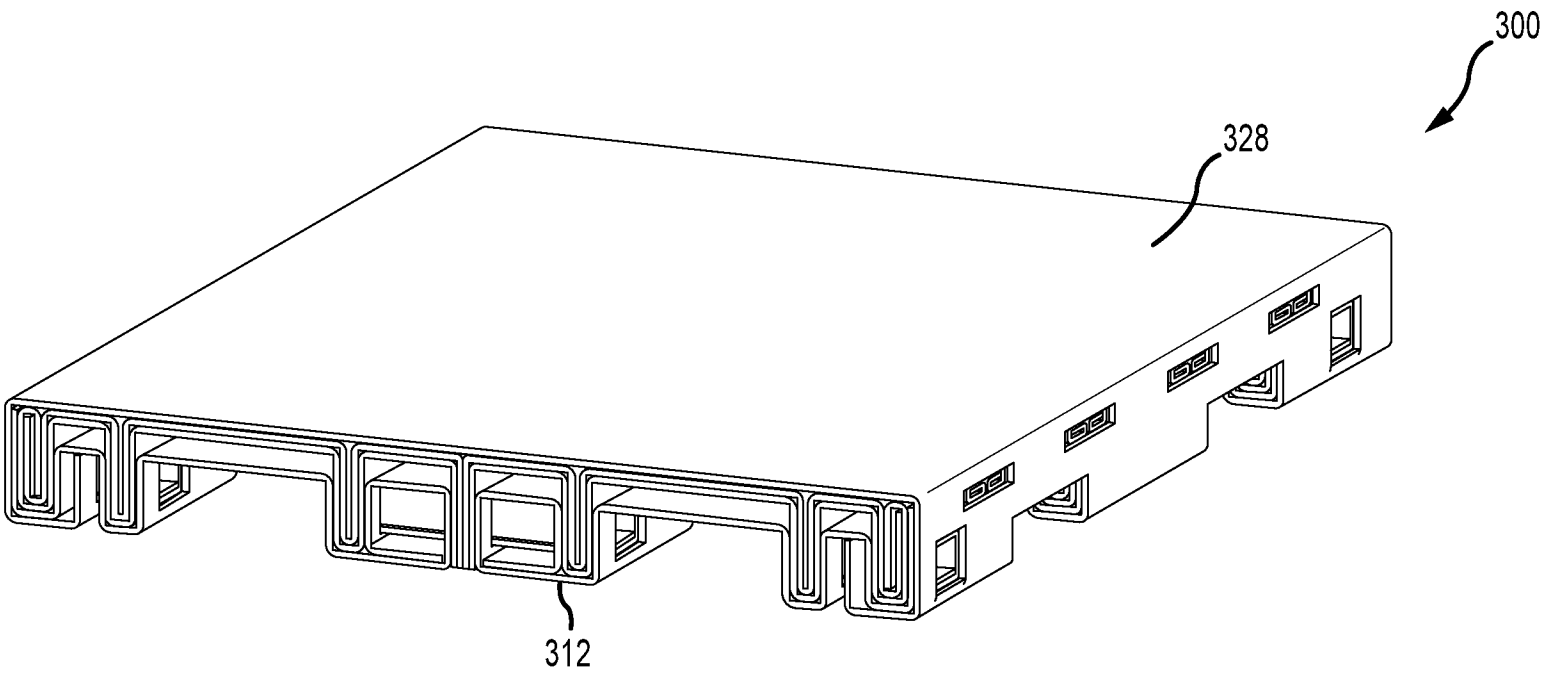
FIG. 23D is a perspective view of planar pieces of FIGS. 22A-22B placed on top of the pieces of FIG. 23C to form an assembled pallet in accordance with embodiments of the present disclosure.

FIG. 23D shows the planar piece 328 is positioned on top of the longitudinal pieces 304, 308, 312. In addition, the transverse pieces 316, 320, 324 positioned in the respective transverse slots of the pieces 304, 308, 312, 328 where the first and second transverse pieces 316, 320 are positioned in the first transverse slots of the pieces 304, 308, 312, 328, and the third transverse pieces 324 are positioned in the second transverse slots of the pieces 304, 308, 312, 328 to form a complete pallet 300.

Fourth Exemplary Embodiment

Figure 24B:
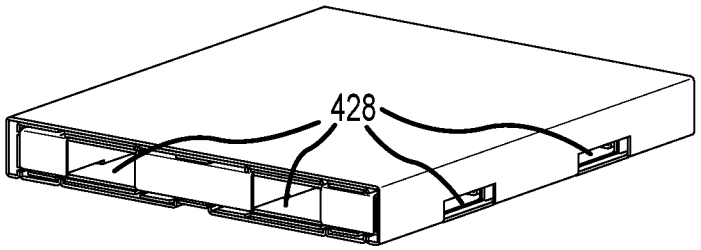
FIG. 24B is an assembled, perspective view of the pallet of FIG. 24A in accordance with embodiments of the present disclosure.
Figure 24A:
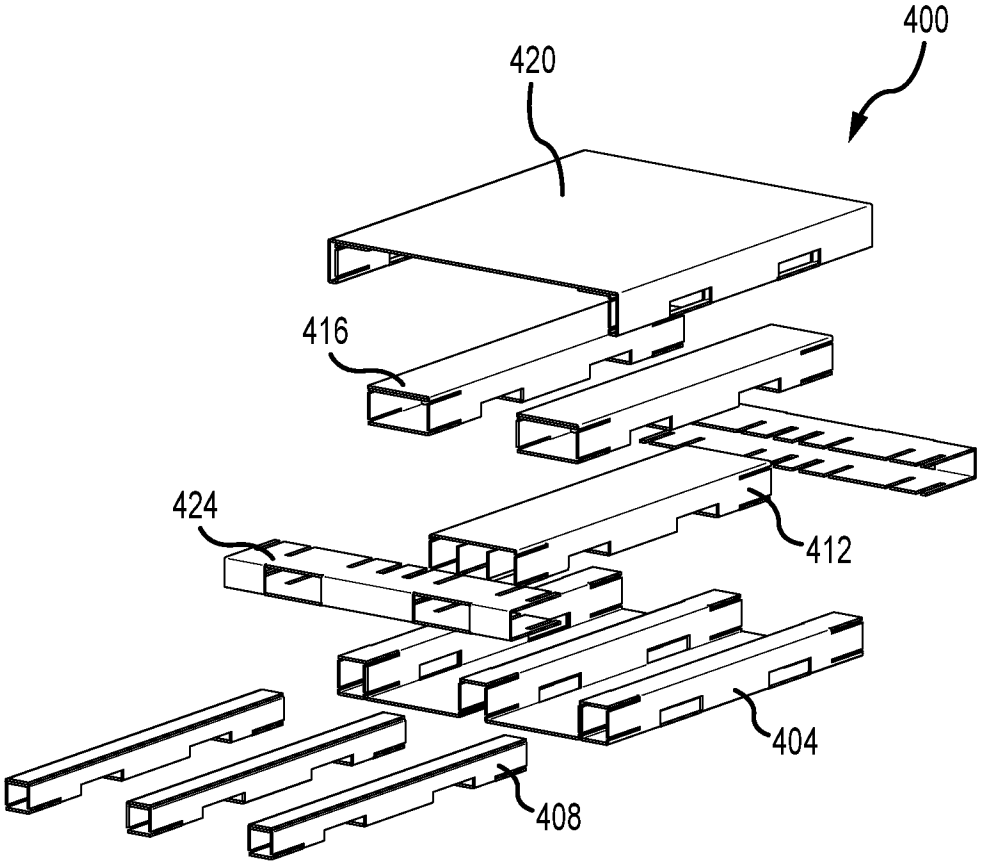
FIG. 24A is an exploded, perspective view of a pallet in accordance with embodiments of the present disclosure.

FIGS. 24A and 24B are an exploded view and an assembled view of a pallet 400, respectively. Referring to FIG. 24A, this embodiment of the pallet 400 comprises a first longitudinal piece 404, a second longitudinal piece 408, a third longitudinal piece 412, a fourth longitudinal piece 416, a transverse piece 424, and a planar piece 420. The longitudinal pieces 404, 408, 412, 416 are bent to provide horizontal and vertical portions that are generally oriented perpendicular to each other and extend in a longitudinal direction. The horizontal portions extend to define a width of the pallet 400 and also to define some apertures 428 configured to receive the forks of a forklift so that the pallet 400, once loaded, can be transported by the forklift. In this embodiment, the pallet 400 has two sets of apertures 428 so that the forklift can engage the pallet 400 from four different sides. The vertical portions define the smallest dimension of the pallet 400 and provide the requisite compressive strength to handle the loads, materials, devices, etc. placed on the top of the pallet 400. As described in further detail below, multiple pieces with vertical portions can be positioned within each other to reinforce the vertical portions and provide the requisite compressive strength of the pallet 400.

Next, transverse pieces 424 hold the longitudinal pieces 404, 408, 412, 416 in a final shape. The longitudinal pieces 404, 408, 412, 416 are each folded from a single piece of material such as cardboard. As a result, the longitudinal pieces 404, 408, 412, 416 have a tendency to unfurl or revert to their initial shapes or original planar shapes. The transverse piece 424 is oriented perpendicular to both the horizontal and vertical portions of the longitudinal pieces 404, 408, 412, 416 and lock into each longitudinal piece 404, 408, 412, 416 to hold the longitudinal pieces 404, 408, 412, 416 in their final shapes and to hold the horizontal and vertical portions in the desired orientations. This arrangement provides an interference fit between the transverse pieces 424 and the longitudinal pieces 404, 408, 412, 416 that holds the pieces 404, 408, 412, 416 together. The planar piece 420 provides a flat surface to receive materials. FIGS. 25A-30B describe the bend lines and other features of each individual piece, and FIGS. 31A-31E show a sequence of assembling the pieces to form a pallet 400.

Figure 25B:
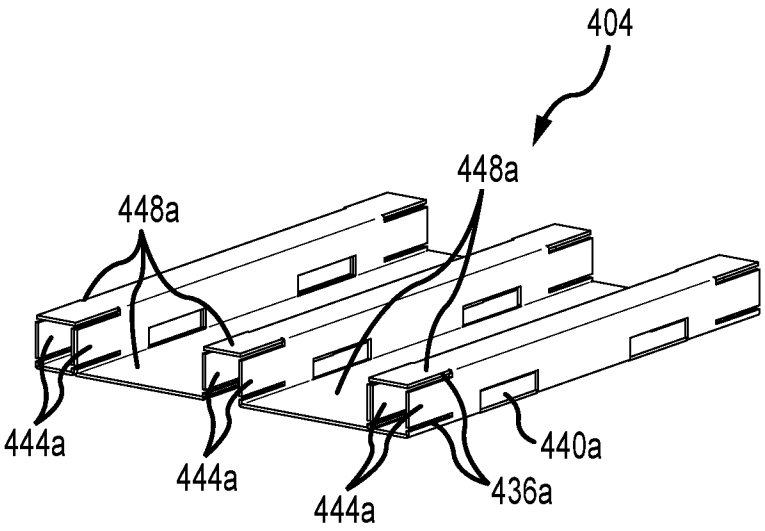
FIG. 25B is a perspective view of the first longitudinal piece of FIG. 25A in a final shape in accordance with embodiments of the present disclosure.
Figure 25A:
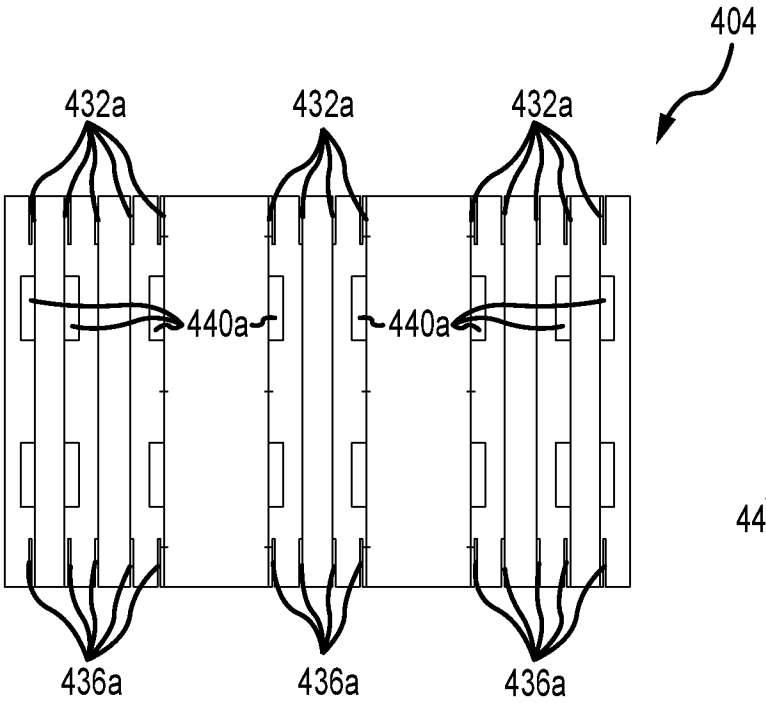
FIG. 25A is a top plan view of a first longitudinal piece in an initial shape in accordance with embodiments of the present disclosure.

FIGS. 25A and 25B show the first longitudinal piece 404 in an initial shape and a final shape, respectively. Referring to FIG. 25A, the first longitudinal piece 404 can be made from a single piece of material such as cardboard. To begin, a series of bend lines 432*a* extend along a longitudinal length of the piece 404, and the portions between the bend lines 432*a* are the horizontal and vertical portions that are described in more detail below with respect to FIG. 25B. Next, a series of transverse slots 436*a* are positioned along a bottom edge of the first longitudinal piece 404. As shown, the first longitudinal piece has fourteen transverse slots 436*a* along the bottom edge. In FIG. 25A, the piece 404 generally exhibits symmetry about a midline so there are twenty eight transverse slots 436*a* in total.

The first longitudinal piece 404 also has a series of fork slots 440*a* that define some fork apertures that are configured to receive the forks of a forklift. Eight slots define a fork slot 440*a* once the first longitudinal piece 404 is bent into a final shape. One fork slot 440*a* is identified on an upper half of the first longitudinal piece 404, and with symmetry about a midline, the first longitudinal piece 404 has two total fork slots 440*a*.

Referring to FIG. 25B, the first longitudinal piece 404 is shown in a final shape where the piece 404 has been bent about each bend line to define several horizontal portions 448*a* and vertical portions 444*a*. Also shown in FIG. 25B are the transverse slots 436*a* and the fork slots 440*a*.

Figure 26B:
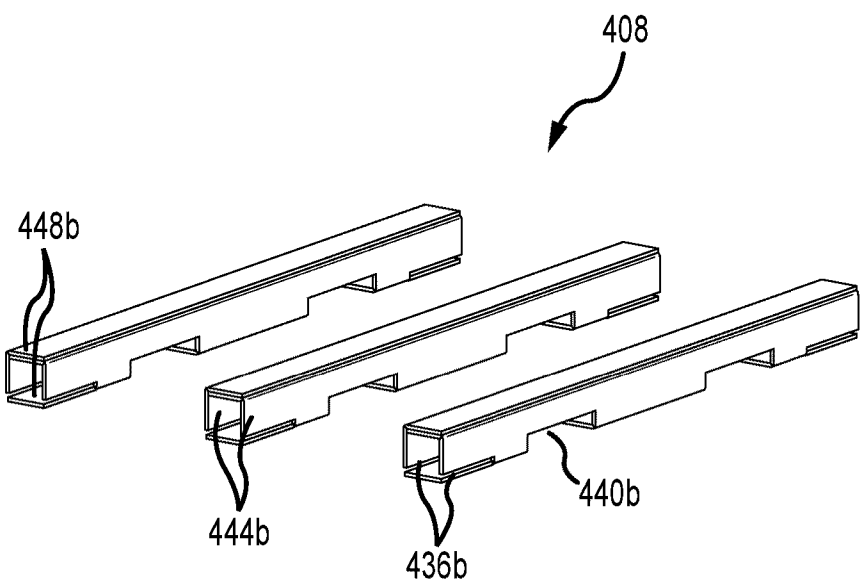
FIG. 26B is a perspective view of the second longitudinal piece of FIG. 26A in a final shape in accordance with embodiments of the present disclosure.
Figure 26A:
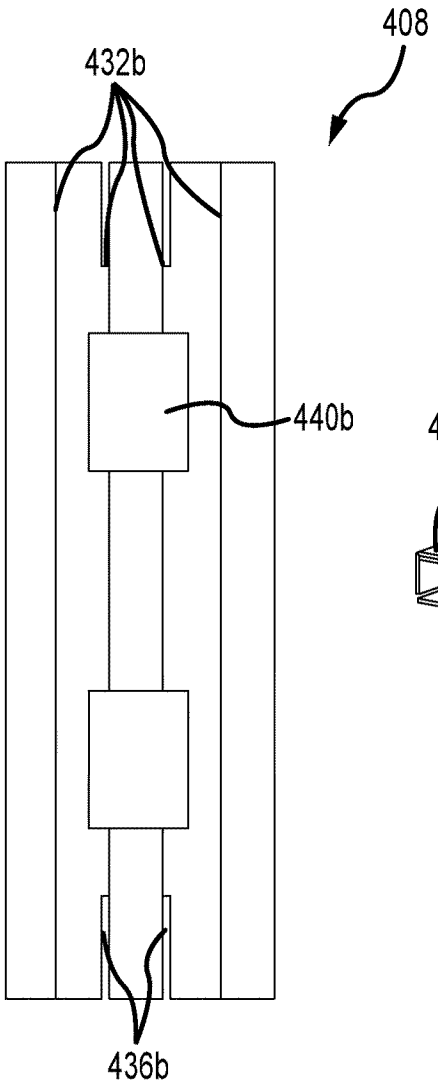
FIG. 26A is a top plan view of a second longitudinal piece in an initial shape in accordance with embodiments of the present disclosure.

FIGS. 26A and 26B show a second longitudinal piece 408 in an initial shape and a final shape, respectively. Referring to FIG. 26A, the second longitudinal piece 408 can be made from a single piece of material such as cardboard. To begin, a series of bend lines 432*b* extend along a longitudinal length of the piece 408, and the portions between the bend lines 432*b* are the horizontal and vertical portions that are described in more detail below with respect to FIG. 26B. Next, a series of transverse slots 436*b* are positioned along a bottom edge of the second longitudinal piece 408. As shown, the second longitudinal piece 408 has two transverse slots 436*b* along the bottom edge. In FIG. 26A, the piece 408 generally exhibits symmetry about a midline so there are four transverse slots 436*b* in total.

The second longitudinal piece 408 also has a fork slot 440*b* that partially defines some fork apertures that are configured to receive the forks of a forklift. One fork slot 440*b* is shown on an upper half of the second longitudinal piece 408, and with symmetry about a midline, the second longitudinal piece 408 has two total fork slots 440*b*.

Referring to FIG. 26B, the second longitudinal piece 408 is shown in a final shape where the piece 408 has been bent about each bend line, and the second longitudinal piece 408 generally has a rectangular cross sectional shape. Also shown in FIG. 26B are the transverse slots 436*b* and the fork slots 440*b*. Three second longitudinal pieces 408 are utilized in the assembly of the pallet.

Figure 27B:
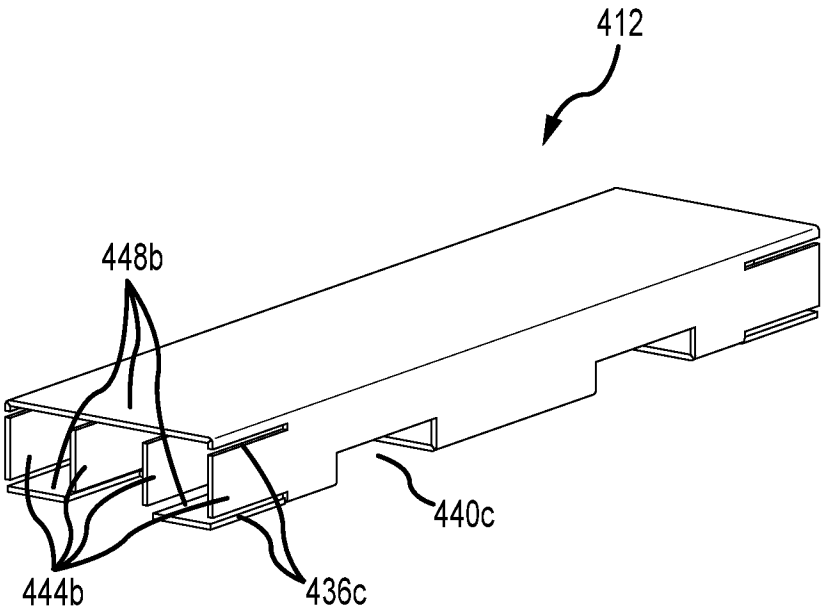
FIG. 27B is a perspective view of the third longitudinal piece of FIG. 27A in a final shape in accordance with embodiments of the present disclosure.
Figure 27A:
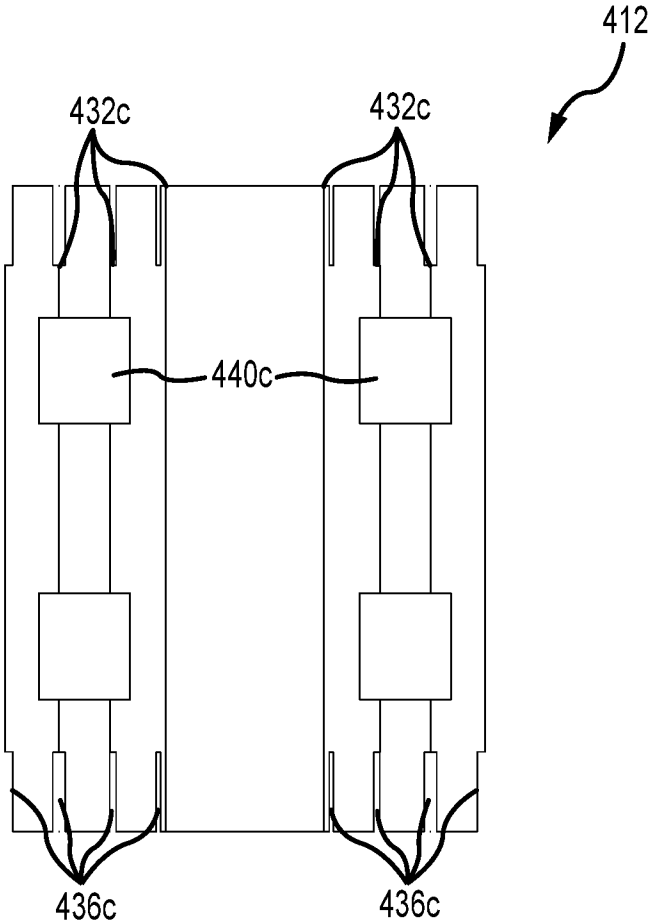
FIG. 27A is a top plan view of a third longitudinal piece in an initial shape in accordance with embodiments of the present disclosure.

FIGS. 27A and 27B show a third longitudinal piece 412 in an initial shape and a final shape, respectively. Referring to FIG. 27A, the third longitudinal piece 412 can be made from a single piece of material such as cardboard. To begin, a series of bend lines 432*c* extend along a longitudinal length of the piece 412, and the portions between the bend lines 432*c* are the horizontal and vertical portions that are described in more detail below with respect to FIG. 27B. Next, a series of transverse slots 436*c* are positioned along a bottom edge of the third longitudinal piece 412. As shown, the third longitudinal piece 412 has eight transverse slots 436*c* along the bottom edge. In FIG. 27A, the piece 412 generally exhibits symmetry about a midline so there are sixteen transverse slots 436*c* in total.

The third longitudinal piece 412 also has a fork slot 440*c* that partially defines some fork apertures that are configured to receive the forks of a forklift. Two slots define a fork slot 440*c* once the third longitudinal piece 412 is bent into a final shape. One fork slot 440*c* is shown on an upper half of the third longitudinal piece 412, and with symmetry about a midline, the third longitudinal piece 412 has two total fork slots 440*c*.

Referring to FIG. 27B, the third longitudinal piece 412 is shown in a final shape where the piece 412 has been bent about each bend line to define horizontal portions 448*c* and vertical portions 444*c*, and the third longitudinal piece 412 generally has a rectangular cross sectional shape. Also shown in FIG. 27B are the transverse slots 436*c* and the fork slots 440*c*.

Figure 28B:
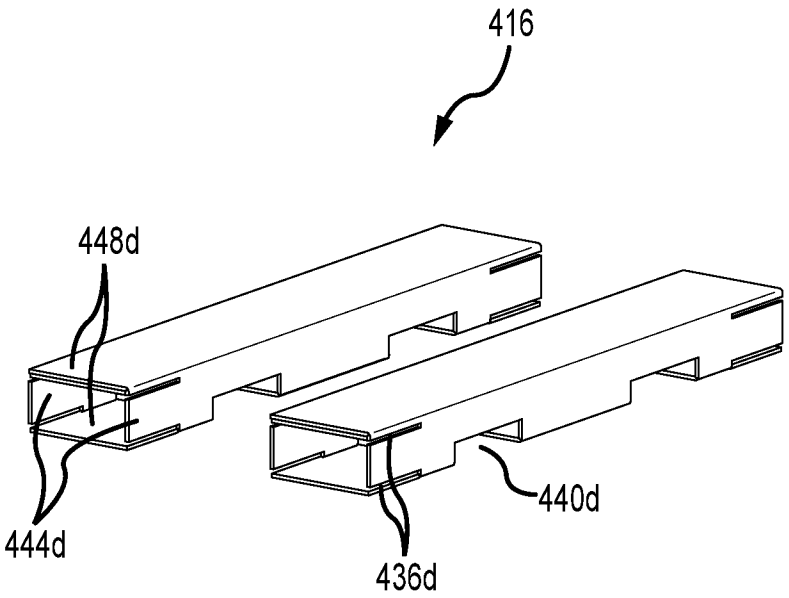
FIG. 28B is a perspective view of the fourth longitudinal piece of FIG. 28A in a final shape in accordance with embodiments of the present disclosure.
Figure 28A:
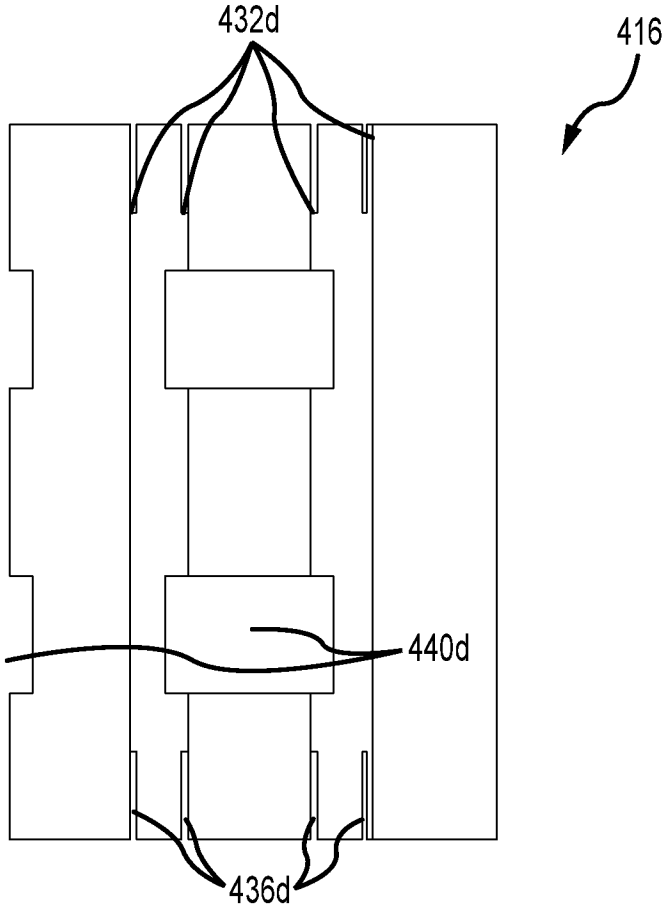
FIG. 28A is a top plan view of a fourth longitudinal piece in an initial shape in accordance with embodiments of the present disclosure.

FIGS. 28A and 28B show a fourth longitudinal piece 416 in an initial shape and a final shape, respectively. Referring to FIG. 28A, the fourth longitudinal piece 416 can be made from a single piece of material such as cardboard. To begin, a series of bend lines 432*d* extend along a longitudinal length of the piece 416, and the portions between the bend lines 432*d* are the horizontal and vertical portions that are described in more detail below with respect to FIG. 28B. Next, a series of transverse slots 436*d* are positioned along a bottom edge of the fourth longitudinal piece 416. As shown, the fourth longitudinal piece 416 has four transverse slots 436*d* along the bottom edge. In FIG. 28A, the piece 416 generally exhibits symmetry about a midline so there are eight transverse slots 436*d* in total.

The fourth longitudinal piece 416 also has fork slots 440*d* that partially define some fork apertures that are configured to receive the forks of a forklift. Two slots define a fork slot 440*d* once the fourth longitudinal piece 416 is bent into a final shape. One fork slot 440*d* is shown on an upper half of the fourth longitudinal piece 416, and with symmetry about a midline, the fourth longitudinal piece 416 has two total fork slots 440*d*.

Referring to FIG. 28B, the fourth longitudinal piece 416 is shown in a final shape where the piece 416 has been bent about each bend line to define horizontal portions 448*d* and vertical portions 444*d*, and the fourth longitudinal piece 416 generally has a rectangular cross sectional shape. Also shown in FIG. 28B are the transverse slots 436*d* and the fork slots 440*d*. Two fourth longitudinal pieces are used in the assembly of the pallet.

Figure 29B:
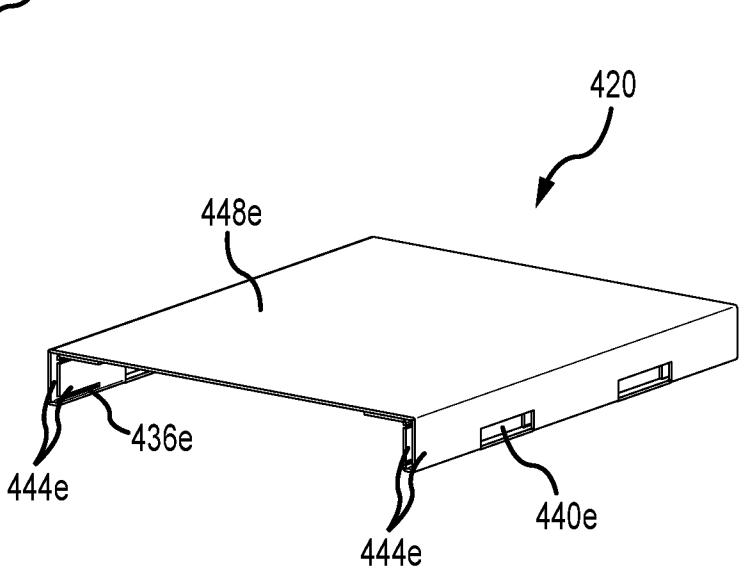
FIG. 29B is a perspective view of the planar piece of FIG. 29A in a final shape in accordance with embodiments of the present disclosure.
Figure 29A:
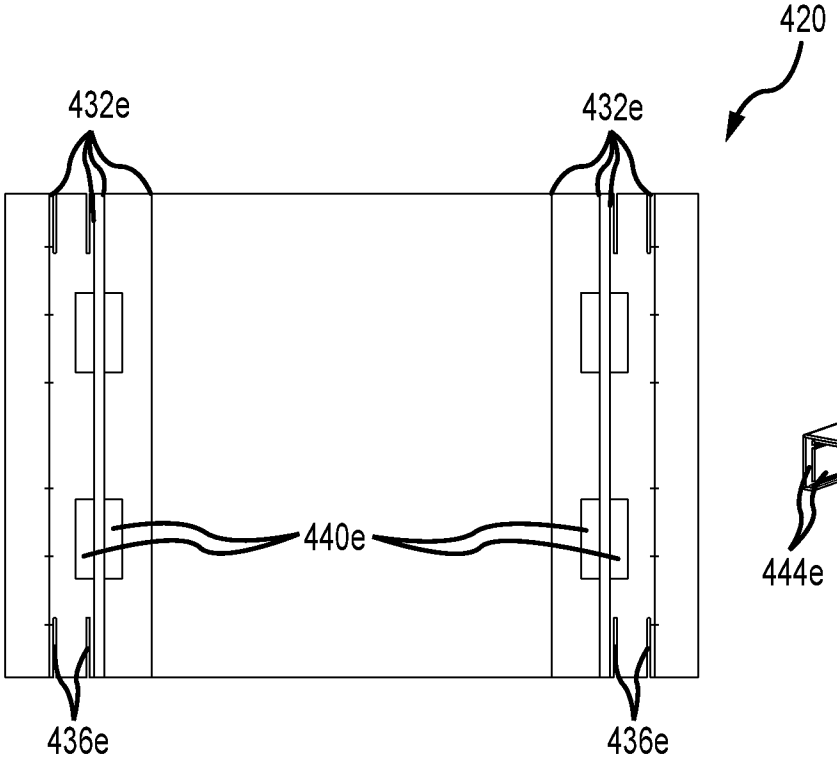
FIG. 29A is a top plan view of a planar piece in an initial shape in accordance with embodiments of the present disclosure.

FIGS. 29A and 29B show a planar piece 420 in an initial shape and a final shape, respectively. Referring to FIG. 29A, the planar piece 420 can be made from a single piece of material such as cardboard. To begin, a series of bend lines 432*e* extend along a longitudinal length of the piece 420, and the portions between the bend lines 432*e* are the horizontal and vertical portions that are described in more detail below with respect to FIG. 29B. Next, a series of transverse slots 436*e* are positioned along a bottom edge of the planar piece 420. As shown, the planar piece 420 has four transverse slots 436*e* along the bottom edge. In FIG. 29A, the piece 420 generally exhibits symmetry about a midline so there are eight transverse slots 436*e* in total.

The planar piece 420 also has fork slots 440*d* that partially define some fork apertures that are configured to receive the forks of a forklift. Four slots define a fork slot 440*e* once the planar piece 420 is bent into a final shape. One fork slot 440*e* is shown on a lower half of the planar piece 420, and with symmetry about a midline, the planar piece 420 has two total fork slots 440*e*.

Referring to FIG. 29B, the planar piece 420 is shown in a final shape where the piece 420 has been bent about each bend line to define horizontal portions 448*e* and vertical portions 444*e*. Also shown in FIG. 29B are the transverse slots 436*e* and the fork slots 440*e*.

Figure 30B:
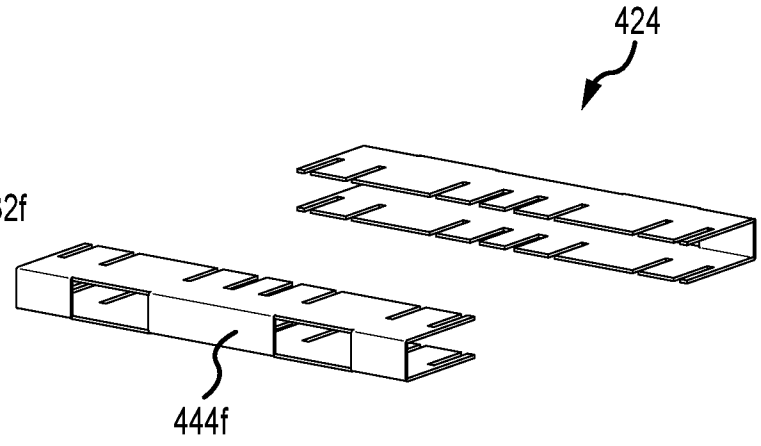
FIG. 30B is a perspective view of the transverse piece of FIG. 30A in a final shape in accordance with embodiments of the present disclosure.
Figure 30A:
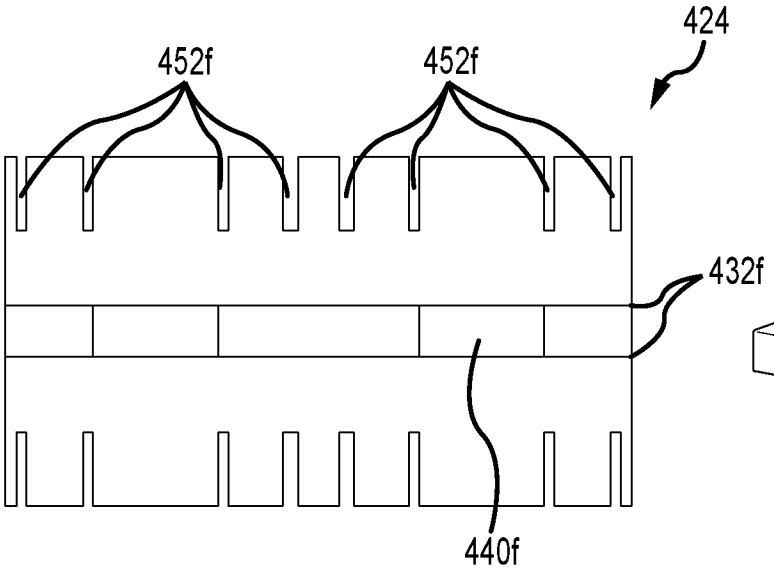
FIG. 30A is a top plan view of a transverse piece in an initial shape in accordance with embodiments of the present disclosure.

FIGS. 30A and 30B show a transverse piece 424 in an initial shape and a final shape, respectively. Referring to FIG. 30A, the transverse piece 424 may be made from a single piece of planar cardboard. Bend lines 432*f* extend across the transverse piece 424, and the transverse piece 424 has two fork slots 440*f*. Next, the transverse piece 424 has a series of recesses 452*f*. These recesses 452*f* generally correspond to vertical portions of the longitudinal pieces and the planar piece. This allows the transverse piece 424 to extend completely downward into the transverse slots of these other pieces so that the top of the transverse piece 424 is flush or substantially flush with the tops of the other pieces. Referring to FIG. 30B, the transverse piece 424 is folded about the bend line. Like the longitudinal pieces, the transverse piece 424 also generally has some bias back towards the initial position. This aspect helps lock the transverse piece 424 into the transverse slots in an interference fit.

Figure 31A:
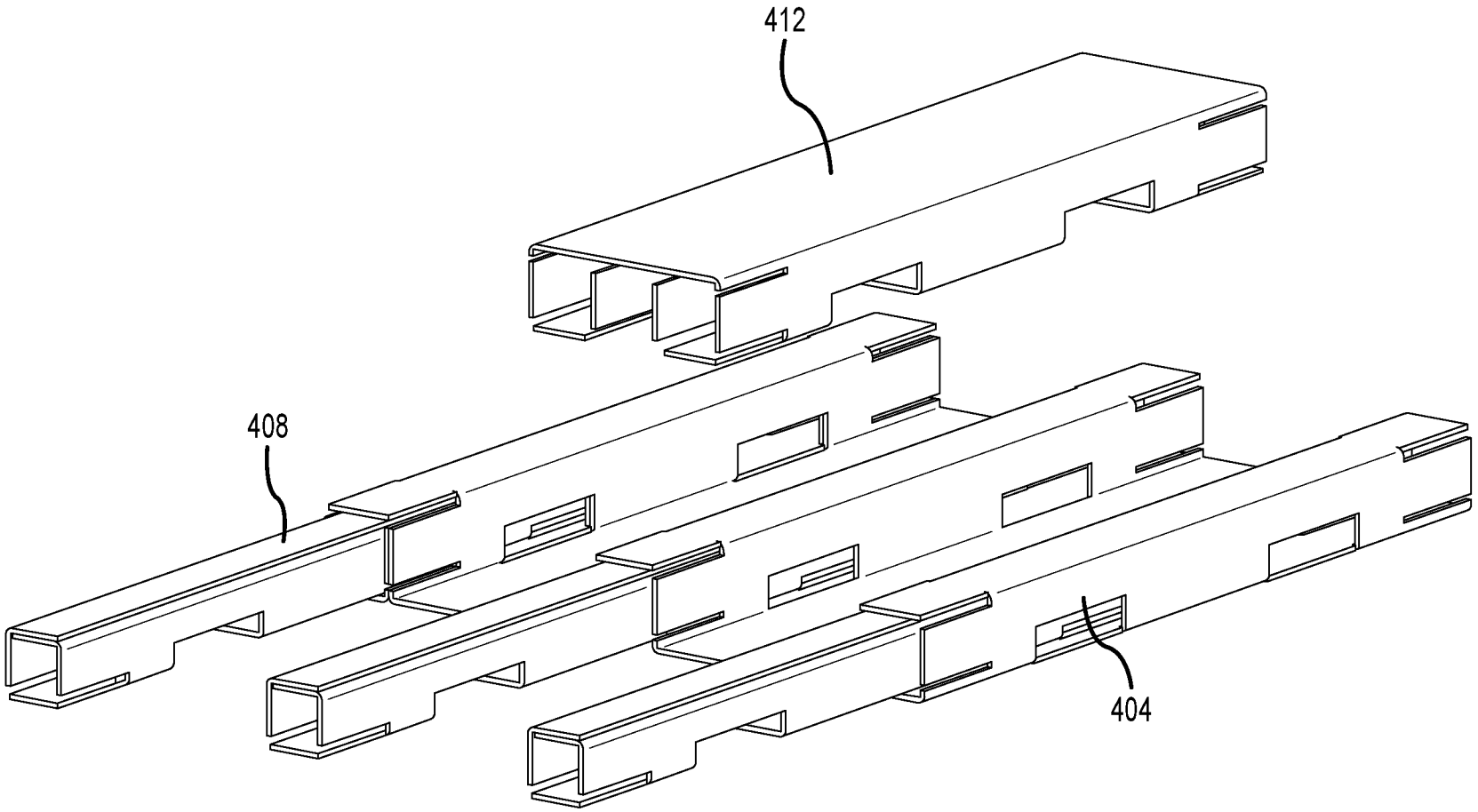
FIG. 31A is a perspective view of first longitudinal pieces of FIGS. 25A-25B, second longitudinal pieces of FIGS. 26A-26B, and third longitudinal pieces of FIGS. 27A-27B in accordance with embodiments of the present disclosure.
Figure 31B:
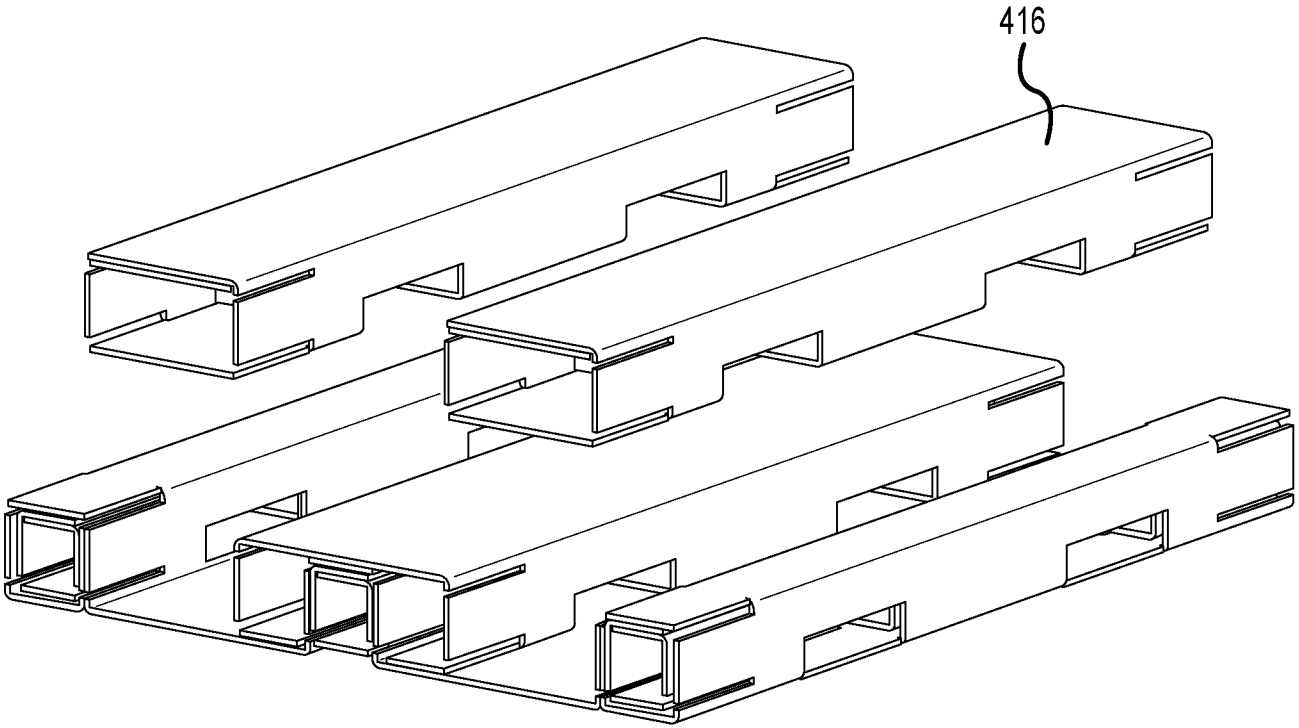
FIG. 31B is a perspective view of fourth longitudinal pieces of FIGS. 28A-28B and the pieces of FIG. 31A in accordance with embodiments of the present disclosure.

FIGS. 31A-31E show a sequence of assembling the various pieces to form a pallet. FIG. 31A shows a first longitudinal piece 404, three second longitudinal pieces 408, and a third longitudinal piece 412 positioned next to each other. FIG. 31A shows the second longitudinal pieces 408 partially positioned within the first longitudinal piece 404. FIG. 31B shows the second longitudinal pieces 408 positioned within the first longitudinal piece 404 and the third longitudinal piece 412 positioned within the first longitudinal piece 404. The fourth longitudinal piece 416 is positioned next to the combined longitudinal pieces 404, 408, 412.

Figure 31C:
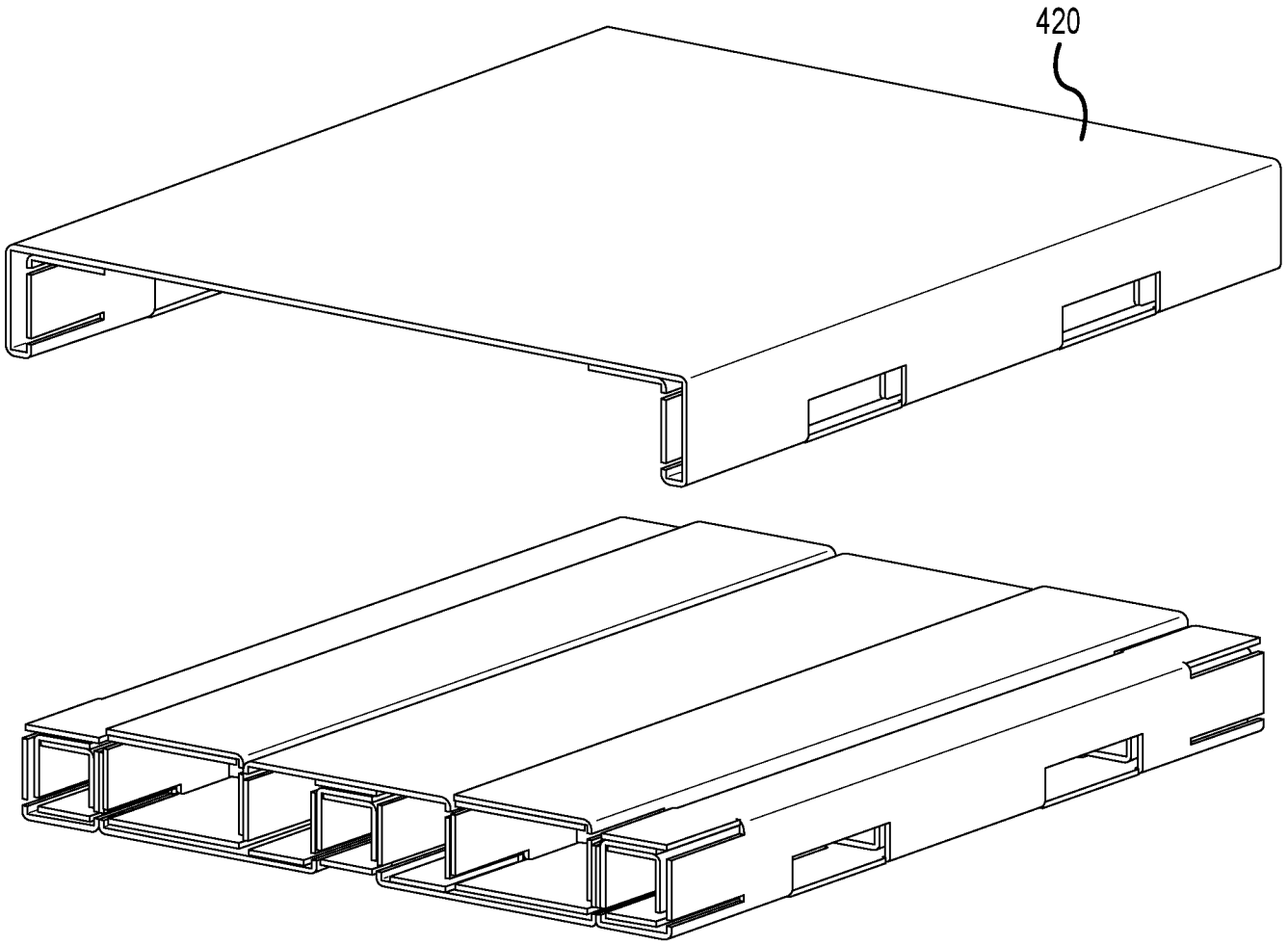
FIG. 31C is a perspective view of the planar piece of FIGS. 29A-29B and the pieces of FIG. 31B in accordance with embodiments of the present disclosure.
Figure 31D:
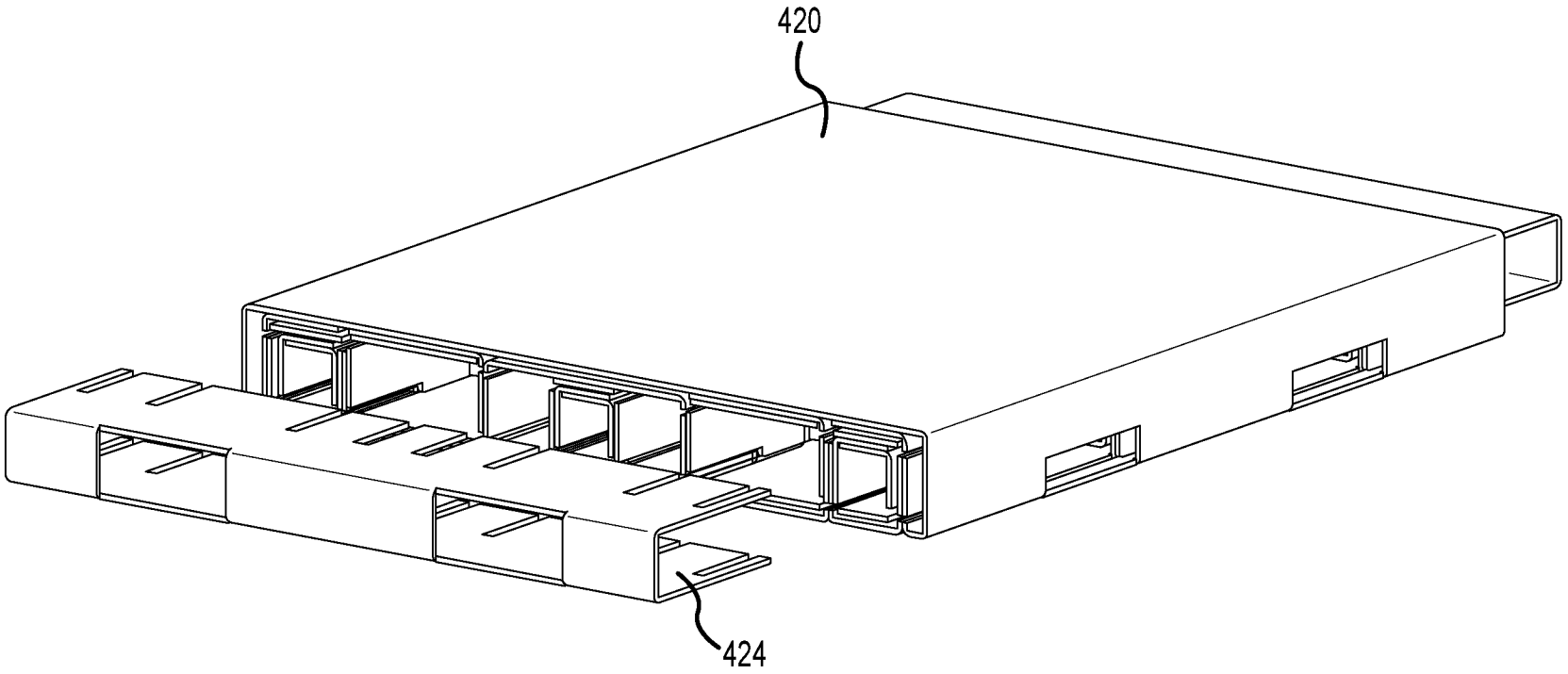
FIG. 31D is a perspective view of transverse pieces of FIGS. 30A-30B and the pieces of FIG. 31C in accordance with embodiments of the present disclosure.
Figure 31E:
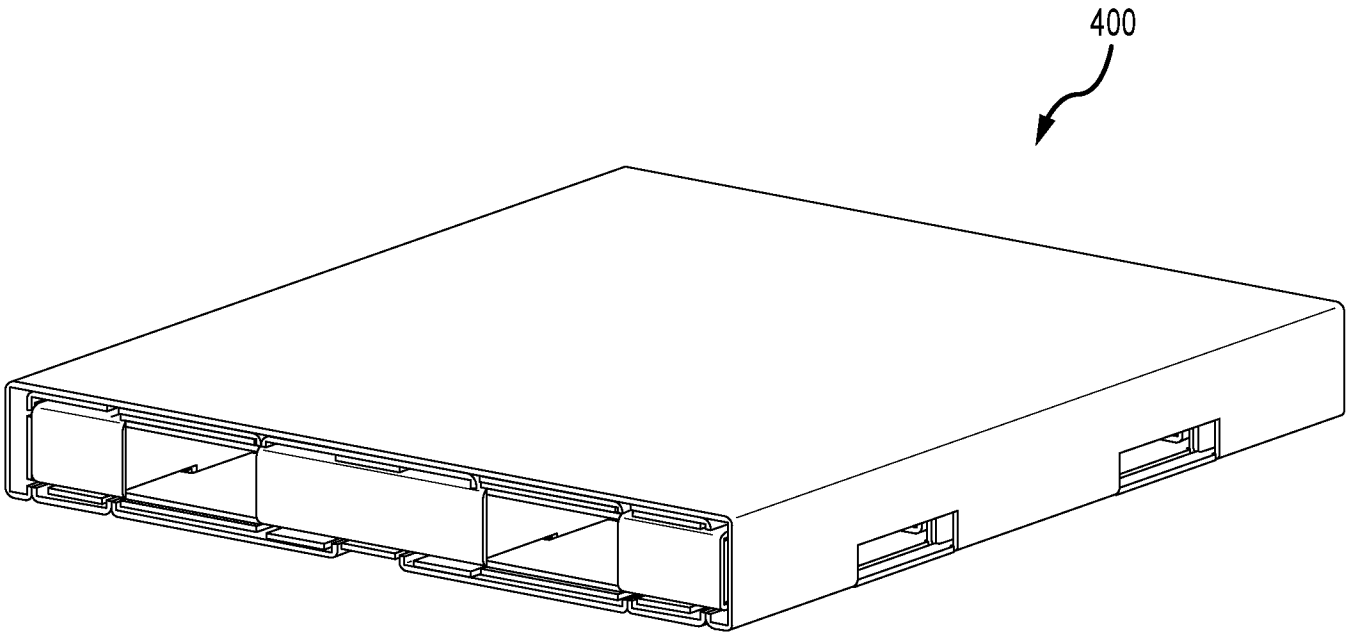
FIG. 31E is a perspective view of the pieces of FIG. 31D to form an assembled pallet in accordance with embodiments of the present disclosure.

FIG. 31C shows the longitudinal pieces 404, 408, 412, 416 assembled into a combined structure, and a planar piece 420 is positioned next to the combination of longitudinal pieces 404, 408, 412, 416. FIG. 31D shows the planar piece 420 positioned on top of the combined longitudinal pieces 404, 408, 412, 416, and the planar piece 420 provides a surface to load materials onto the pallet. FIG. 31D also shows two transverse pieces 424. In FIG. 31E, the transverse pieces are positioned in the transverse slots defined by the other pieces 404, 408, 412, 416, 420 to lock those pieces 404, 408, 412, 416, 420 into the respective final shapes and form a completed pallet 400.

Any one or more of the aspects/embodiments as substantially disclosed herein.

Any one or more of the aspects/embodiments as substantially disclosed herein optionally in combination with any one or more other aspects/embodiments as substantially disclosed herein.

One or means adapted to perform any one or more of the above aspects/embodiments as substantially disclosed herein.

The phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B and C together.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

What is claimed is:

1. A pallet assembly, comprising:

a first longitudinal piece and a second longitudinal piece, each of the first and second longitudinal pieces having:

a plurality of bend lines, wherein each longitudinal piece is configured to bend along the plurality of bend lines from an initial shape to a final shape, at least one horizontal portion defined between two bend lines of the plurality of bend lines, at least one vertical portion defined between two bend lines of the plurality of bend lines, wherein one horizontal portion of the at least one horizontal portion extends further in a direction perpendicular to the plurality of bend lines than any vertical portion of the at least one vertical portion, and at least one transverse slot extending substantially parallel to the plurality of bend lines; and a transverse piece selectively connected to the at least one transverse slot of each of the first and second longitudinal pieces to secure each of the first and second longitudinal pieces in the final shape, wherein at least a portion of the transverse piece is perpendicular to the at least one horizontal portion and the at least one vertical portion of each of the first and second longitudinal pieces when each of the first and second longitudinal pieces is in the final shape.

2. The pallet assembly of claim 1, further comprising:

a planar piece having a first end selectively connected to a planar slot in at least one of the first longitudinal piece and the second longitudinal piece, and the planar piece having a second end selectively connected to an additional planar slot in at least one of the first longitudinal piece and the second longitudinal piece, wherein the planar piece has a horizontal portion that is substantially parallel with the at least one horizontal portion of each of the first and second longitudinal pieces, wherein transverse slots of the at least one transverse slot extend further in a direction parallel to the plurality of bend lines than the planar slot.

3. The pallet assembly of claim 1, wherein the transverse piece has at least one bend line, and the transverse piece is configured to bend along the at least one bend line from an initial shape to a final shape, and wherein the transverse piece is bent to the final shape prior to being selectively connected to the at least one transverse slot of each of the first and second longitudinal pieces.

4. The pallet assembly of claim 1, wherein each of the first and second longitudinal pieces is substantially planar in the initial shape.

5. The pallet assembly of claim 1, wherein each of the first and second longitudinal pieces and the transverse piece are made from a double-wall, kraft cardboard having a flute BC and an edge crush test of 42 pounds/inch.

6. The pallet assembly of claim 1, further comprising:

at least one fork slot configured to form at least a portion of a fork aperture, wherein the fork aperture is positioned on only a vertical portion of the at least one vertical portion.

7. A pallet system, comprising:

a longitudinal piece having:

a plurality of bend lines, wherein the longitudinal piece is configured to bend along the plurality of bend lines from an initial shape to a final shape, at least one horizontal portion defined between two bend lines of the plurality of bend lines, at least one vertical portion defined between two bend lines of the plurality of bend lines, at least one transverse slot, and at least one fork slot configured to form at least a portion of a fork aperture, wherein the fork aperture is positioned on only a vertical portion of the at least one vertical portion;

a transverse piece having at least one recess, wherein the transverse piece selectively connects to the longitudinal piece at the at least one transverse slot to secure the longitudinal piece in the final shape, and the at least one recess engages the at least one vertical portion of the longitudinal piece, wherein at least a portion of the transverse piece is perpendicular to the at least one horizontal portion and the at least one vertical portion of the longitudinal piece; and a planar piece having a first end selectively connected to a planar slot in the longitudinal piece, and the planar piece having a second end selectively connected to an additional planar slot in the longitudinal piece, wherein the planar piece has a horizontal portion that is substanially parallel with the at least one horizontal portion of the longitudinal piece, and wherein tranverse slots of the at least one transverse slot extend further in a direction parallel to the plurality of bend lines than the planar slot.

8. The pallet system of claim 7, wherein the longitudinal piece at least partially defines four fork apertures, wherein a first fork aperture and a second fork aperture of the four fork apertures are substantially parallel to each other.

9. The pallet system of claim 8, wherein a third fork aperture and a fourth fork aperture are substantially parallel to each other, and wherein the first and second fork apertures intersect the third and fourth fork apertures.

10. The pallet system of claim 7, wherein the transverse piece has at least one bend line, and the transverse piece is configured to bend along the at least one bend line from an initial shape to a final shape, and wherein the transverse piece is bent to the final shape prior to being selectively connected to the at least one transverse slot of the longitudinal piece.

11. The pallet system of claim 7, wherein one horizontal portion of the at least one horizontal portion extends further in a direction perpendicular to the plurality of bend lines than any vertical portion of the at least one vertical portion.

12. A pallet assembly, comprising:

a first longitudinal piece and a second longitudinal piece, each of the first and second longitudinal pieces having:

a plurality of bend lines, wherein each of the first and second longitudinal pieces is configured to bend along the plurality of bend lines from an initial shape to a final shape, at least one horizontal portion defined between two bend lines of the plurality of bend lines, at least one vertical portion defined between two bend lines of the plurality of bend lines, wherein one horizontal portion of the at least one horizontal portion extends further in a direction perpendicular to the plurality of bend lines than any vertical portion of the at least one vertical portion, and at least one transverse slot;

a transverse piece selectively connected to the at least one transverse slot of each of the first and second longitudinal pieces to secure each of the first and second longitudinal pieces in the final shape, wherein at least a portion of the transverse piece is perpendicular to the at least one horizontal portion and the at least one vertical portion of each of the first and second longitudinal pieces when each of the first and second longitudinal pieces is in the final shape; and a planar piece having a first end selectively connected to a planar slot in at least one of the first longitudinal piece and the second longitudinal piece, and the planar piece having a second end selectively connected to an additional planar slot in at least one of the first longitudinal piece and the second longitudinal piece, wherein the planar piece has a horizontal portion that is substantially parallel with the at least one horizontal portion of each of the first and second longitudinal pieces, and wherein the transverse slots of the at least one transverse slot extend further in a direction parallel to the plurality of bend lines than the planar slot.

13. The pallet assembly of claim 12, wherein the at least one transverse slot of the first and second longitudinal pieces extends substantially perpendicular to the plurality of bend lines.

14. The pallet assembly of claim 12, wherein the at least one transverse slot of the first and second longitudinal pieces extends substantially parallel to the plurality of bend lines.

15. The pallet assembly of claim 12, wherein the transverse piece has at least one bend line, and the transverse piece is configured to bend along the at least one bend line from an initial shape to a final shape, and wherein the transverse piece is bent to the final shape prior to being selectively connected to the at least one transverse slot of each of the first and second longitudinal pieces.

16. The pallet assembly of claim 12, wherein the at least one transverse slot of each of the first and second longitudinal pieces extends across at least one bend line of the plurality of bend lines of each of the first and second longitudinal pieces.

17. The pallet assembly of claim 12, wherein each of the first and second longitudinal pieces is substantially planar in the initial shape.

18. The pallet assembly of claim 12, wherein each of the first and second longitudinal pieces and the transverse piece are made from a double-wall, kraft cardboard having a flute BC and an edge crush test of 42 pounds/inch.

* * * * *